US011401099B2

(12) United States Patent
Stephens et al.

(10) Patent No.: US 11,401,099 B2
(45) **Date of Patent: *Aug. 2, 2022**

(54) SOFT-SIDED INSULATED CONTAINER WITH HARD-SIDED LINER

(71) Applicant: CALIFORNIA INNOVATIONS INC., Toronto (CA)

(72) Inventors: Richard C. Stephens, Chicago, IL (US); William Kearns, Brampton (CA); Evan R. Olander, North York (CA); Yongbing Guo, Shenzhen (CN)

(73) Assignee: CALIFORNIA INNOVATIONS INC.

( * ) Notice: Subject to any disclaimer, the term of this patent is extended or adjusted under 35 U.S.C. 154(b) by 0 days.

This patent is subject to a terminal disclaimer.

(21) Appl. No.: 16/728,848

(22) Filed: Dec. 27, 2019

(65) Prior Publication Data

US 2021/0188521 A1 Jun. 24, 2021

Related U.S. Application Data

(63) Continuation-in-part of application No. 16/722,775, filed on Dec. 20, 2019.

(51) Int. Cl.
*B65D 81/38* (2006.01)
*B65D 43/22* (2006.01)
(Continued)

(52) U.S. Cl.
CPC ..... *B65D 81/3823* (2013.01); *B65D 25/2841* (2013.01); *B65D 43/164* (2013.01); *B65D 43/22* (2013.01)

(58) Field of Classification Search
CPC ..... A45C 11/20; A45C 3/00; A45C 13/02; A45C 3/001; A45C 2005/037; F25D 3/08;
(Continued)

(56) References Cited

U.S. PATENT DOCUMENTS 1,700,615 A 1/1929 O'Brien
1,922,485 A 8/1933 McKee
(Continued)

FOREIGN PATENT DOCUMENTS

CA 2149491 A1 11/1996

OTHER PUBLICATIONS

Office Action dated Jan. 13, 2022 issued in corresponding U.S. Appl. No. 16/722,775.

*Primary Examiner* — Shawn M Braden
(74) *Attorney, Agent, or Firm* — Ostrolenk Faber LLP

(57) ABSTRACT

A soft-sided insulated container that has a rigid closure. The rigid closure has a first closure interface that is a passive friction fit in which one part wipes another. The rigid closure has a second closure interface that is an active closure in which a mechanical device, such as a latch or clamp, is used positively to energize a closure between different parts of the closure. The soft-sided insulated container has a soft-sided external casing, and a rigid internal liner that includes a mating rigid lid. There is a releasable securement that holds the liner in engagement with the casing, but that can be released to permit the casing to be extracted from the liner. The releasable securement is a one-way passively engageable securement.

63 Claims, 42 Drawing Sheets

(51) Int. Cl.
*B65D 43/16* (2006.01)
*B65D 25/28* (2006.01)

(58) Field of Classification Search
CPC ..... F25D 2331/804; B65D 81/3897; B65D 81/38
See application file for complete search history.

(56) References Cited

U.S. PATENT DOCUMENTS 1,949,677 A 3/1934 Crawford
1,964,795 A 7/1934 Frary
1,973,880 A 9/1934 Moody
2,289,254 A 7/1942 Eagles
2,555,126 A 5/1951 Greve
2,555,788 A 6/1951 Donaldson
2,645,332 A 7/1953 Martin et al.
2,720,208 A 10/1955 Gellman
2,808,093 A 10/1957 Gilman
2,827,096 A 3/1958 Hinson
2,883,041 A 4/1959 Pfeifer et al.
2,954,891 A 10/1960 Imber
3,001,566 A 9/1961 Lipsitz
3,238,002 A 3/1966 O'Connell et al.
3,255,607 A 6/1966 Bair et al.
3,295,709 A 1/1967 Herrick et al.
3,390,703 A 7/1968 Matlow
3,572,054 A 3/1971 Curcio
3,791,547 A 2/1974 Branscum
3,998,072 A 12/1976 Shaw
4,050,264 A 9/1977 Tanaka
4,085,785 A 4/1978 Hoot
4,210,186 A 7/1980 Belenson
4,260,004 A 4/1981 Domke
4,286,440 A 9/1981 Taylor
4,323,180 A 4/1982 Sloop
D273,533 S 4/1984 Weinreb
4,468,933 A 9/1984 Christopher
4,499,998 A 2/1985 Carlson
4,506,769 A 3/1985 Franco et al.
4,513,895 A 4/1985 Leslie
4,537,313 A 8/1985 Workman
4,541,540 A 9/1985 Gratz et al.
4,551,988 A 11/1985 Petrantoni
4,598,746 A 7/1986 Rabinowitz
4,610,286 A 9/1986 Cyr
4,629,040 A 12/1986 Jones
4,648,121 A 3/1987 Lowe
4,655,052 A 4/1987 Garcia
4,667,489 A * 5/1987 Seitz ..... D04B 35/32 66/168
4,673,117 A 6/1987 Galton
4,805,776 A 2/1989 Namgyal et al.
4,819,793 A 4/1989 Willard et al.
4,877,128 A 10/1989 Strickland
4,889,257 A 12/1989 Steffes
4,916,923 A 4/1990 Adams et al.
4,929,094 A 5/1990 Becker
D312,530 S 12/1990 Gallen et al.
4,984,662 A 1/1991 Jacober
5,095,718 A 3/1992 Ormond et al.
D328,550 S 8/1992 Mogil et al.
5,156,291 A 10/1992 Meilke
D340,387 S 10/1993 Melk
D340,621 S 10/1993 Melk
D340,840 S 11/1993 Melk
5,337,911 A 8/1994 Holub
5,354,131 A 10/1994 Mogil
D355,568 S 2/1995 Paulin
5,403,095 A * 4/1995 Melk ..... A45C 11/20 220/23.87
5,421,172 A 6/1995 Jones
5,472,279 A 12/1995 Lin
D366,812 S 2/1996 Collins et al.
5,490,396 A 2/1996 Morris
5,501,338 A 3/1996 Preston
D368,387 S 4/1996 Bureau
D369,065 S 4/1996 Sylvestre et al.
5,505,307 A 4/1996 Shink
D370,123 S 5/1996 Klinger
D371,052 S 6/1996 Melk
5,524,761 A 6/1996 Wayman
5,537,911 A 7/1996 Ohlrogge
D373,514 S 9/1996 Melk
D373,515 S 9/1996 Melk
5,568,735 A 10/1996 Newkirk et al.
5,649,658 A 7/1997 Hoffman
D382,771 S 8/1997 Mogil
D382,772 S 8/1997 Mogil
5,671,611 A 9/1997 Quigley
D387,249 S 12/1997 Mogil
D391,121 S 2/1998 Melk
D394,552 S 5/1998 Melk
5,857,778 A 1/1999 Ells
D408,225 S 4/1999 Hodosh
5,904,230 A 5/1999 Peterson
5,924,303 A 7/1999 Hodosh
5,938,646 A 8/1999 Carter
D419,770 S 2/2000 Mogil
6,027,249 A 2/2000 Bielinski
D421,366 S 3/2000 Mogil
6,047,976 A 4/2000 Wang
6,067,816 A 5/2000 Hodosh
6,068,402 A 5/2000 Freese et al.
6,092,661 A 7/2000 Mogil
6,105,844 A 8/2000 Walters et al.
6,116,045 A 9/2000 Hodosh
D435,342 S 12/2000 Mogil
D435,968 S 1/2001 Mogil
D436,442 S 1/2001 Mogil
6,234,677 B1 5/2001 Mogil
6,237,776 B1 5/2001 Mogil
6,238,091 B1 5/2001 Mogil
6,247,328 B1 6/2001 Mogil
D445,307 S 7/2001 Fickle
D446,937 S 8/2001 Mogil
6,296,165 B1 10/2001 Mears
D452,075 S 12/2001 Mogil
6,336,342 B1 1/2002 Zeddies
D453,625 S 2/2002 Mogil
6,363,739 B1 4/2002 Hodosh
6,439,389 B1 8/2002 Mogil
6,474,095 B1 11/2002 Chan
6,481,239 B2 11/2002 Hodosh
6,513,661 B1 2/2003 Mogil
6,582,124 B2 6/2003 Mogil
6,644,063 B2 11/2003 Mogil
6,821,019 B2 11/2004 Mogil
7,162,890 B2 1/2007 Mogil
7,669,436 B2 3/2010 Mogil
7,988,006 B2 8/2011 Mogil et al. ..... 220/23.89
8,901,819 B2 12/2014 Seiders
9,187,232 B2 11/2015 Seiders
9,834,342 B2 12/2017 Seiders
10,046,900 B2 8/2018 Seiders
2002/0126920 A1 9/2002 Mogil
2004/0035143 A1* 2/2004 Mogil ..... A45C 7/0077 62/457.2
2005/0056046 A1 3/2005 Fuchs
2005/0279123 A1 12/2005 Maldonado
2006/0076352 A1* 4/2006 Peterson ..... B65D 43/169 220/254.3
2010/0133326 A1* 6/2010 Sanchez ..... B65D 81/3876 229/87.03
2011/0121002 A1* 5/2011 Stiller ..... B65D 21/083 220/504
2014/0054298 A1* 2/2014 Hwang ..... A45C 11/20 220/592.2
2014/0091103 A1* 4/2014 Neitzel ..... B65D 83/0805 220/833
2015/0136796 A1* 5/2015 Muehlhauser ..... B65D 1/225 220/592.2

* cited by examiner

FIG. 6A
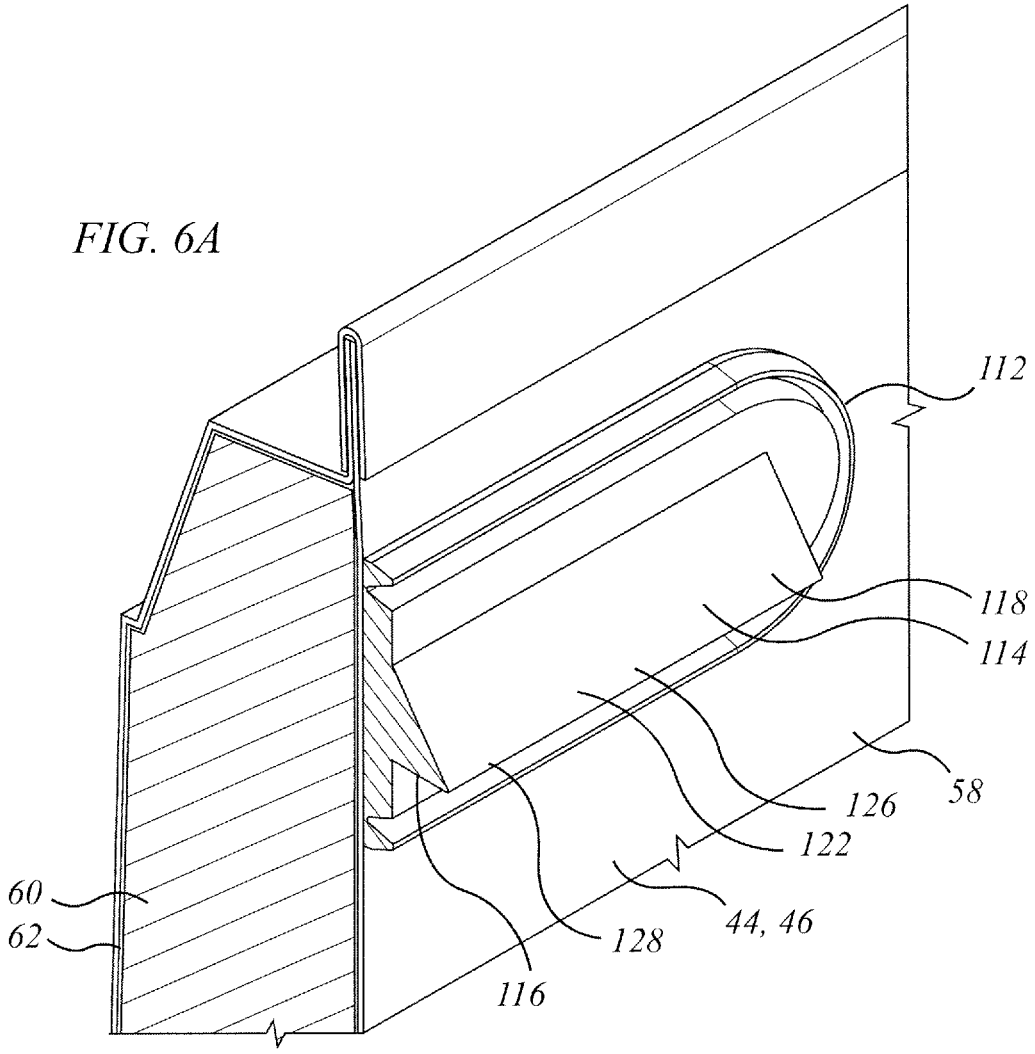
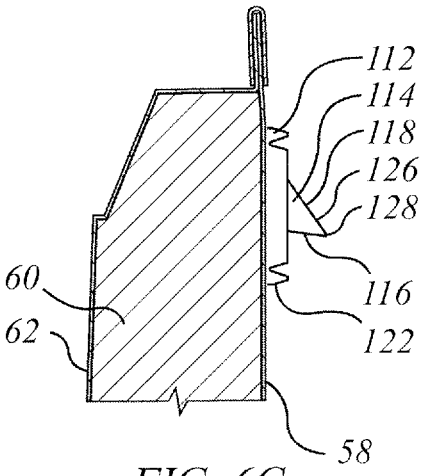
FIG. 6C
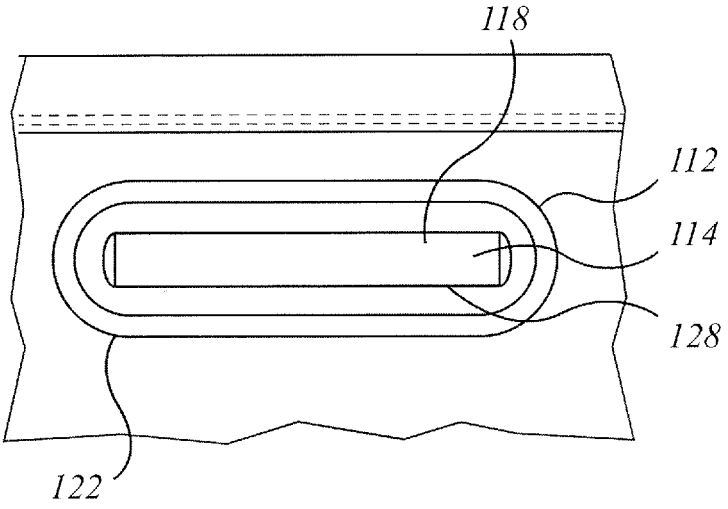
FIG. 6B 510
524
534
532
522
568
558
550
566
572
548

584
510
524
534
532
544
522
512
576
542
556
544
572
558

SOFT-SIDED INSULATED CONTAINER WITH HARD-SIDED LINER

CROSS-REFERENCE TO A RELATED APPLICATION

This application is a continuation-in-part of U.S. patent application Ser. No. 16/722,775, filed Dec. 20, 2019, the contents of which are incorporated by reference herein.

FIELD OF THE INVENTION

This invention relates to the field of portable insulated containers.

BACKGROUND OF THE INVENTION

Soft-sided insulated containers may be used to transport articles that may best be served cool, such as beverages or salads, or warm, such as appetizers, hot dogs, and so on. Such containers are also used to carry liquids, whether hot liquids, such as soup containers, coffee or tea, or cold liquids such as beer, soft drinks, or other carbonated beverages, juices and milk. The containers are typically made in a generally cube-like shape, whether of sides are of equal length or not, having a base, four upstanding walls, and a top. The top wall is often a lid which opens to permit articles to be placed in, or retrieved from, the container. In soft-sided insulated containers heretofore, the main closure of the lid has tended to depend on the closing of a zipper, often a zipper running around three sides of a rectangle, with the fourth side being hinged. The lid may rest on a foam lip or bead. When a container of this nature falls over, its resistance to the spilling of liquid through the closure may not be as effective as might be desired. It might be advantageous to have a somewhat tighter seal, such as might be made by stiffer materials in an interference fit. A soft-sided panel would not normally be sufficiently stiff to achieve such a seal. The use of a seal in this nature might also permit the elimination of the main peripheral zipper of the main closure of the container.

SUMMARY OF THE INVENTION

In an aspect of the invention, there is a soft-sided insulated container that has a rigid closure. The rigid closure has a first closure interface that is a passive friction fit in which one part wipes another. The rigid closure has a second closure interface that is an active closure. In a second mode of operation a mechanical device, such as a latch or clamp, is used positively to energize the second closure interface. In a feature, the second closure interface is a seal.

In another aspect, a soft-sided insulated container having a soft-sided external casing, and a rigid internal liner that includes a mating rigid lid. There is a releasable securement that holds the liner in engagement with the casing, but that can be released to permit the casing to be extracted from the liner. The releasable securement is a one-way passively engageable securement.

In another aspect of the invention there is a soft-sided insulated container assembly having a first portion and a second portion. The first portion has a soft-sided insulated wall structure that includes an upstanding soft-sided insulated peripheral wall. The second portion includes a surround that mates with the first portion. The second portion has a closure movable between an open position and a closed position. The closure has a movable member and a stationary member. The closure has a first mode of securement and a second mode of securement. In the first mode, when the movable member is closed relative to the stationary member, the movable member is in a friction fit with the stationary member. The interference fit discourages the movable member from disengaging from the stationary member. In the second mode, when the movable member is closed relative to the stationary member, the movable member is retained by a locking force other than the friction fit.

In a feature of any of those aspects, there is a first closure interface between the movable member and the stationary member, and in closing in the first mode the movable member rubs across the stationary member. In another feature, there is a second closure interface between the movable member and the stationary member, and in closing in the second mode the movable member moves predominantly normal to the second closure interface. In still another feature, there is a closure interface between the movable member and the stationary member; in moving from the open position to the closed position the movable member moves in a closing direction; there is a seal located at the closure interface; and the locking force is applied in is the closing direction. In an additional feature, in the second mode the locking force is applied normal to the seal.

In still another feature, there is a first closure interface between the movable member and the stationary member, and a second closure interface between the movable member and the stationary member. In closing in the first mode the movable member rubs across the stationary member in the interference fit. In closing in the second mode the movable member moves predominantly normal to the second closure interface. In an additional feature, in moving from the open position to the closed position, the movable member closes in the first mode prior to closing in the second mode. In still another feature, in the second mode the movable member and the stationary member co-operate to form a water-tight seal. In another additional feature, a seal is trapped between the movable member and the stationary member. The seal has a first portion and a second portion. The first portion defines a wiper that deflects in the first mode. The second portion defines a ring that is compressed when energized in the second mode. In a still further feature, the seal is a resilient seal mounted to the movable member. The wiper is one of (a) a peripherally outwardly extending deflectable vane, and (b) a hollow bulb. The stationary member includes a flanged shoulder having a first leg and a second leg forming an angle. The first leg of the flanged shoulder is a peripherally outwardly extending flange defining a land engaged by the ring in the second mode. The second leg has an axially extending surface engaged by the wiper in the first mode.

In a further feature, the stationary member includes a frame that extends about a peripheral lip of the second portion. The frame defines an opening of the soft-sided insulated container through which objects pass upon entry to an internal chamber of the soft-sided insulated container. In another feature, the second portion includes a rigid molded liner that seats within the first portion. In still another feature, the second portion includes a rigid molded liner having a liquid containment wall; and the stationary member of second portion defines a peripheral flange structure of the rigid molded liner. In another feature, the second portion includes at least a first clamp, and in the second mode the clamp is operable to secure the movable member in the closed position relative to the stationary member. In a further feature, the movable member is connected to the stationary member at a hinge. The second portion includes two clamps operable to secure the movable member in the closed position relative to the stationary member; and the clamps are mounted in opposition to the hinge. In another feature, the second portion defines a rigid liner that seats within the first portion; and, when the liner is located within the first portion, the second portion is releasably secured to the first portion. In an additional feature, the second portion is releasably secured to the first portion by mating male and female engagement fittings. In a further additional feature the second portion is releasably secured to the first portion by one-way engagement fittings, the one-way engagement fittings having a releasable catch.

In another feature, the first portion has an uppermost peripheral margin. The second portion includes a liner formed as a rigid molding. The second portion includes a peripheral frame that defines an access-way to the liner. The stationary member is defined by the peripheral frame. The movable member is hingedly mounted to the peripheral frame. The peripheral frame includes an outermost downwardly depending lip that overhangs the uppermost peripheral margin of the first portion. The peripheral frame has an inward facing releasable one-way catch located inwardly of the downwardly depending lip. The uppermost peripheral margin of the first portion has an outwardly facing cleat. On insertion of liner of the second portion within the upstanding peripheral wall of the first portion the one-way catch engages the cleat to retain the liner within the upstanding peripheral wall. The downwardly depending lip is outwardly flexible away from the liner to release the one-way catch. In another feature, the first portion includes at least one watertight envelope membrane.

In another aspect, a soft-sided insulated container has a soft-sided external casing and a rigid internal liner, the soft-sided internal container having a releasable securement.

In a feature of that aspect, the releasable securement is a one-way catch that engages passively on insertion of the liner within the soft-sided external casing, and is actively disengaged to permit removal of the liner from within the soft-sided external casing. In another feature, the rigid internal container includes a rim defining an opening thereof; and the rim has a downwardly depending skirt that overhangs the soft-sided external casing. In still another feature, the releasable securement includes a reinforcement mounted within the downwardly depending skirt. In an additional feature the releasable securement includes a cleat mounted to the soft-sided external casing and a catch mounted within the downwardly depending skirt. In another feature, the skirt is transversely deformable to release the catch from the cleat. In still another feature, the liner has a lid, and the lid has a watertight seal. In a further feature, the rigid internal liner has the form of a molded plastic tub that forms a liquid containment vessel. In a further feature, the rigid internal liner has a rim that defines an opening of the liner providing access to a chamber formed within the liner. A lid is hingedly mounted to the rim and is movable between open and closed conditions to govern access to the chamber. The chamber has a first closure mode and a second closure mode. The first closure more is a friction interference fit of the lid in engagement with the rim. The second closure is an active closure energized by a latching mechanism. In a further feature, the rim includes a peripherally extending depending skirt. There is an upwardly extending recess defined between the downwardly depending skirt and a peripheral wall portion of the liner lying inwardly of the rim; and the soft sided insulated wall structure has an uppermost margin that seats in the recess between the skirt and the peripheral wall portion.

In another aspect there is a soft-sided insulated container. It has a first portion and a second portion. The first portion includes a soft-sided insulated upstanding peripheral sidewall. The second portion includes a rigid liner that seats within the peripheral sidewall. The second portion includes a rigid frame that extends around an access-way of the rigid liner. The soft-sided insulated upstanding peripheral sidewall of the first portion has and upper region defining an upper rim. The upper region has a first releasable securement fitting mounted thereto. The rigid frame has a depending skirt that overhangs the upper region of the first portion. The downwardly depending skirt has a second releasable securement fitting mounted thereto. On insertion of the liner within the upstanding peripheral sidewall the first and second releasable securement fittings engage to prevent release of the rigid liner from within the upstanding peripheral sidewall. The second releasable securement fitting is movable to disengage the first releasable securement engagement fitting to permit the liner to be removed from the first portion.

BRIEF DESCRIPTION OF THE DRAWINGS

These aspects and other features of the invention may be understood with the aid of the following illustrations of a number of exemplary, and non-limiting, embodiments of the principles of the invention in which:

FIG. 6*a* is an enlarged detail perspective view in section of a top margin of the soft-sided insulated wall structure of FIG. 5*b* showing a releasable securement;

FIG. 6*b* shows a front view of the releasable securement of FIG. 6*a;*

FIG. 6*c* shows a side view of the releasable securement of FIG. 6*a;*

DETAILED DESCRIPTION

Figure 1A:
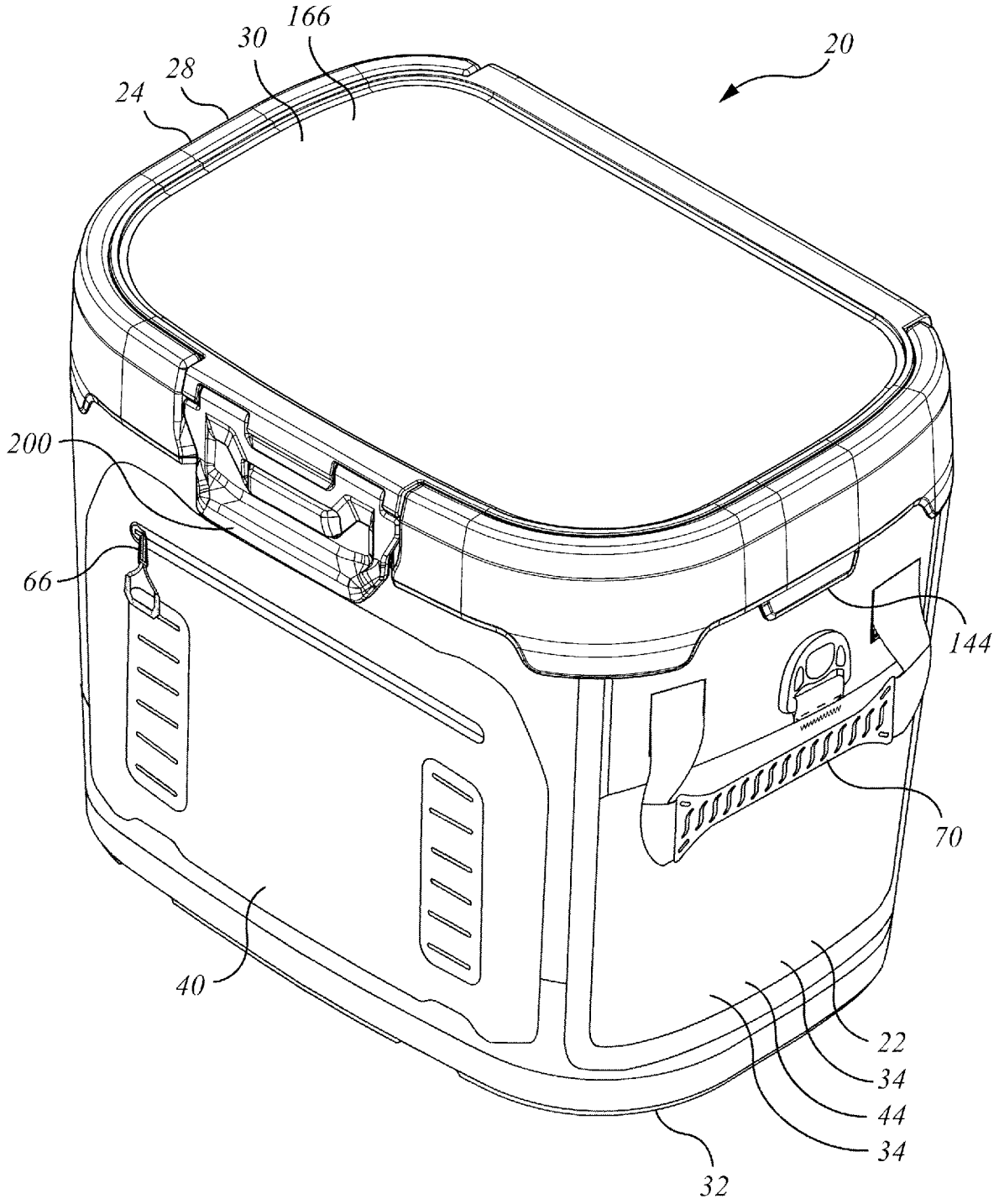
FIG. 1*a* shows a perspective view of a soft-sided insulated container assembly according to an aspect and features of the invention described herein, viewed from in front, to the left, and above.

The description that follows, and the embodiments described therein, are provided to illustrate examples of particular embodiments of the principles of the present invention. These examples are provided for the purposes of explanation, and not of limitation, of those principles and of the invention. In the description, like parts are marked throughout the specification and the drawings with the same respective reference numerals. The drawings are substantially to scale, except where noted otherwise, such as in those instances in which proportions may have been exaggerated in order more clearly to depict certain features of the invention.

For the purposes of this description, it may be that a Cartesian frame of reference may be employed. The vertical direction, or z-axis, extends in an up and down orientation from bottom to top. The x-axis extends in the shorter dimension of the container assembly, when fully expanded, running in the front-to-back direction. The y-axis extends cross-wise horizontally relative to the x-axis, running in the side-to-side direction. Unless noted otherwise, the terms "inside" and "outside", "inwardly" and "outwardly", refer to location or orientation relative to the associated enclosed space of the container assembly, as may be. The base of the article, where substantially planar, may be considered to extend in an x-y plane. The height of the article may be measured in the vertical, or z-direction. In other contexts, when looking at a single panel, reference may also be made to the "through-thickness" direction or dimension through the wall structure. The largest container panels herein may be designated arbitrarily as either the front and rear sides, walls, faces, or portions of the container. Similarly, the closure member, or opening is arbitrarily designated as being at the top, and the base panel is designated as being at the bottom, as these terms may be appropriate for the customary orientation in which the objects may usually be found, sold, or employed, notwithstanding that the objects may be picked up and placed on one side or another from time to time at the user's choice. It should also be understood that, within the normal range of temperatures to which food and touch is accustomed, although the term cooler, or cooler container, or cooler bag, may be used, such insulated structures may generally also be used to aid in keeping food, beverages, or other objects either warm or hot as well as cool, cold, or frozen. That is, although the term "cooler" may be used for convenience in describing a thermally insulted container, the "cooler" may sometimes be used to keep objects warm rather than cold, e.g., as when hot foods are being transported from a kitchen, or take-out restaurant, to a place where those foods will be eaten some distance away.

The term "insulated" or "insulated wall structure" may be used in this description. It is intended to pertain to walls having a layer of thermal insulation. Typically such walls have an inner surface or lining or web, an outer surface or lining or web, and a layer of insulation material captured between the inner and outer surfaces. The outside layer may be a wear-resistant or scuff resistant material. Thin single membranes or sheets of web material, such as woven high density Nylon™, or Vinyl™, or leather, or paper, are not of themselves intended to fall within the meaning of the term "insulated" as used herein unless they have been treated or formed in an manner deliberately to enhance thermal insulating properties.

Accordingly, the adjective "insulated" is intended to be given its usual and normal meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from *Phillips* v. *AWH Corp*., this definition provided herein is intended to supplant any dictionary definition, and to prevent interpretation in the US Patent Office (or any other Patent Office) that strays from the customary and ordinary meaning of the term "insulated". The Applicant also explicitly excludes cellophane, waxed paper, tin foil, paper, or other single use disposable (i.e., not intended to be re-used) materials from the definition of "washable".

A soft-sided insulated structure is one in which the insulated panels are flexible panels, typically in the form of fabric or plastic sheets with insulation inside. The insulation usually has the form of a flexible open cell or closed cell billet, or slab, which may have been bent or folded or molded into the shape of the wall structure.

A soft-sided insulated structure may be understood as being in contrast to a hard-sided insulated structure in which the insulation is contained within a rigid molded structure, and in which the insulation itself may be substantially rigid. In that regard, too, this description distinguishes of hard-shell containers from soft-sided containers. In the jargon of the trade, a soft-sided cooler, or bag, or container, is one that does not have a substantially rigid, high density exoskeleton. A typical example of a container having a hard exoskeleton is one having a molded shell, e.g., of ABS or polyethylene, or other common types of molded plastic. Rather, a soft-sided container may tend not to be substantially rigid, but may rather have a skin that is flexible, or crushable, or sometimes foldable. By way of an example, which is not intended to be exhaustive, comprehensive, exclusive or limiting, a soft-sided cooler may have an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam.

In some instances, a substantially rigid liner is mounted inside the soft-sided insulated structure to stiffen it. The liner is typically removable, although not always. In some examples, a soft-sided insulated wall structure may include one or more permanent or removable battens or stiffeners (which may be of a relatively hard plastic) concealed within the soft-sided wall structure more generally. Soft-sided insulated containers may have hard molded fittings either at a container rim or lip, or to provide a base or a mounting point for wheels, where the outside of the assembly nonetheless remains predominantly of soft-sided panels. Once again, this commentary is intended to forestall the adoption by the US Patent Office, (or any other Patent Office), of an interpretation of the term "soft-sided" that diverges from the ordinary and customary meaning of the term as understood by persons of ordinary skill in the art in the industry, and as used herein.

Figure 1B:
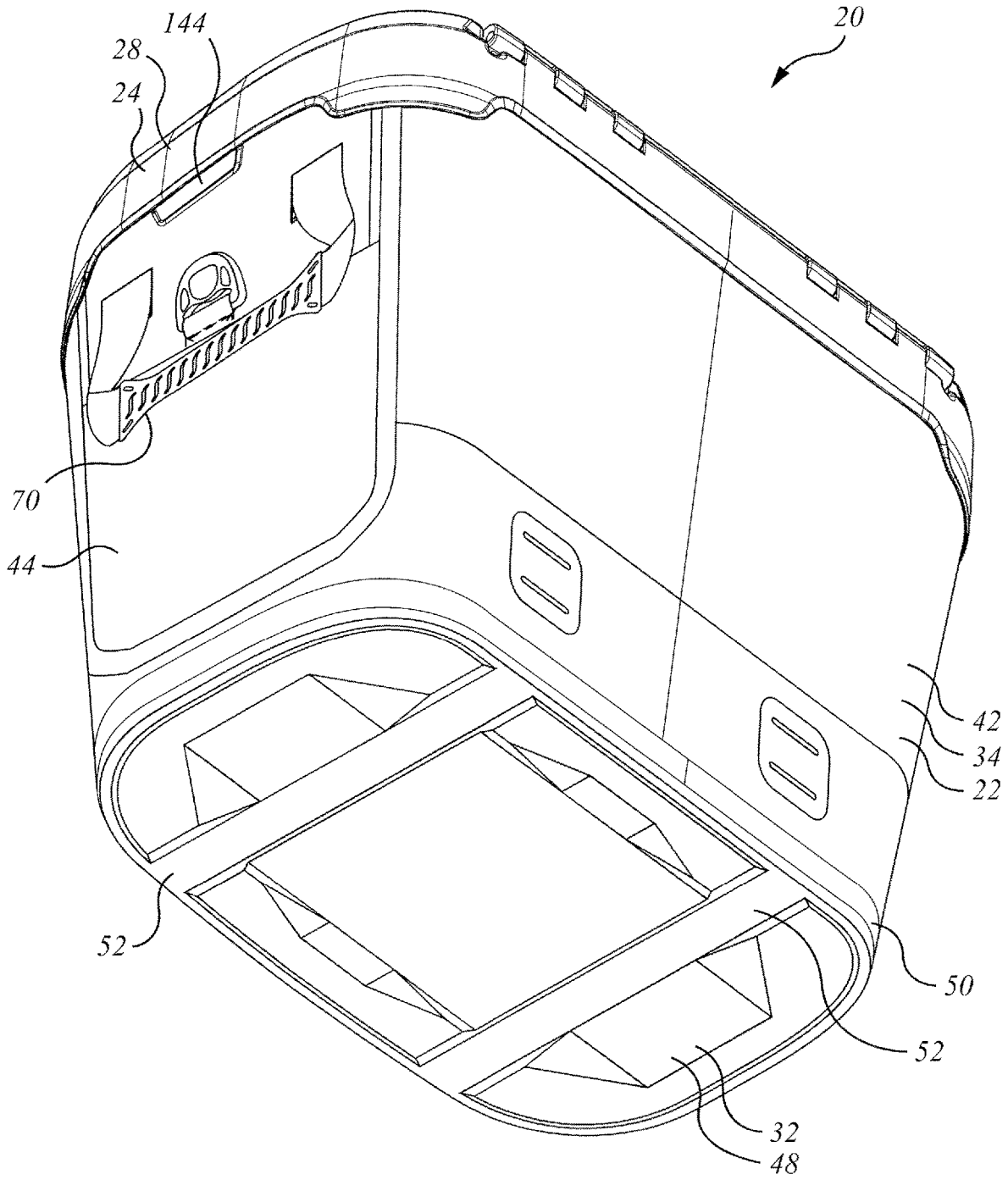
FIG. 1*b* is a perspective view of the soft-sided insulated container assembly of FIG. 1*a* from behind, to the left, and below.
Figure 1C:
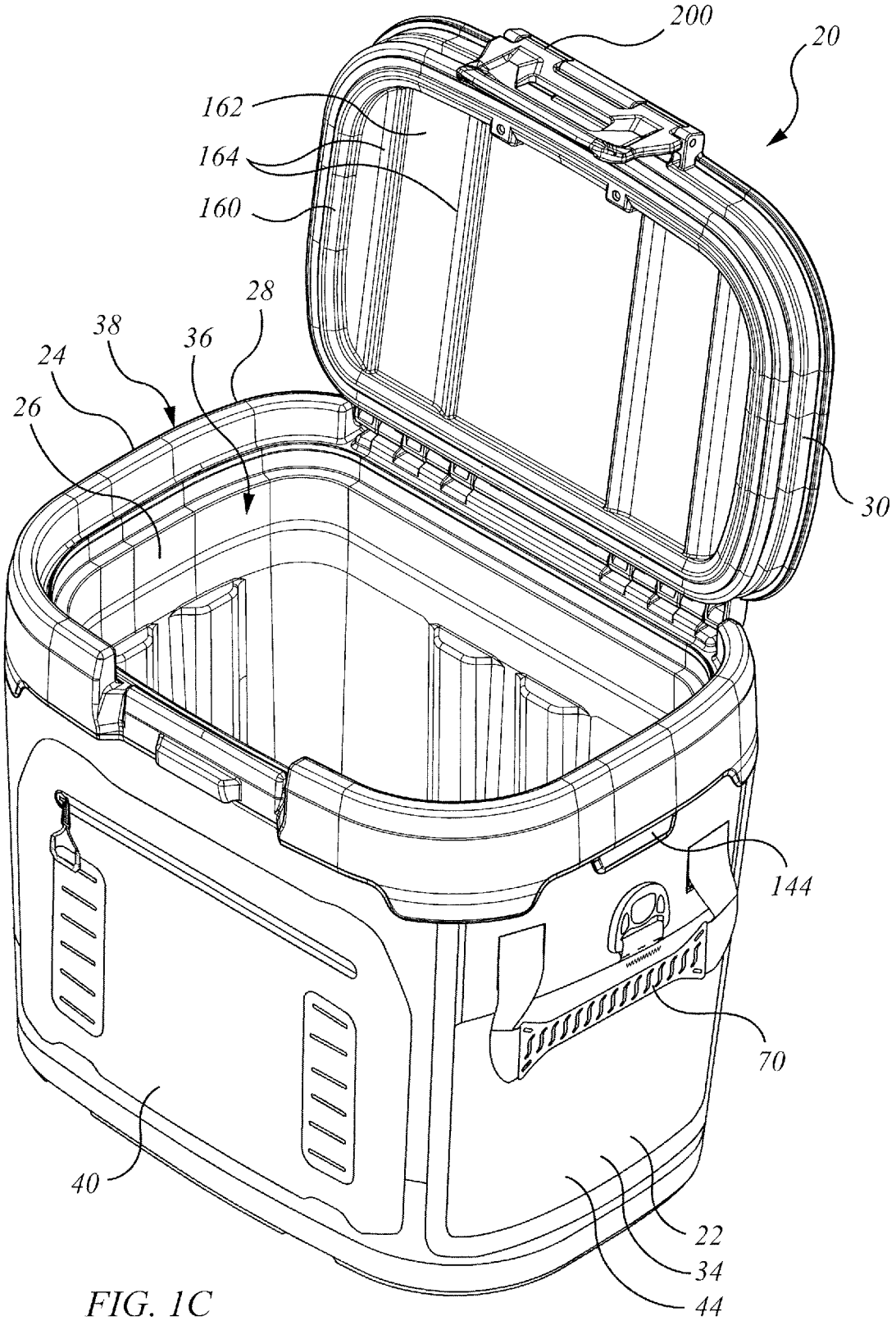
FIG. 1*c* shows the soft-sided container assembly of FIG. 1*a* with its lid open.
Figure 2C:
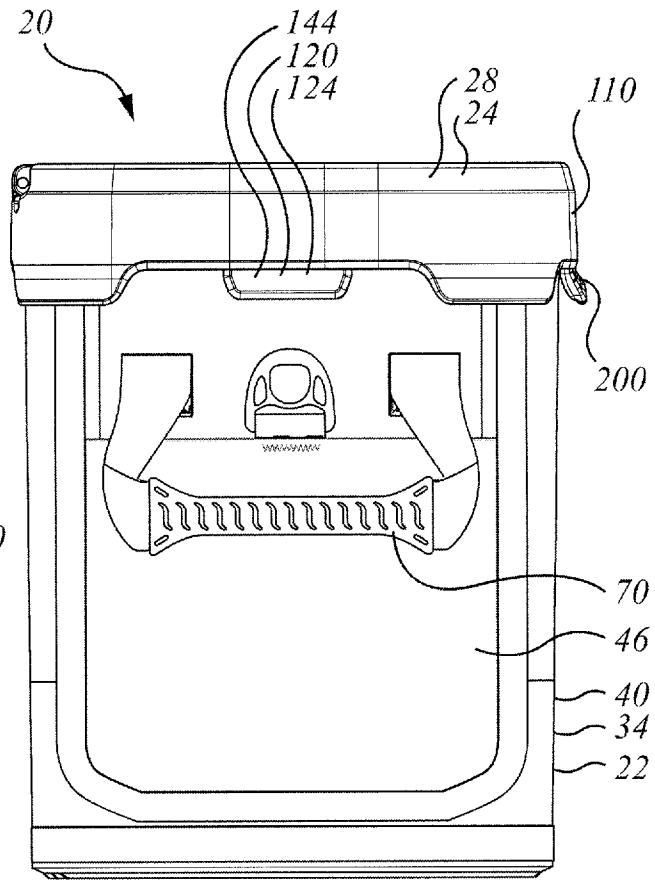
FIG. 2*c* is a right-hand side view of the container assembly of FIG. 2*a*, the left hand side view being a mirror image of the right-hand side view.
Figure 2A:
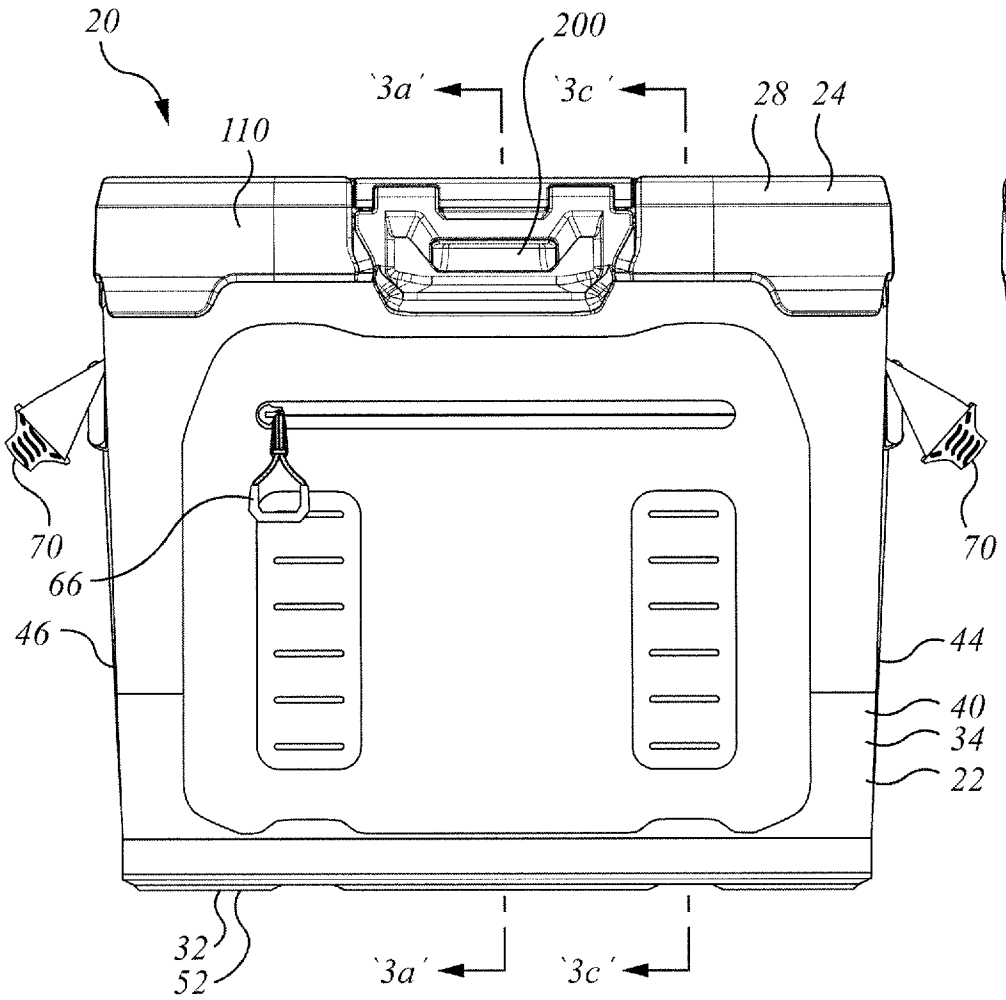
FIG. 2*a* is a front view of the container assembly of FIG. 1*a;*
Figure 2I:
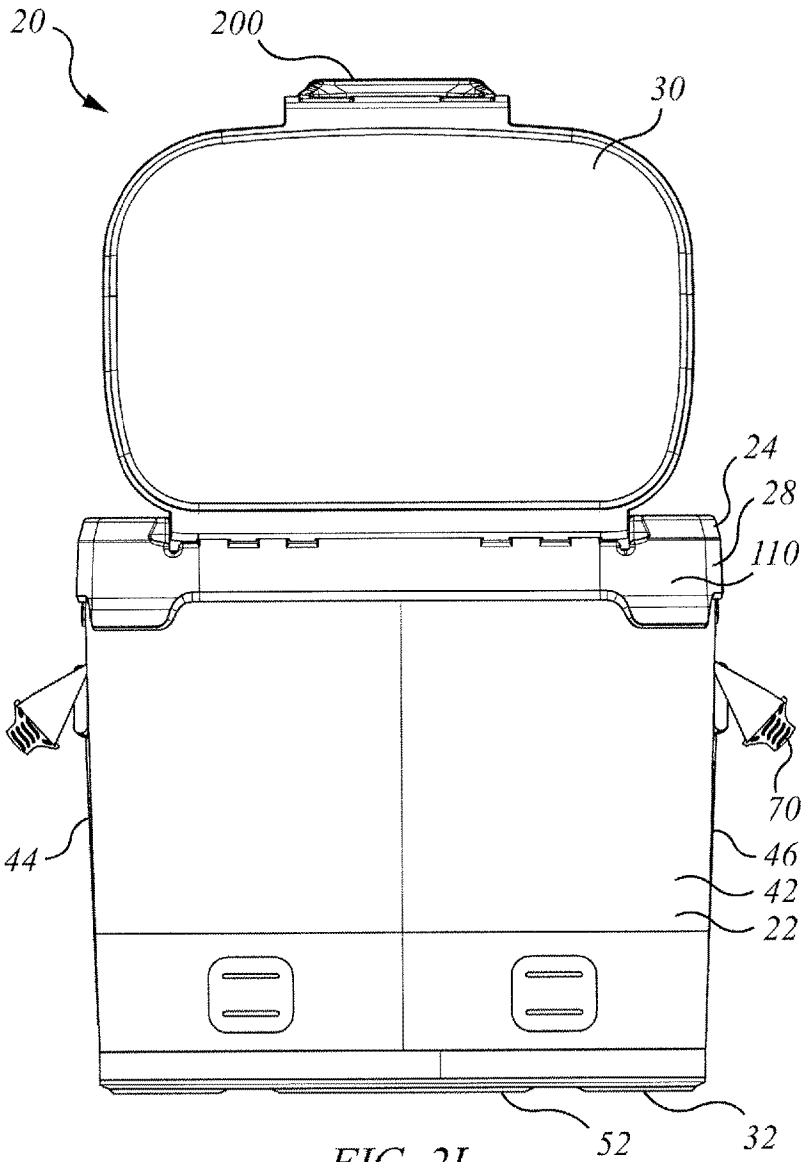
FIG. 2*i* is a rear view of the container assembly of FIG. 2*b* in an open condition.
Figure 2B:
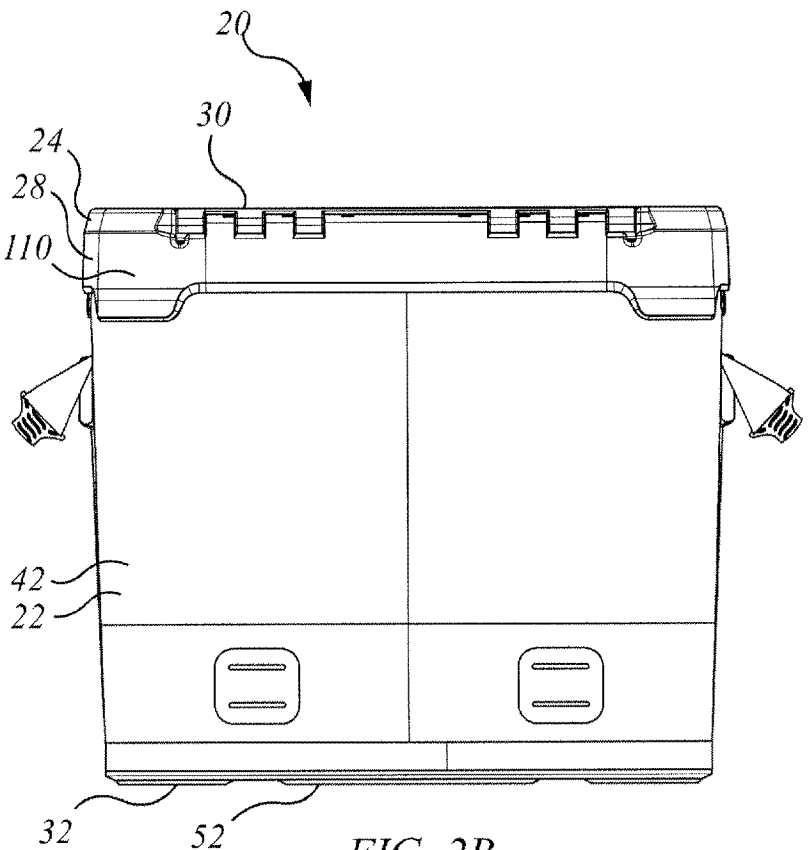
FIG. 2*b* is a rear view of the container assembly of FIG. 2*a;*
Figure 2D:
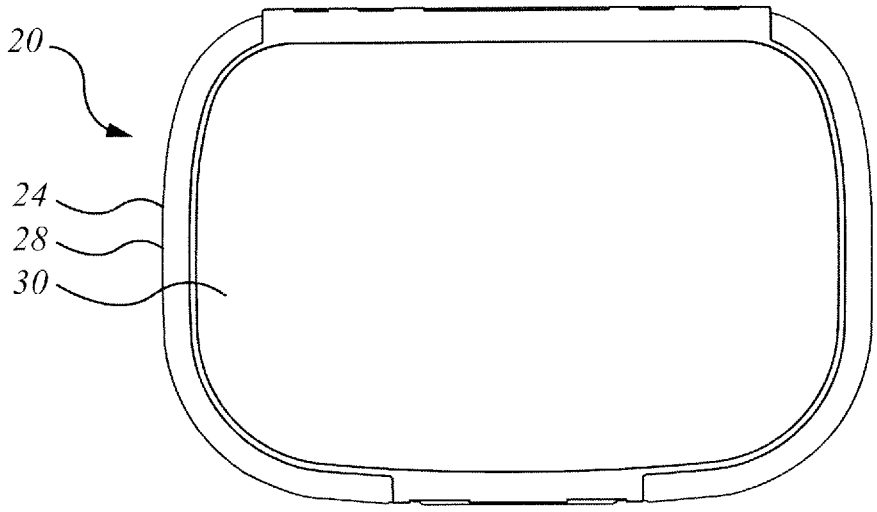
FIG. 2*d* is a top view of the container assembly of FIG. 2*a;*
Figure 2E:
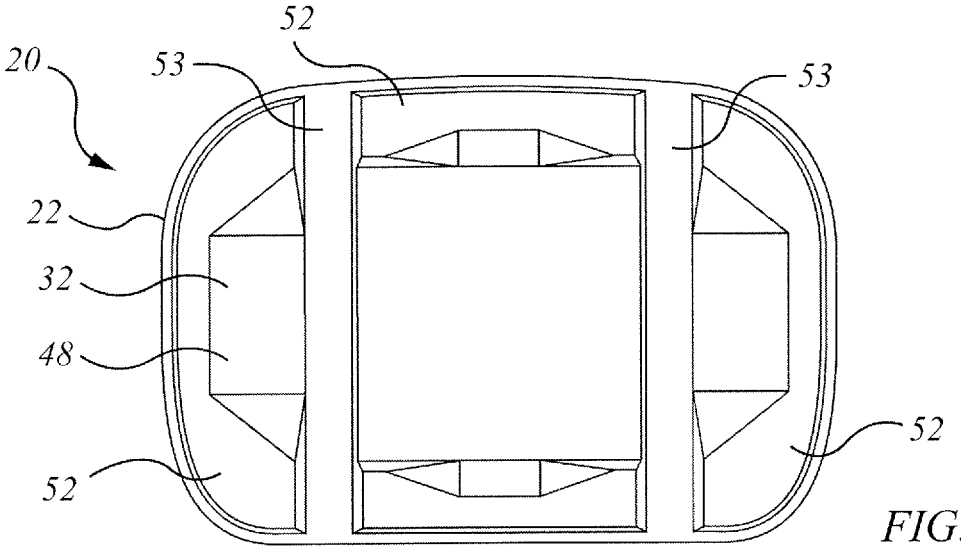
FIG. 2*e* is a bottom view of the container assembly of FIG. 2*a;*
Figure 2F:
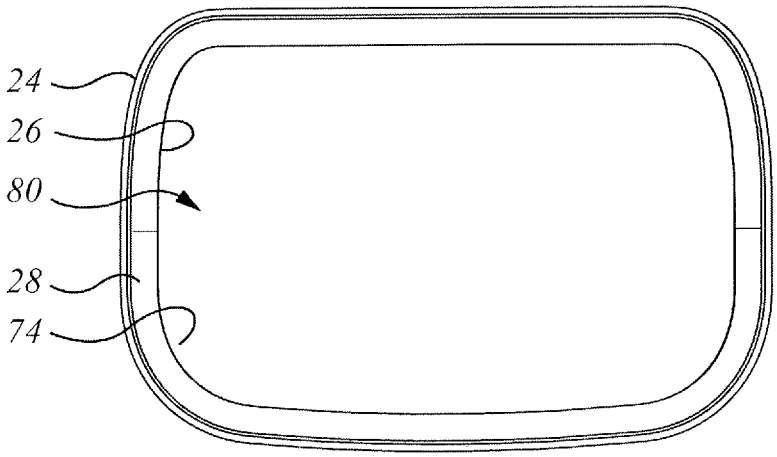
FIG. 2*f* is a view of the container assembly of FIG. 2*d* with lid structure removed.
Figure 2H:
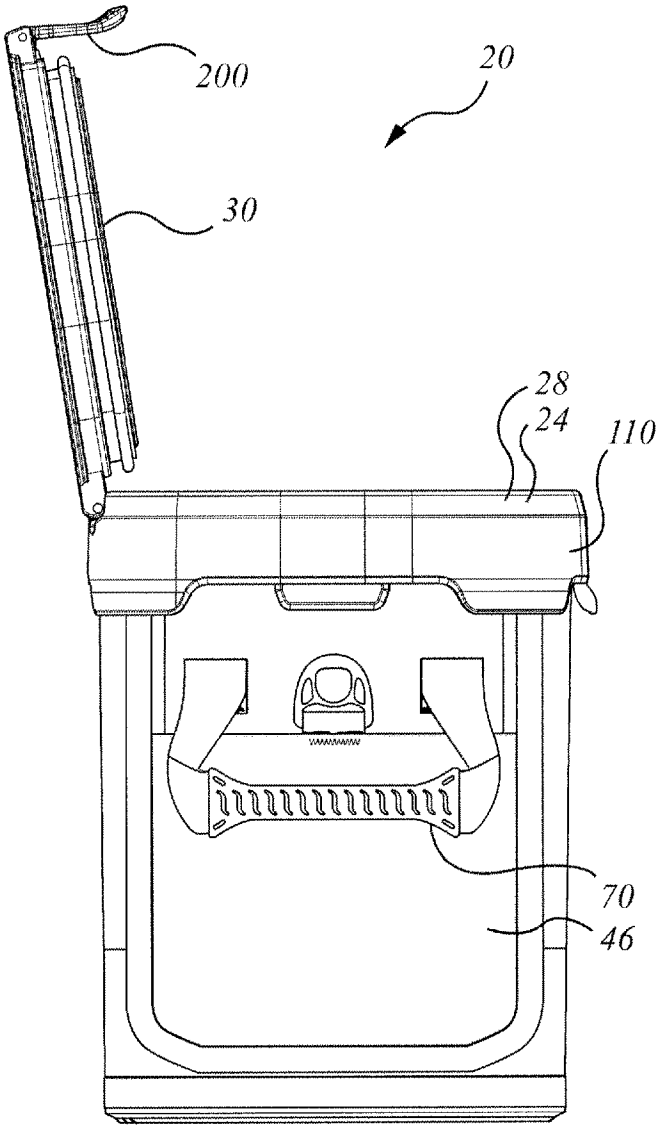
FIG. 2*h* is a right-hand side view of the container assembly of FIG. 2*a* with lid open, the left-hand side view being a mirror image thereof.
Figure 2G:
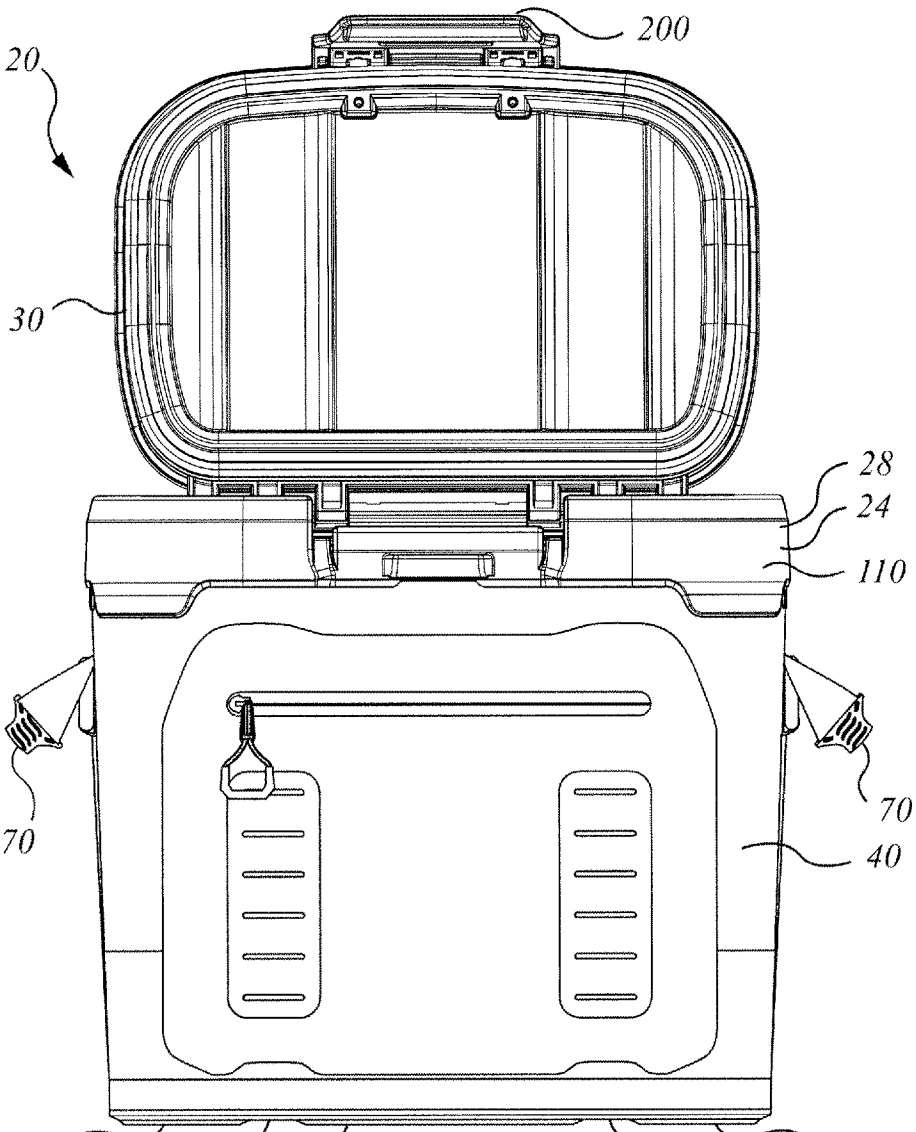
FIG. 2*g* is a front view of the container assembly of FIG. 2*a* with lid open.

As a general overview, FIGS. 1*a* to 1*c*; 2*a*-2*i*; and 3*a*-3*h* show a soft-sided insulated container assembly identified as 20. Container assembly 20 includes a first portion such as may be identified as an outer casing 22 in the nature of a soft-sided, insulated wall structure which is first or main portion, or main body of container assembly 20. Container assembly 20 also includes a second portion 24. Second portion 24 includes a liner 26, a rim or frame 28, and a lid or lid assembly 30 that is hingedly mounted to the upper rearward margin of frame 28. Lid assembly 30 is movable in a first degree of freedom, namely pivotally about a hinge axis, between a first position and a second position, the first position being an open position as seen in FIG. 1*c* and the second position being a closed position generally as seen in FIG. 1*a*.

Outer casing 22 may be generally box-shaped. That is, it may have a base or bottom panel 32, and an upstanding peripheral wall structure 34 that defines the sidewall of outer casing 22 and that includes four sides or side panels 40, 42, 44 and 46, being, respectively, front panel 40, rear panel 42, left hand side panel 44 and right hand side panel 46. Base or bottom panel 32, and the four side panels 40, 42, 44, and 46 of upstanding peripheral wall structure 34 may combine to form a five-sided open-topped box. A chamber 36 is defined within the box, i.e., the upstanding soft-sided insulate wall structure. The respective upper margins of the sides co-operate to define a four-sided opening 38 of chamber 36. In summary, bottom panel 32, and side panels 40, 42, 44, 46 of upstanding peripheral wall structure 34 co-operate to define a five-sided, open-topped box. As seen, bottom panel 32 has rounded corners and the respective sides merge into each other on rounded corners having a large radius, as seen from above or below.

In container assembly 20, each of panels 32, 40, 42, 44 and 46 may tend to be square or rectangular although this need not be so. For example the side panels could be trapezoidal such as to produce a box of tapering dimensions. Bottom panel 32 may tend to be rectangular, and may typically have two short sides, or edges, and two long sides or edges. The long edges may typically correspond to the front and back sides. The front and rear panels may tend to be the largest, or major, panels of the assembly. In some embodiments the front and back portions or sides or panels may be taller than wide. As shown, the front and rear panels are slightly wider than tall. Container assembly 20 has a slight taper from bottom to top such that the bottom is slightly narrower than the top of casing 22. Casing 22 has external lifting members identified as handles 70. These may have rigid bails, or, as shown, they may have flexible straps with enlarged load spreading hand grips. Lifting handles 70 in turn lift casing 22, which lifts liner 24.

Figure 7B:
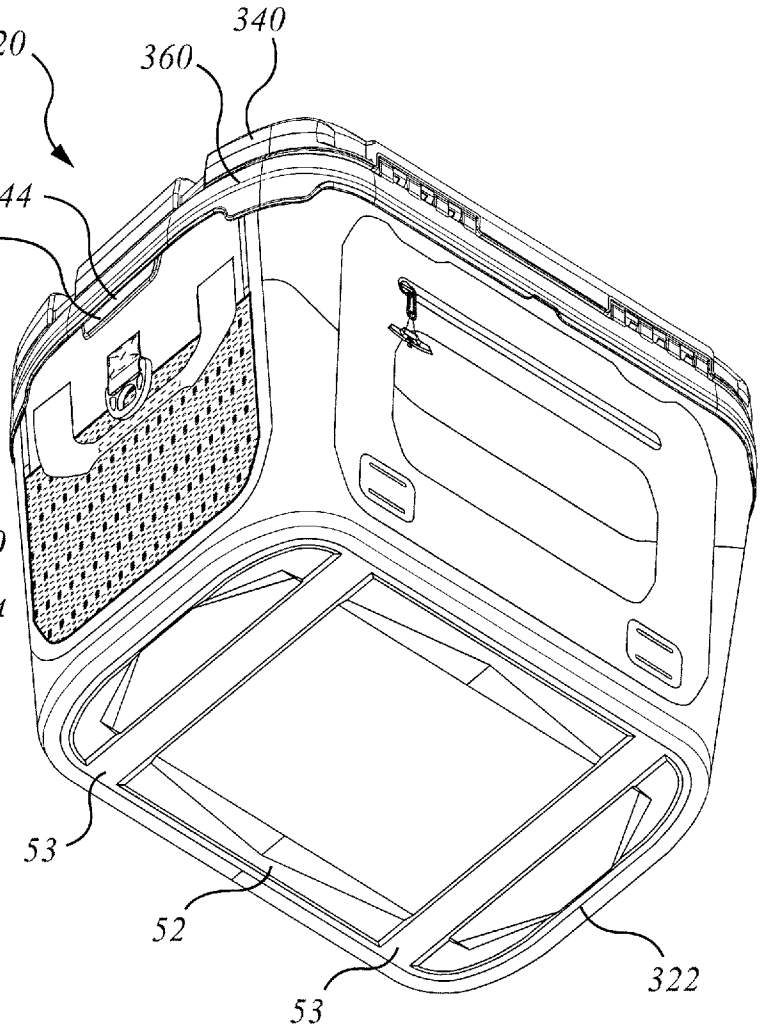
FIG. 7*b* is a perspective view of the soft-sided insulated container assembly of FIG. 7*a* from behind, to the left, and below.
Figure 7A:
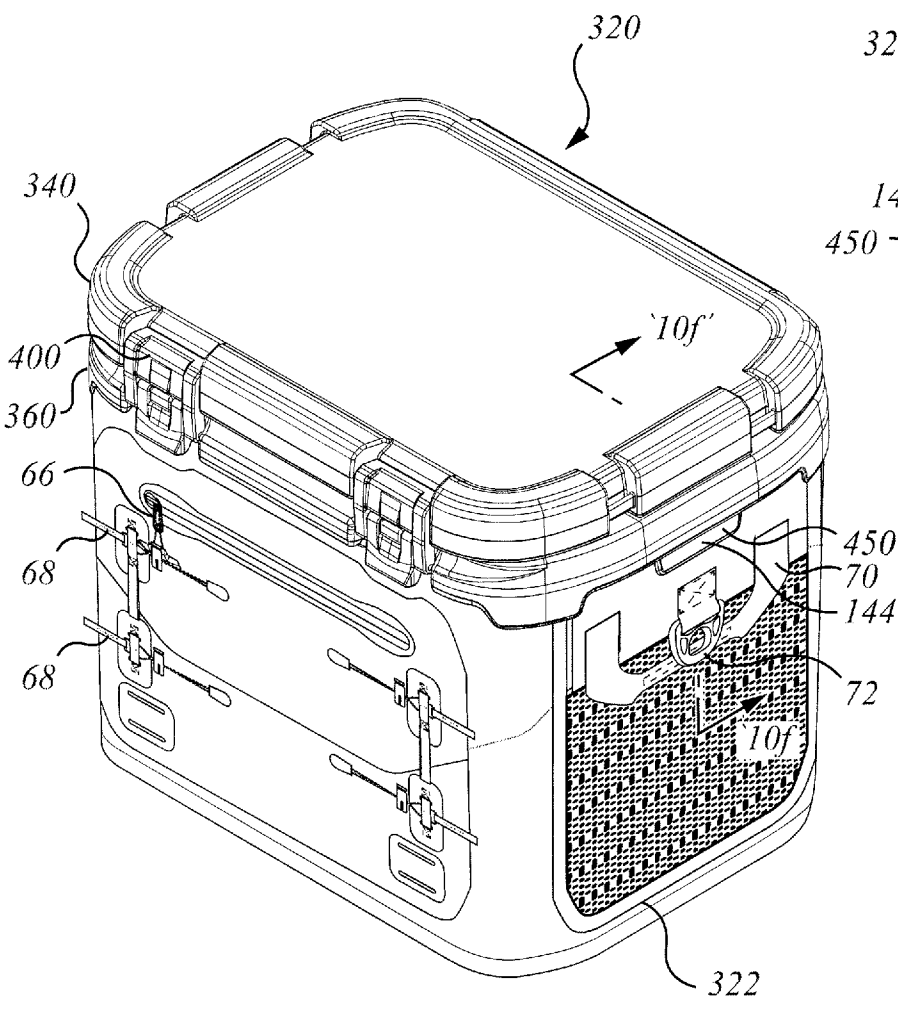
FIG. 7*a* is a perspective view of an alternate embodiment of soft-sided insulated container assembly to that of FIG. 1*a*, seen from in front, to the left, and above.
Figure 7D:
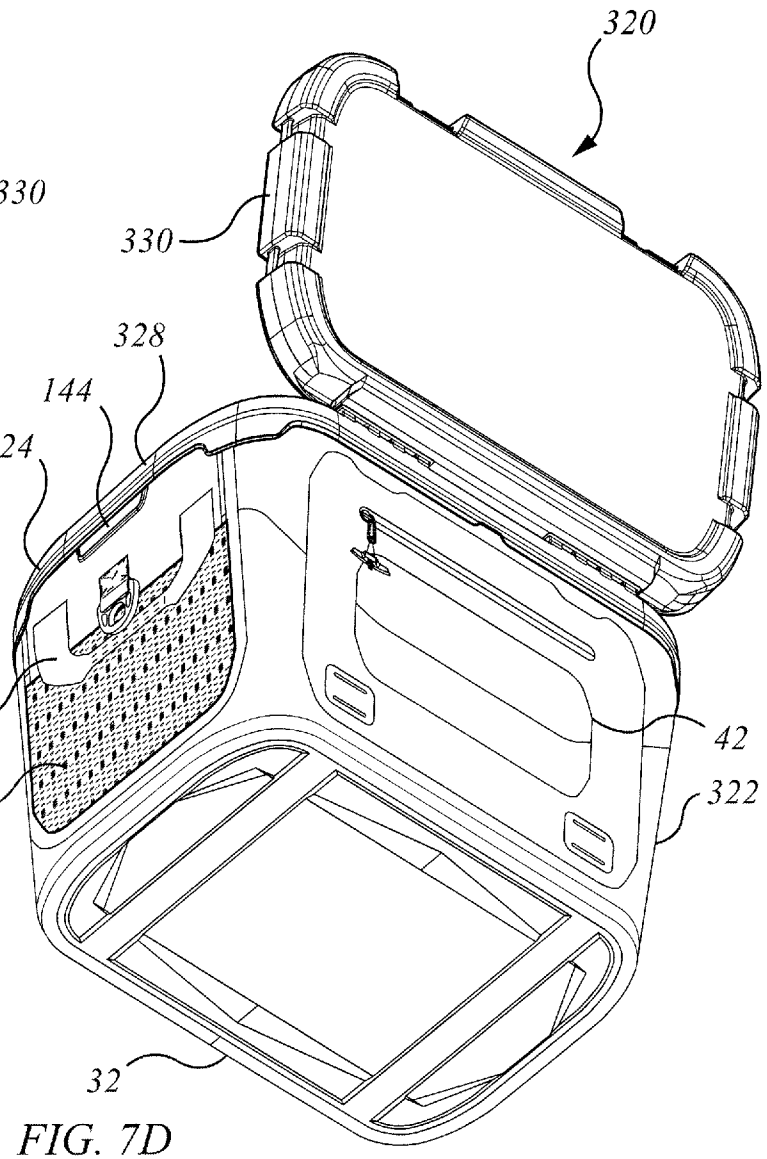
FIG. 7*d* shows the soft-sided container assembly of FIG. 7*b* with its lid open.
Figure 7C:
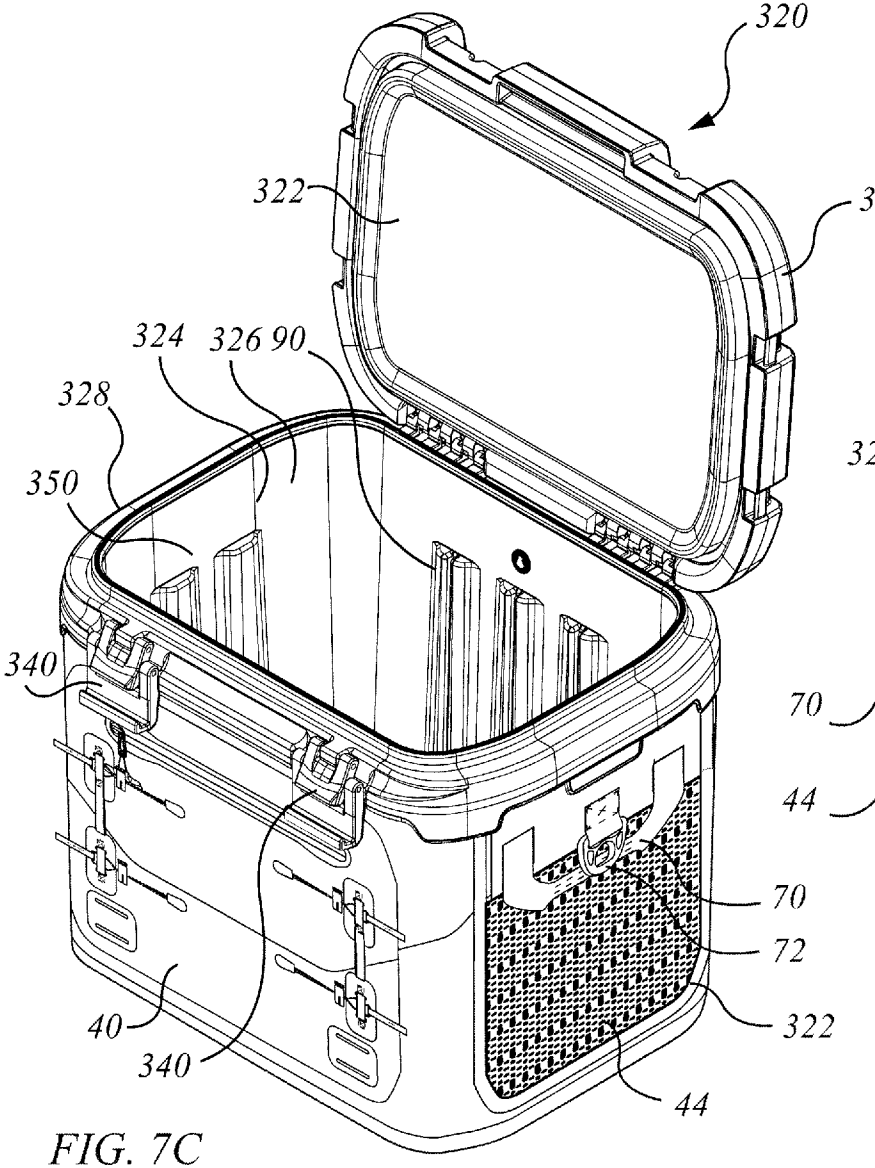
FIG. 7*c* shows the soft-sided container assembly of FIG. 7*a* with its lid open.
Figure 7H:
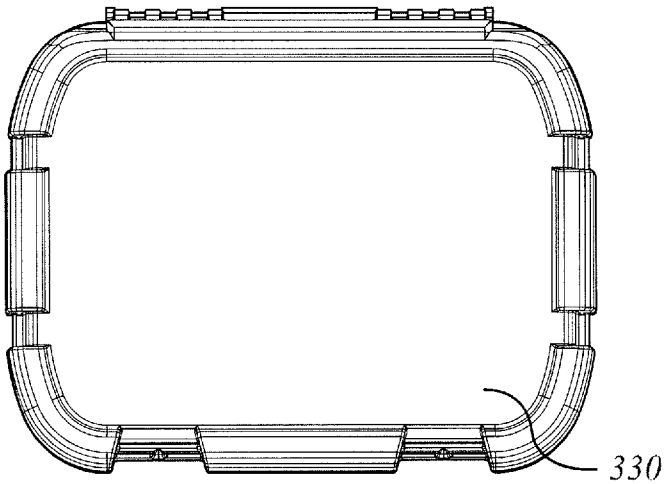
FIG. 7*h* is a top view of the container assembly of FIG. 7*a*, the bottom view corresponding to the bottom view of FIG. 2*e*, but on the size and aspect ratio of the container assembly of FIG. 7*h* rather than FIG. 2*e;*
Figure 7F:
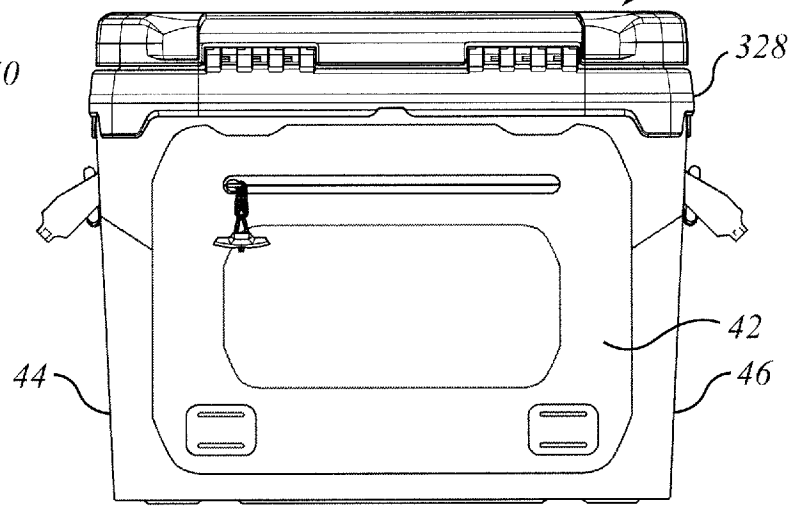
FIG. 7*f* is a rear view of the container assembly of FIG. 7*a;*
Figure 7G:
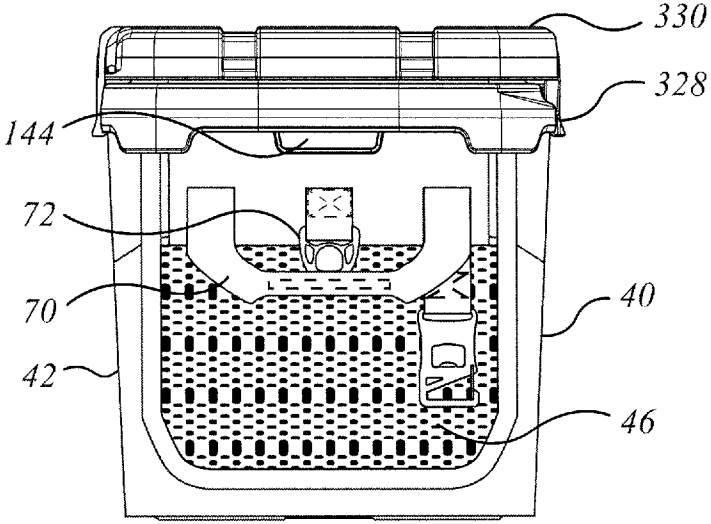
FIG. 7*g* is a right-hand side view of the container assembly of FIG. 7*a*, the left hand side view being a mirror image of the right-hand side view.
Figure 7E:
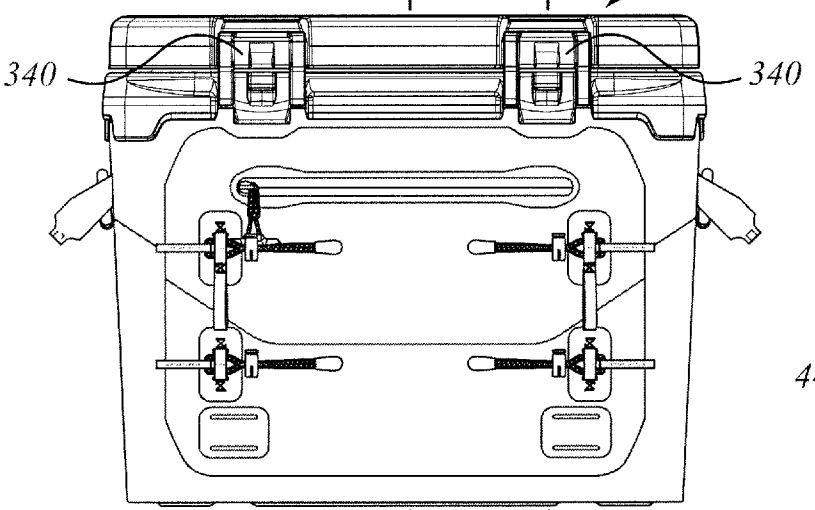
FIG. 7*e* is a front view of the container assembly of FIG. 7*a;*
Figure 8B:
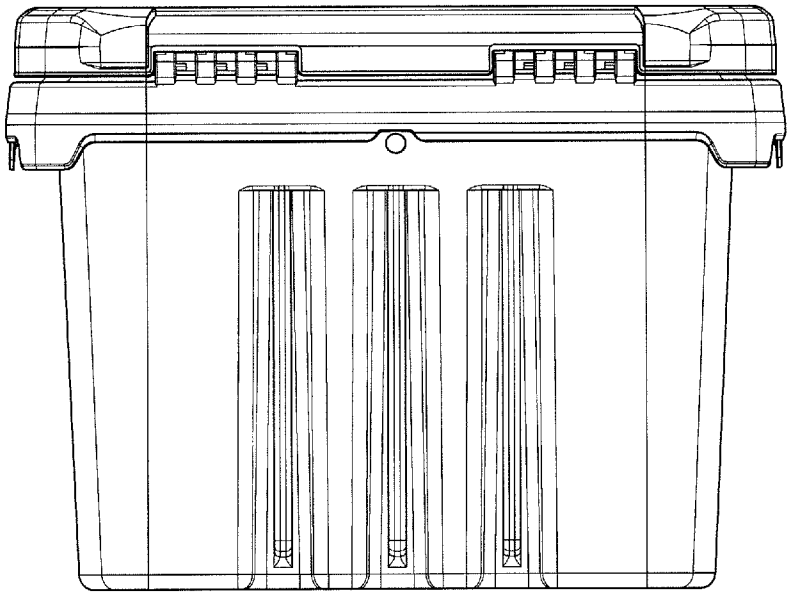
FIG. 8*b* is a rear view of the rigid liner and lid assembly of the insulated soft-sided container assembly of FIG. 8*a;*
Figure 8A:
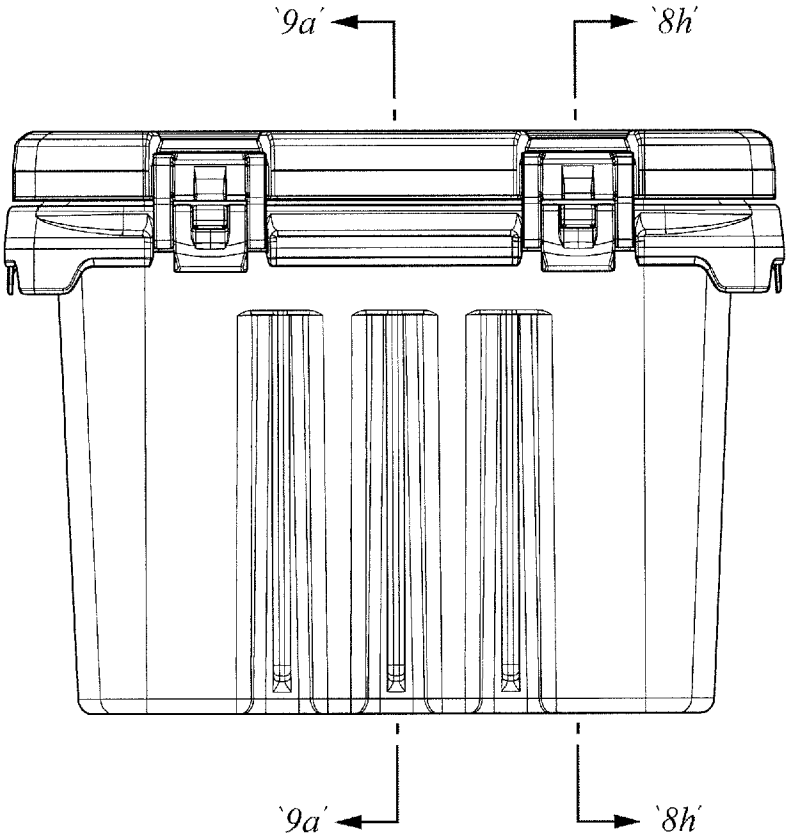
FIG. 8*a* is front view of the rigid liner and lid assembly of the insulated soft-sided container assembly of FIG. 7*a;*
Figures 8C, 8G, 8H:
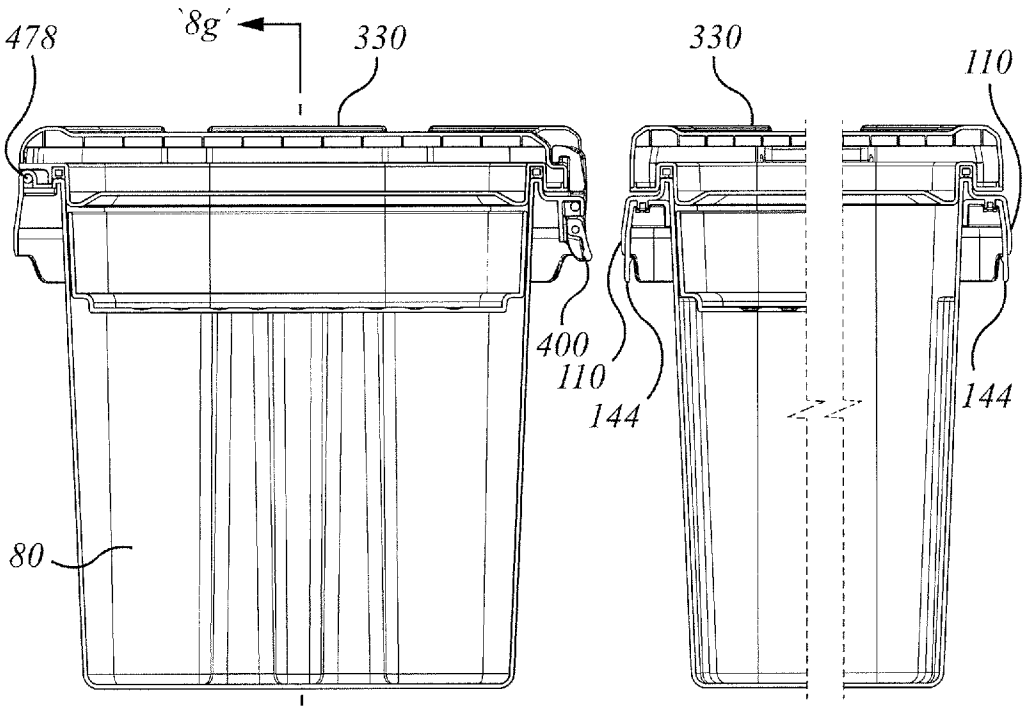
FIG. 8*c* shows the left-hand side of the rigid liner and lid assembly of FIG. 8*a*, the right hand side being a mirror image thereof.
FIG. 8*h* is a view through section '8*h*-8*h*' of FIG. 8*a*, with the enlargement of the sections at the latch and hinge corresponding to the sections enlarged in FIGS. 10*e* and 10*d*, seen in the opposite direction.
FIG. 8*g* is a sectional view looking rearward through the handle details of section '10*f*-10*f*' of FIG. 8*c*, which are seen in enlarged detail in FIG. 10*f;*
Figure 8D:
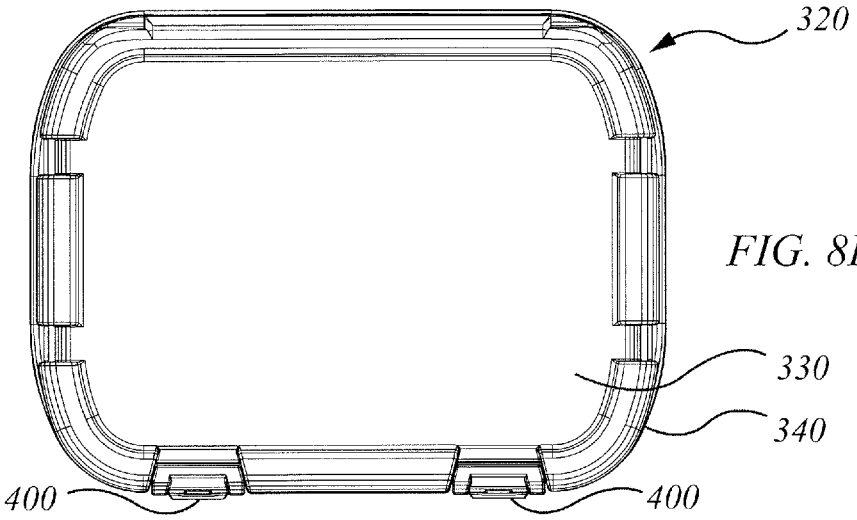
FIG. 8*d* is a top view of the rigid liner and lid assembly of FIG. 8*a;*
Figure 8E:
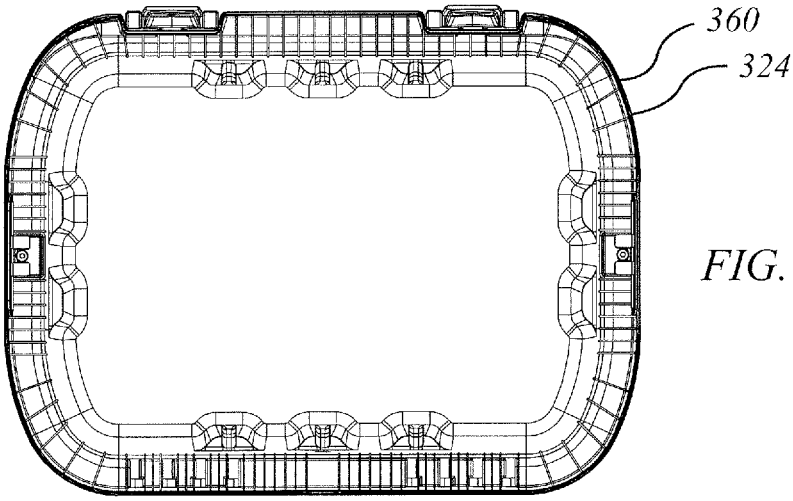
FIG. 8*e* is a bottom view of the rigid liner and lid assembly of FIG. 8*a;*
Figure 8F:
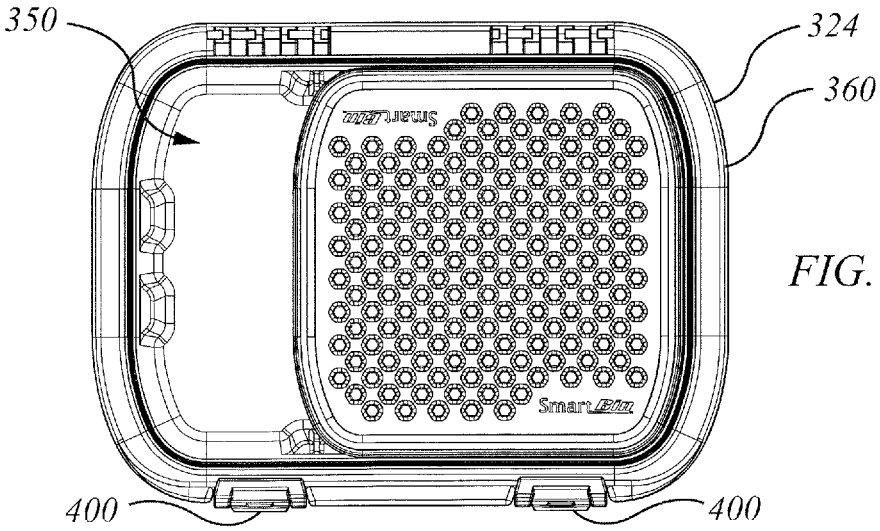
FIG. 8*f* is a top view of the rigid liner of FIG. 8*d* with the lid removed to show the inside of the liner and a removable tray that seats therein.

In this type of structure, bottom panel 32 may have a thickened, durable skin 48, that may tend to be scuff-resistant, as appropriate for a member whose exterior surface is intended to contact the ground, and that may be subject to wear when slid or dragged along a roughened surface or loaded onto a vehicle bed. This external skin may be molded to have an upturned lip 50. The external skin may be waterproof. External skin 48 may be made of Nylon™, and may have a flexural stiffness greater than other skins or webbing in the structure. External skin 48 may include molded protrusions in the form of feet, ribs, ridges or protrusions 52 that stand outwardly and define the ground-contacting interface or surface or footprint of container assembly 20. Spaces between the various protrusions 52 may provide an allowance or accommodation 53 for straps, such as may be used to secure items to container assembly 20 during transit. A layer 54 of open cell or closed cell insulation may overlie external skin 48 and may extend upwardly beyond the upper marginal edge of rim or lip 50. A further skin, or web, or layer 56 overlies layer 54 of insulation. Layer 56 is the inner skin of the bottom panel and may be part of a larger inner skin of outer casing 22 more generally. It may be made of a nylon sheet. Similarly, the side wall panels have an external skin 58, a layer of insulation 60, and an internal skin 62. External skin 58 may be made of a sheet or web that is a rubberized skin that is waterproof. External skin 58 may be thicker than, and more durable than internal skin 62 (or 56), as it is exposed to the wear of everyday use. The bottom margin of external skin 58 may be welded to the outward, peripherally extending upturned face of lip 50, as by RF welding, and this welded interface may follow the radius of the corners. The upper margin of external skin 58 may be welded to, or folded over and seamed together with the corresponding peripherally extending upper margin of the inner lining, or web, or layer, skin 62. Insulation layer 60 may be made of rectangular (or trapezoidal, as may be) billets corresponding to each of side panels 40, 42, 44, 46, or it may be made as a single piece or two-piece wrap-around rectangular sheet 64 that conforms to the four-sided shape within which it is contained. Sheet 64 and insulation layer 54 co-operate to form a bucket-shaped insulation barrier. Similarly, internal skin 62 may be a continuation of internal skin 56 of bottom panel 32 and they may be formed as a pouch or sack that lines the inside of the insulation. The outside of casing 22 may also include auxiliary features such as external pouches, such as for documents, and which may have waterproof-zippered closures, as at 66, and external attachment or securement members or straps or cords, such as represented in FIG. 7*a* by elasticized securement straps 68. It may also have lifting points or lifting lugs 72 to which a shoulder strap may be attached.

Second portion 24 may be referred to generally as "the liner". However, it has three major portions or elements, those elements being a main body or main portion that forms the liner 26 that goes inside upstanding peripheral wall structure 34; a bezel or frame 28; and a closure assembly or lid 30. In the embodiments illustrated, liner 26 and frame 28 are formed as a single integrally molded monolith, being a rigid plastic molding or more simply, a rigid liner. Liner 26 has the form of a bucket or liquid containing vessel 74. It has a bottom wall 76 and an upstanding peripheral sidewall 78. Bottom wall 76 is substantially rectangular, and corresponds generally to the inside and upwardly facing projection of bottom wall 32 of first portion 22. Peripheral sidewall 78 is also four-sided to correspond to the four sides or edges of bottom wall 76. The four sidewall portions being front, rear, left-hand side and right-hand side are identified as 82, 84, 86, and 88. They co-operate with bottom wall 76 to form an open topped box that surrounds an internal space, or cavity or chamber 80. In the embodiment shown, each of the sidewalls 82, 84, 86 and 88 has vertical wall reinforcement or stiffening in the nature of respective pairs of flutes or channels 90 molded into the respective walls. Although the left-hand and right-hand sides of the container are mirror images of each other, in the embodiment shown front wall 82 is not the same as rear wall 84, but rather has a forwardly bulging profile, such that the overall container is somewhat D-shaped.

Figure 3A:
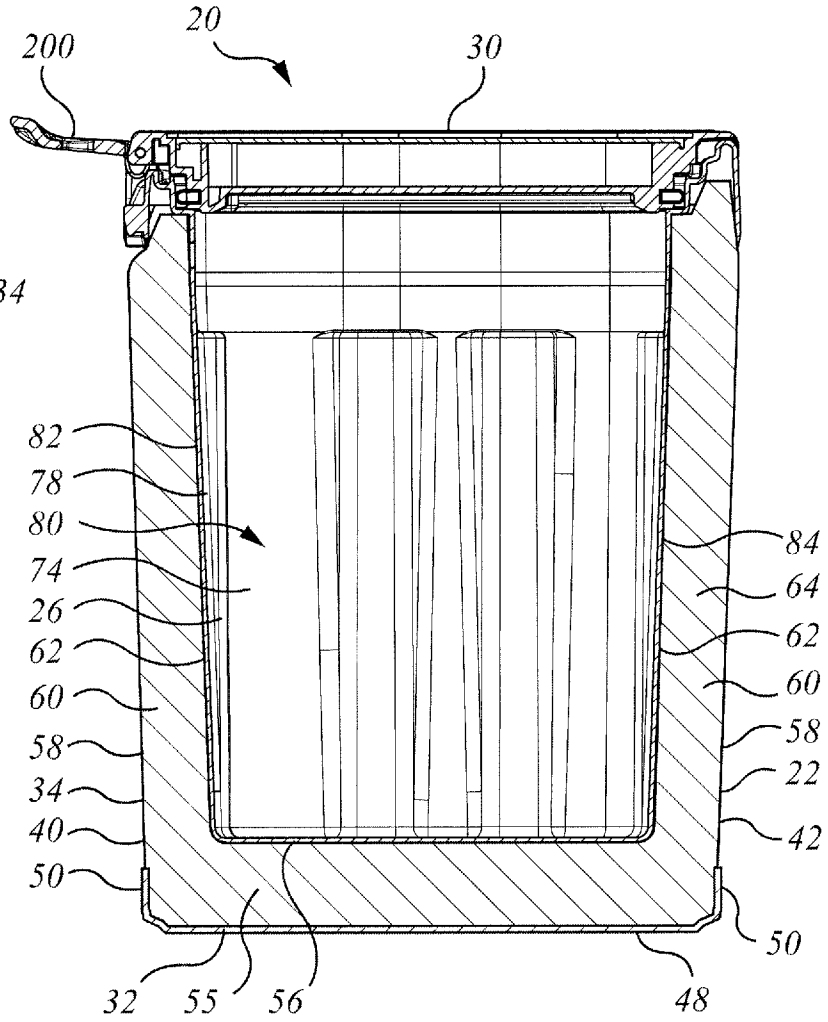
FIG. 3*a* is a cross-section taken on the vertical centerline plane of the container assembly of FIG. 2*a* on section '3*a*-3*a*' with lid closure latch open.
Figure 3B:
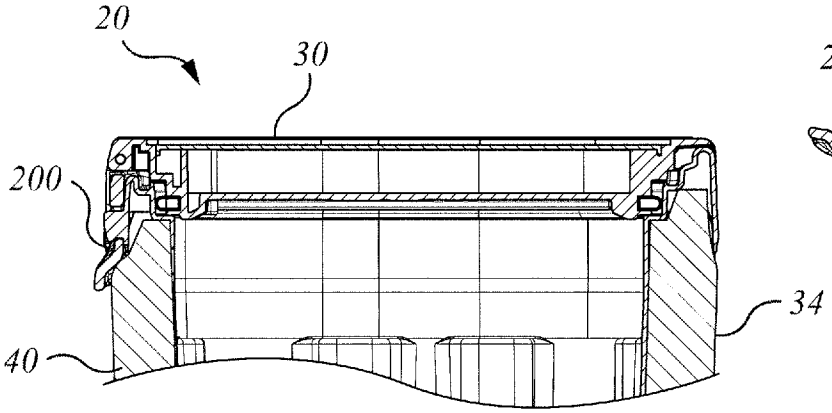
FIG. 3*b* shows the section of FIG. 3*a* with lid closure latch closed.
Figure 3C:
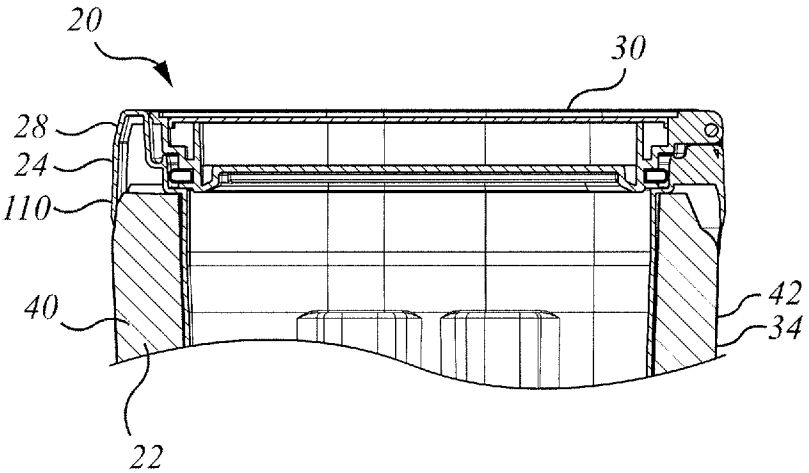
FIG. 3*c* shows a section of the container assembly of FIG. 2*a* on section '3*c*-3*c*' at a location that does not pass through the lid closure latch structure.
Figure 3E:
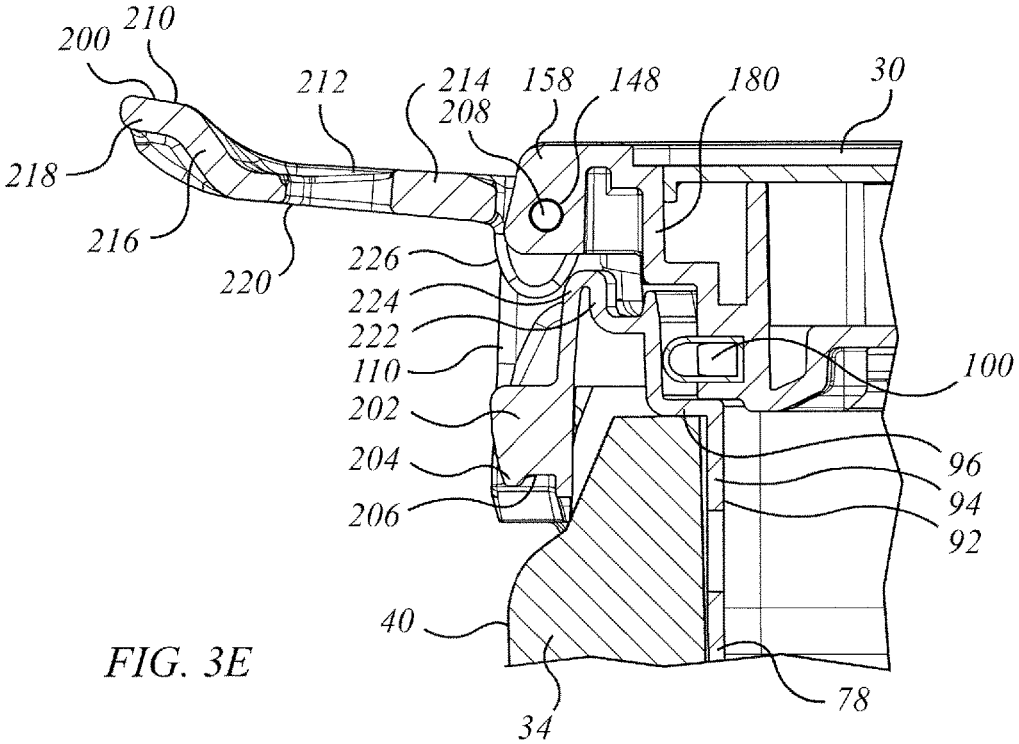
FIG. 3*e* is an enlarged detail of the open lid closure latch of FIG. 3*a;*
Figure 3D:
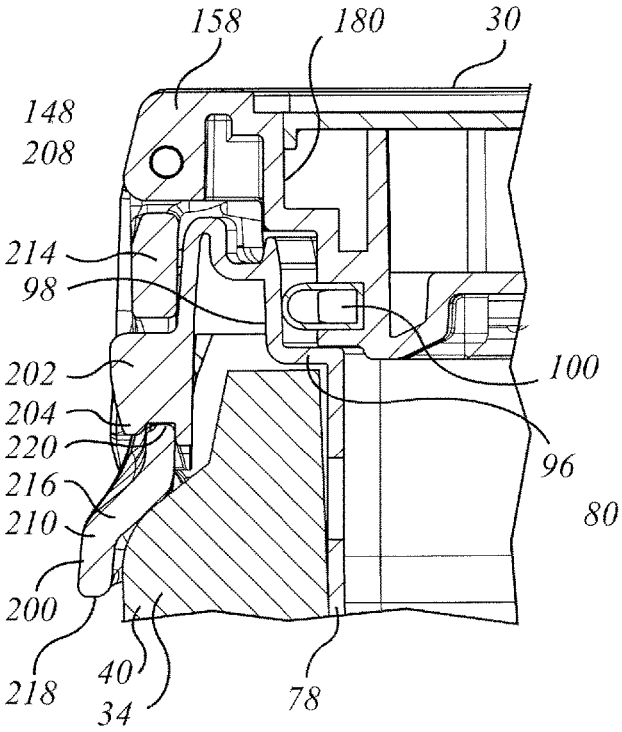
FIG. 3*d* is an enlarged detail of the closed lid closure latch of FIG. 3*b;*
Figure 3G:
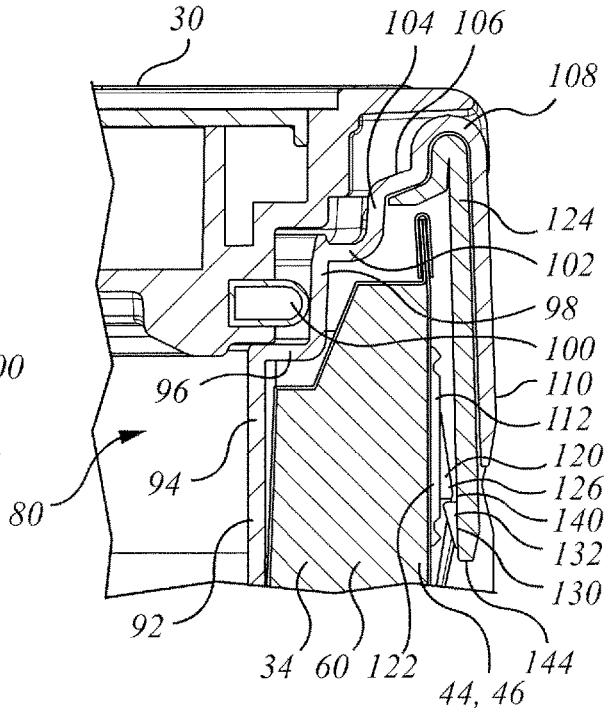
FIG. 3*g* is an enlarged detail of the section of FIG. 3*a* at the rear wall.

Bezel or frame 28 is located at the upper peripheral margin, or rim 92, of upstanding peripheral sidewall 78 of the body of liner 26, as opposed to the lower margin of peripheral sidewall 78 that merges into bottom wall 76. Bezel or frame 28 can be considered a flange of liner 26. FIG. 3*g* is a view of a region of the side wall that does not have latches or hinges. In that section, the upper margin, or rim of the inner peripheral sidewall 78 of liner 26 is indicated generally as 92. In general, rim 92 can be considered to commence with the upper end 94 of the upward leg of sidewall 78. Upper end 94 terminates at a shoulder having a peripherally outwardly extending step or shelf 96 and a predominantly axially extending wall 98. Wall 98 may be, and as shown is, slightly axially upwardly and outwardly tapering on a draft angle. The inward facing surface of wall 98 defines a land, or engagement surface, that is opposed to seal 100 of lid assembly 30 as lid assembly 30 closes.

In the section of FIG. 3*g*, axially upward and peripherally outward of wall 98 is a peripheral sill that has an outward leg 102 and an upward leg 104 that terminates at a chamfer 106. Chamfer 106 ends at an axially extending rounded rib 108 that forms the most axially upward portion of the flange structure and gives a round-edged rim to the overall structure. Outboard of rib 108 is a predominantly axially downwardly depending wall, identified as a flange or skirt 110. Skirt 110 may have, and as shown does have, an outward taper toward its tip. The space between the inside face of skirt 110 and the opposed outside face of upper end 94 of side wall 78 is of a size to receive the upper end of sidewall structure 34.

At two or more locations around the rim, or periphery, of container assembly 20 there are releasable securements that permit outer casing 22 and liner 26 to be mated together. In known coolers, the internal liner may have been removable, and some removable internal liners have been rigid. Quite often, a rigid internal liner fits very snuggly within the external soft-sided insulated wall structure, and the friction between them may tend to keep them from separating inadvertently, as when inverted; or even intentionally, as when it is desired to remove the liner for cleaning. However, in a fairly large cooler, when the cooler is inverted, fir whatever reason, it may not be desirable for the liner to slide out unexpectedly. Alternatively, where the present cooler is lifted by frame 28, the relative weight of casing 22 may tend also to cause casing 22 to disengage, which may not necessarily be desired. Accordingly, container assembly 20 has a set of releasable securements indicated generally as 120. Each releasable securement includes a first fitting or cleat 122 mounted to casing 22, and a second fitting 124 mounted to liner assembly 24. The fittings are designated as first and second, but could as easily be designated as male and female, inner and outer, and so on. The terminology is arbitrary, and is merely intended to indicate that there are two parts that engage and disengage. It is also largely arbitrary whether whichever of the first or male part and second or female part, is on the casing or on the liner.

Figure 5A:
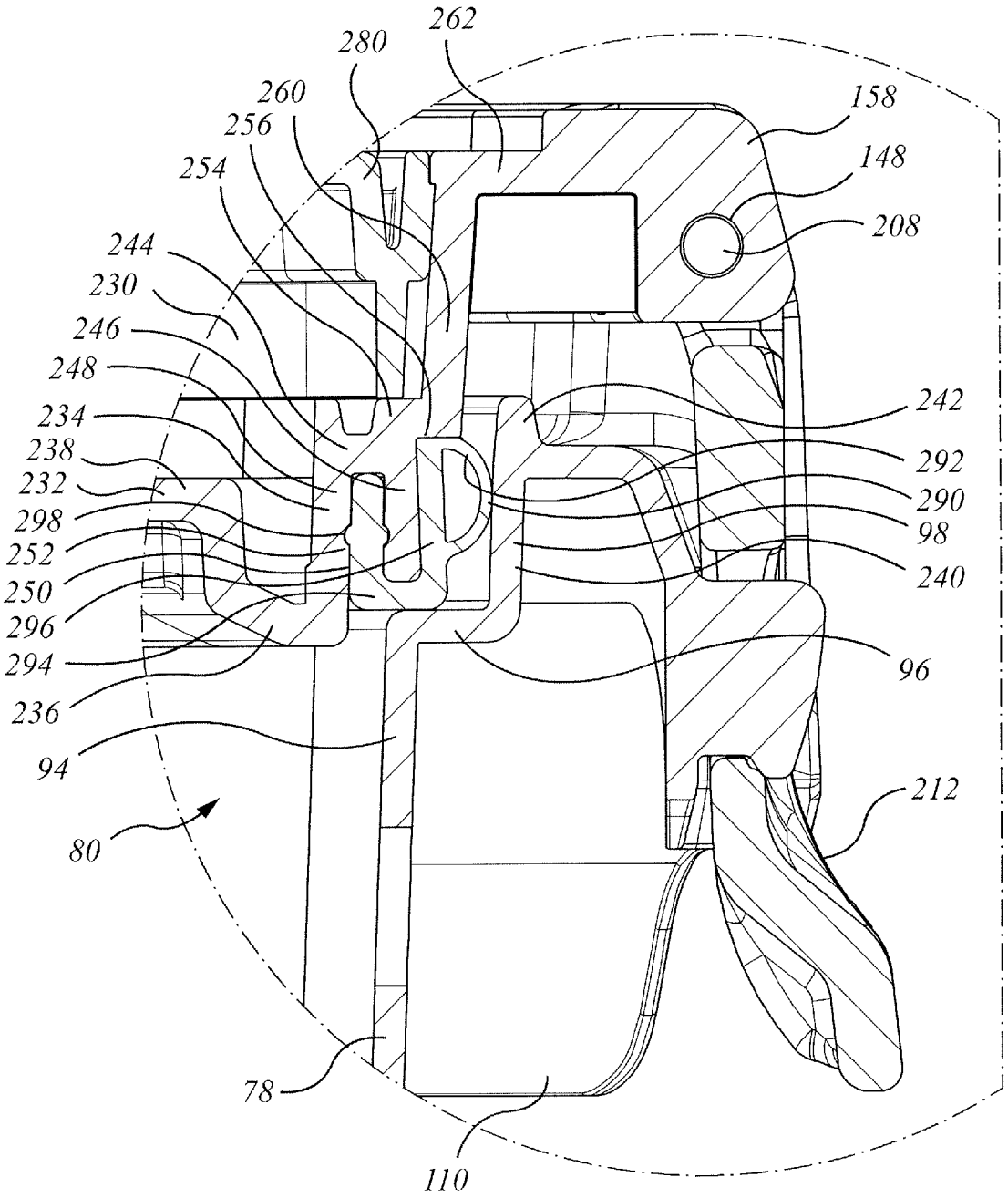
FIG. 5*a* is an enlarged detail of an alternate lid closure and seal arrangement for the assembly of FIG. 4*h;*
Figure 5B:
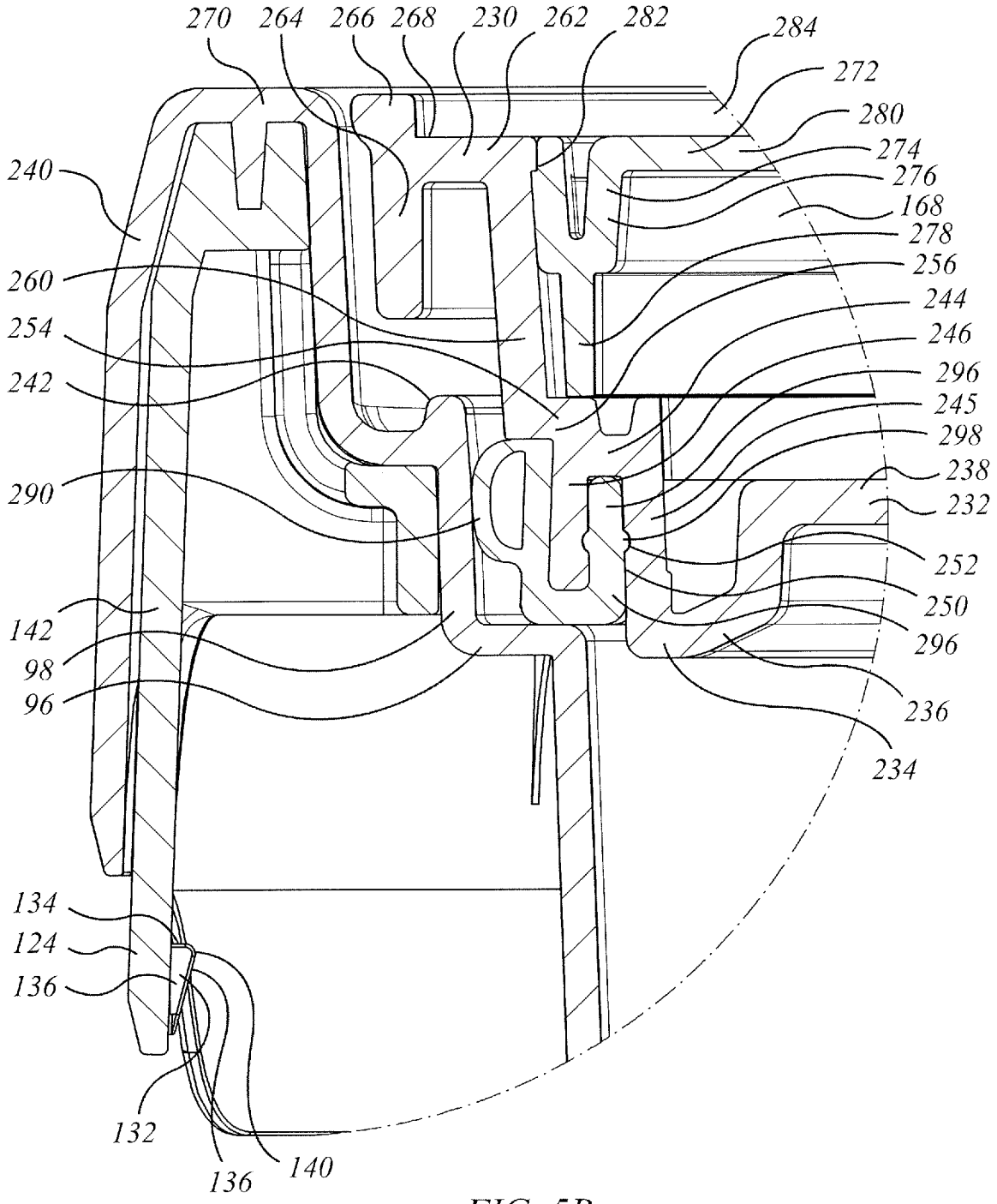
FIG. 5*b* is an enlarged perspective view of a detail of FIG. 4*g;*

Looking at FIGS. 6*a*, 6*b* and 6*c*, and at the enlarged view of the embodiment of FIG. 5*b*, first part 122 has a base 112 that is mounted to the upper outside region of casing 22. In this instance, the set of fittings, i.e., the set of releasable securements 120 includes a first part 122 mounted to end or side wall panel 44 and another such first part 122 mounted to the opposite end or side wall panel 46. In other arrangements first parts 122 could be mounted to front and rear panels 40 and 42, whether as 2 of 4 such parts. The number of such fittings need not be equal on front and back. E.g., there could be 2 fittings 122 on the front wall, and one on the back, or two and three, whether on back or front. There could be more than one such fitting on the end or side walls, and, again, the number of fittings need not be equal or symmetrical. Nonetheless, it is convenient for fittings 122 to be mounted on the respective end walls (i.e., left-and and right-hand panels 40, 42), for there to be one such fitting on each of those end walls, for those fittings to be symmetrically mounted relative to the central vertical fore-and-aft centerline plane of the container assembly generally, for the fittings to be mounted roughly in the plane of, and above, the likely center of gravity of the unit when it is full, and for the fittings to be place well up on the wall near the top of the rim.

Base 112 is a footing, or load spreader that mates to the side wall over a relatively large area, as indicated by the oval footprint seen in FIG. 6*b*. An engagement member 114 stands outwardly proud of base 112. Engagement member 114 may have the form of a catch, or pawl, or stop, or abutment, or finger, or grip, or dog, or tooth, or detent, however it may be termed. In the example shown, the catch 126 has a generally triangular shape, and a substantial length, where the length may be of the order of 10 times the root thickness of the tooth. The downward facing side 116 of the dog, or catch, may be relieved, such that it as a slope extending outwardly and downwardly. When formed in this way, the upwardly facing surface 118 is also sloped outwardly and downwardly, and functions as a cam. The tip of the tooth is indicated as 128.

As seen in FIGS. 3*g* and 5*b*, second part 124 mounts inside skirt 110, and has a mating engagement member 130 that faces inwardly toward wall 78. The embodiment of second portion 124 in FIG. 3*g* is different from the embodiment of second portion 124 in FIG. 5*b*. In FIG. 3*g* the upper end is folded over to fit tightly within the rounded inside radius of upper rib 108 in a sprung interference fit, and which engagement may include and adhesive or bonding agent. In FIG. 5*b*, the underside of rim 270 has an internal tapered boss, or mandrel 286. Second portion 124 has an uppermost leg or wedge, 288, that has a corresponding tapered blind bore that engages mandrel 286. The two parts mate in a sprung interference fit. Again, an adhesive or bonding agent may also be used. Furthermore, in FIG. 3*g*, flange 180 of lid 30 extends at its outermost tip to overlie rib 108. By contrast, in FIG. 5*b*, flange 264 of lid assembly 230 lies within, and flush with, the peripheral wall defined by peripheral rim 270.

Figure 10A:
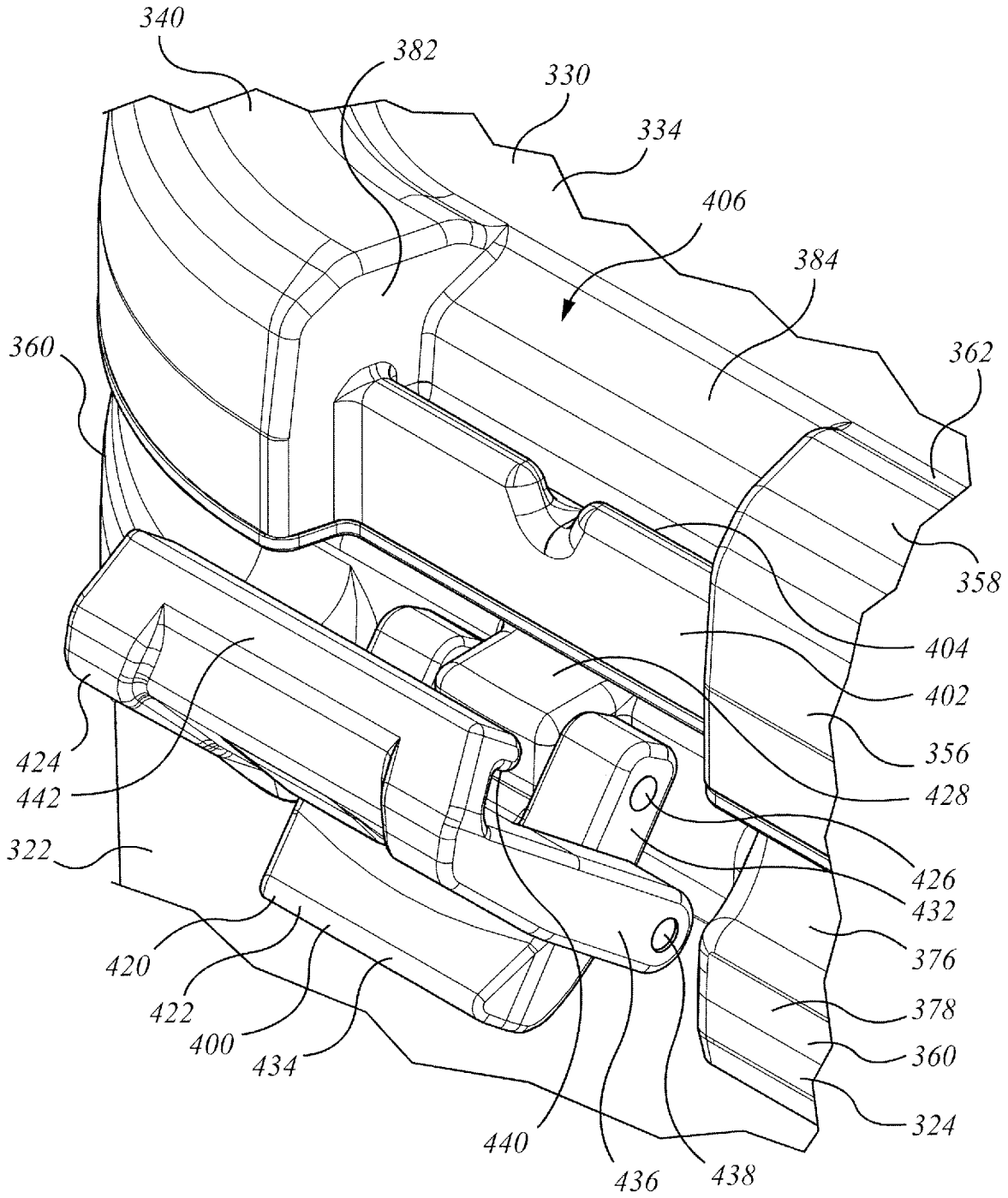
FIG. 10*a* is an enlarged detail of a latch of FIG. 9*a* in the open position.
Figure 10B:
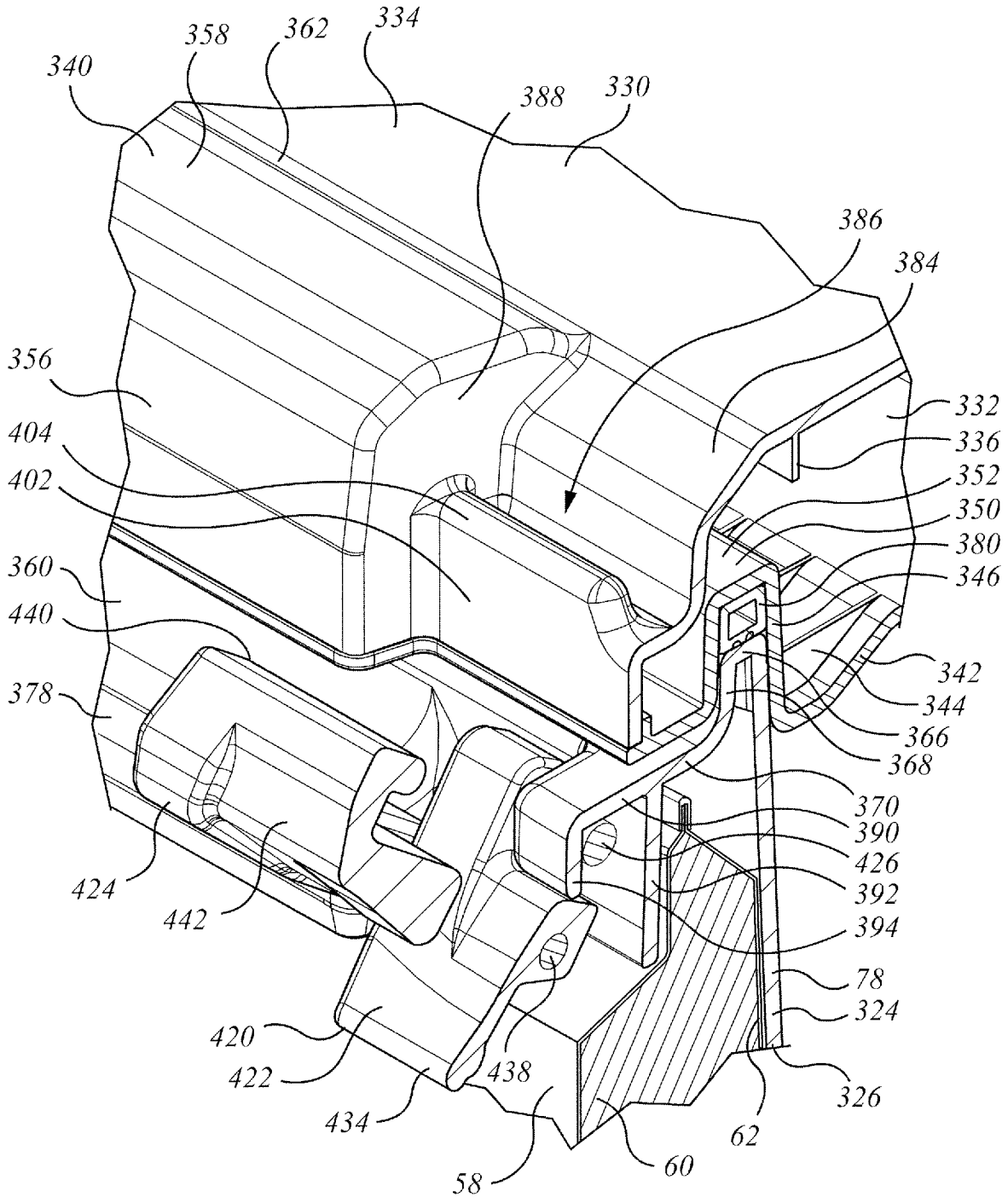
FIG. 10*b* is an enlarged detail of a section of a latch of FIG. 9*a* in the open position.
Figure 10C:
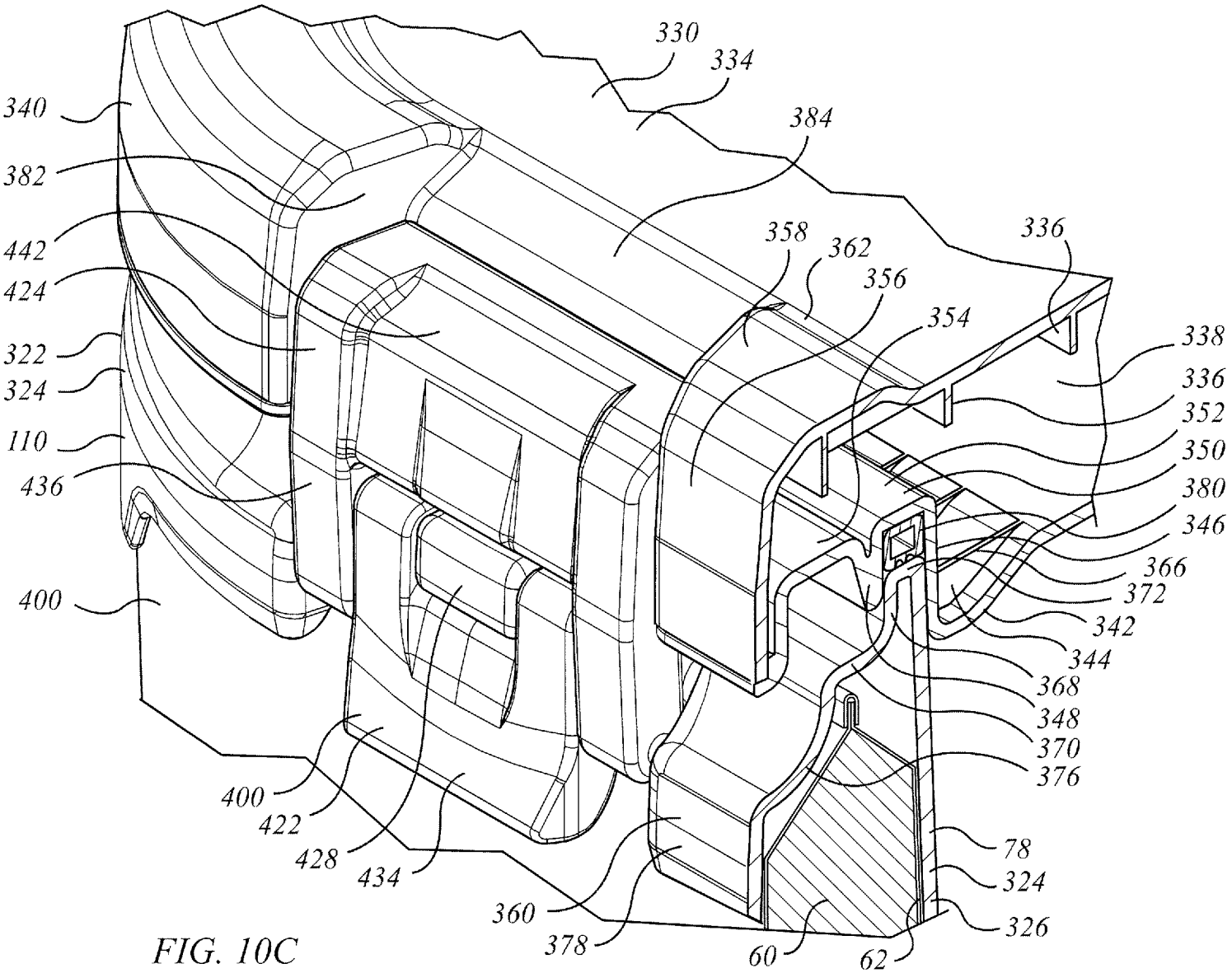
FIG. 10*c* shows the latch of FIG. 10*a* in the closed position.
Figure 10D:
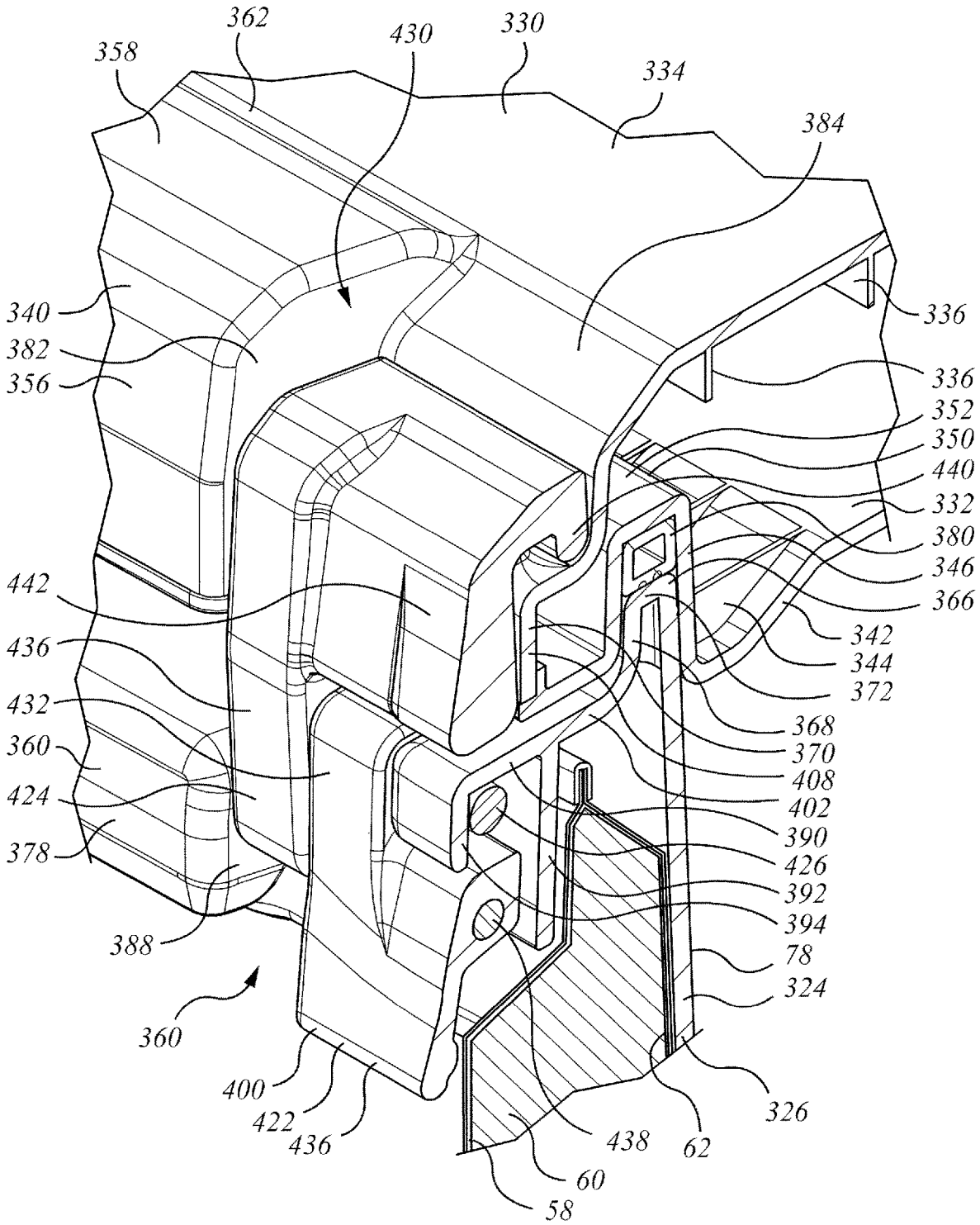
FIG. 10*d* shows the latch of FIG. 10*b* in the closed position.
Figure 10E:
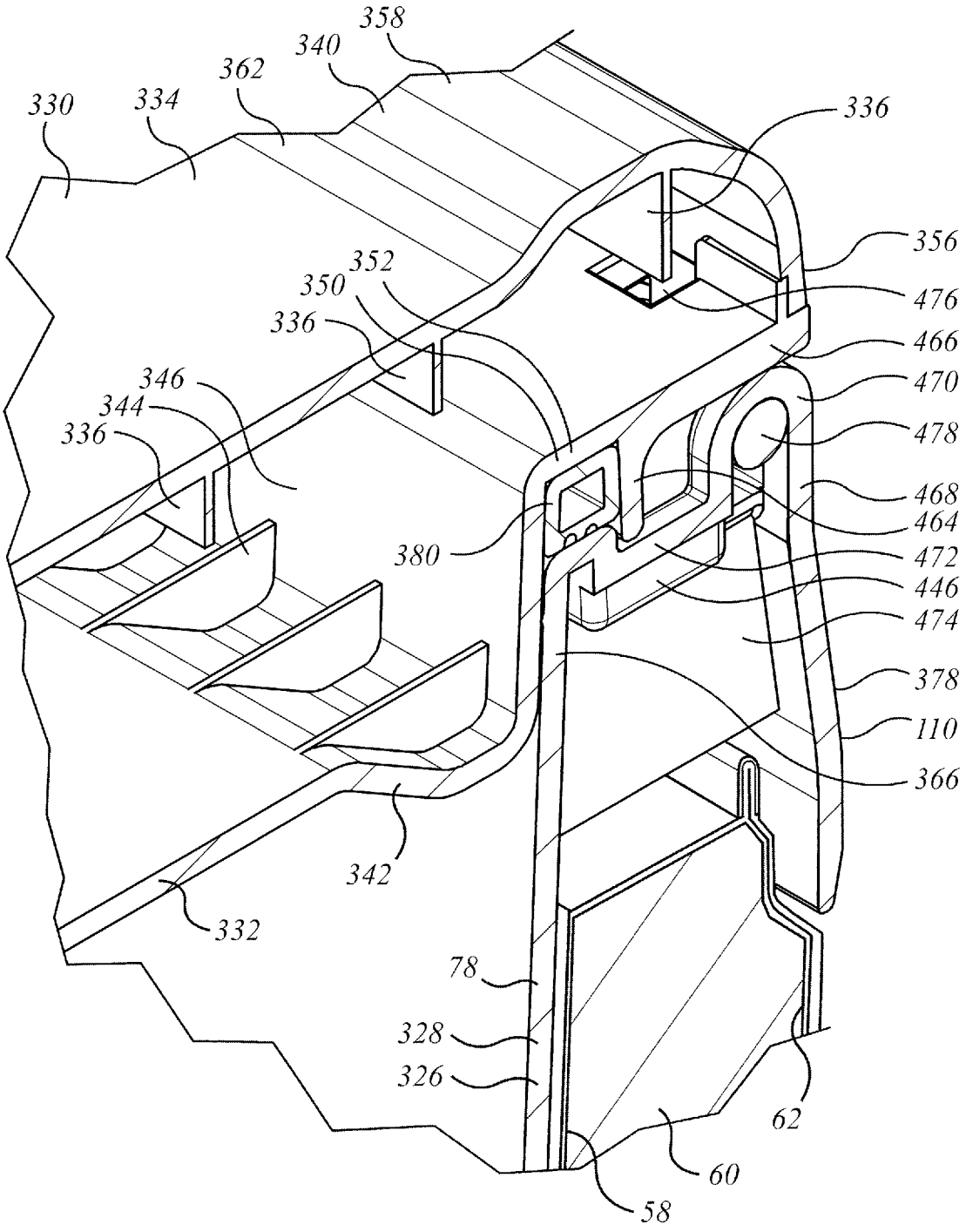
FIG. 10*e* shows an enlarged perspective view of the rear hinge detail of the section of FIG. 8*h* viewed from the opposite side.
Figure 10F:
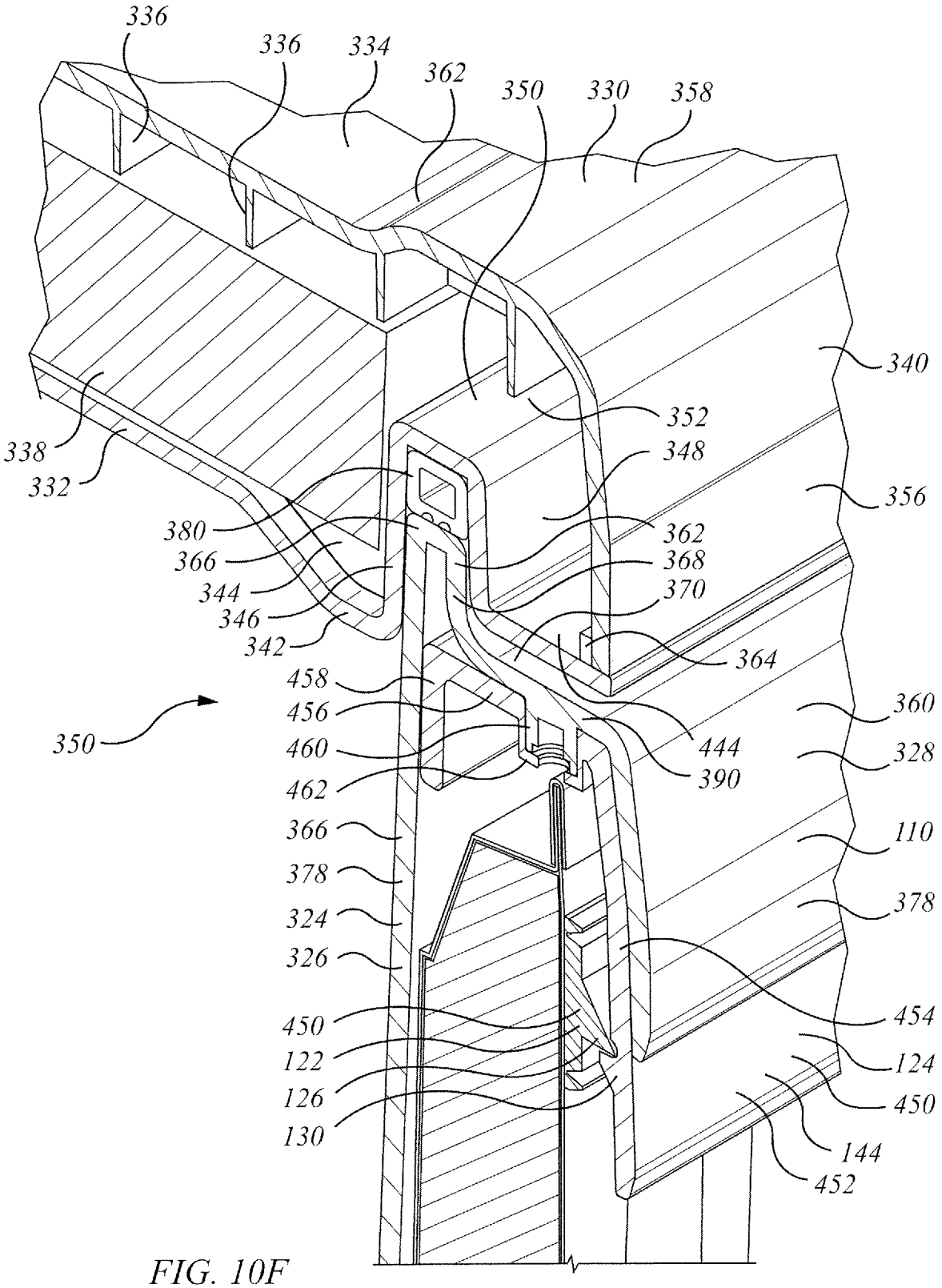
FIG. 10*f* shows an enlarged detail of the container assembly of FIG. 7*a* on the partial section '10*f*-10*f*'.

Whether in FIG. 3*g* or 5*b* or 10*f*, the downwardly depending outer leg of first portion 124 has a tooth, or ridge, or abutment, or dog 132 than may also have a generally triangular shape with upwardly and inwardly sloping sides 134 (upper) and 136 (lower) such that the upper sloped surface is relieved, and so that tip 140 will ride along the cam surface 118 during which time skirt 110 will flex resiliently and deflect locally outward as the insulation material behind panel 78 permits it to flex locally inward. Tooth 132 is mounted on a base 142 of second part 124. Base 142 is formed to conform to the inside contour of skirt 110, and, when in place is secured in place as a doubler or reinforcement that locally reinforces skirt 110. Base 142 also has a lower margin 144 that extends beyond and below the lowermost edge of base 142. Lower margin 144 as rounded corners, and functions as a handle or hand grip. When tip 140 clears tip 128, skirt 110 and panel 78 (whether either or both of them) springs back into place, such that surfaces 116 and 136 overlap in opposition to each other, preventing disengagement of the respective mating prongs or teeth or dogs, or pawls, and so preventing liner 24 from sliding out of casing 22. When disengagement is desired, the user may grasp handle 144 with their fingers and flex skirt 110 outward in a predominantly rotational flexure. This causes tooth 132 of second member 124 to be displaced laterally outward, and to disengage from tooth 114 of first member 122. When so engaged, liner 24 can slide out of casing 22. In this way, the releasable securement fittings 120 function as one-way releasable securements. That is, on installation they are passive, given the cam relationship between tip 140 and surface 134. They are also self-locking, given the relationship of tips 128 and 140, and surfaces 116 and 136 which are angled to draw the latch portions more tightly together when loaded. By contrast, unlocking and releasing fittings 120 requires that active (i.e., not passive) action of the user to release the catch. As may also be noted, the location of the catches is above the bottom marking of skirt 110, and so is largely or completely concealed from view.

Moving on to the closures and latches, it may be noted that when one is sitting at the beach, or at a campsite, and so on, it may be convenient to have easy access to the inside of the cooler. In that context, it may be desirable to have an access to the inside of the cooler that is governed by a friction fit. However, in other, perhaps less casual, circumstances it may be desired to have a closure that is less prone to easy release. In some circumstances it may be desirable for that second closure to be active rather than passive, and to be watertight.

As above, second portion 24 of container assembly 20 includes a lid, or lid assembly 30 mated with rim or frame 28 of liner 26. Lid assembly 30 may be a unitary molded part. Lid assembly 30 may be, and as shown is, or includes, a rigid plastic molding. Lid assembly 30 has a frame 150 that forms a peripheral wall, and that is shaped to correspond to, and to co-operate with frame 28. To that end, they have respective mating hinge fittings 152, 154 along their corresponding rear margins. They assemble together and have an axis of rotation about which lid assembly 30 pivots between first and second, or closed and open, positions relative to frame 28, and therefore relative to liner 26 and chamber 80 more generally. Frame 150 is generally rectangular to correspond to frame 28. It may have, and in the embodiment illustrated does have, generously radiused corners and an overall D shape in which the rear margin is straight and the front wall, or forwardmost, margin has a bulging, arcuate form.

The molding of lid assembly 30 may include, and in the embodiment shown does include, a peripheral flange structure 160 a spanning main portion 162, fore-and-aft stiffeners or ribs or reinforcements 164 that run between the front and rear, and a closure or cover panel 166 that may be made of a softer material. A layer of insulation 168 may seat within lid assembly 30 between spanning main portion 162 and soft cover panel 166.

Looking at the flange structure in section in FIGS. 3*a*-3*h*, the continuous spanning web sheet 170 terminates at its margin at a formed complex flange 172 that has an inwardly formed rib 174 from which a peripheral flange 176 extends outward to terminate at cover panel 166. Sheet 170, rib 174 and flange 176 co-operate to form a continuous, generally four-sided box or lid or cap. This cap has a mating and sealing structure that extends about its periphery. The first parts of the mating and sealing structure are a lowermost leg 178, and an uppermost leg 180. Lowermost leg 178 extends outwardly from near the lowermost portion of rib 174. a distance sufficient to overlie at least a portion of shelf 96. Since shelf 96 and upper portion 94 of wall 78 form an angle section, that section is stiff, and shelf 96 forms a rigid land that intercepts the tip of leg 178 as lid 30 closes. Thus the tip of leg 178 engages, and mates with, shelf 96.

Uppermost leg 180 includes in innermost root or stub, or first leg portion 182 that extends outwardly, parallel to leg 178. First leg portion 182 and leg 178 are spaced apart and opposed, thus forming a channel 184 into which seal 100 seats. Seal 100 is an O-ring seal that goes around the entire periphery of lid assembly 30 in channel 184. Seal 100 is shown in its undeflected uncompressed shape. On closure, seal 100 first wipes against upright leg of tapered wall 98, forming a peripheral contact.

Uppermost leg 180 has a kink or step 186 in the axial direction and then a further outward leg or shelf 188 that overlies the drip lip of the sill 102, followed by a further axial leg 190 that ends in an outward lip 192 that defines a seat for the outside edge of cover panel 166. Cover panel 166 has a peripheral lip or toe 194 that fits within the surrounding wall defined by the inner face of upward axial leg 190. The outer tip of lip 192 fits closely within the opening inside rib 108. As may be understood, the multiple angles formed in the portions of second, uppermost leg 180 yield an edge structure that is rigid, having increased flexural stiffness in both the vertical direction and the lateral direction.

Figure 3H:
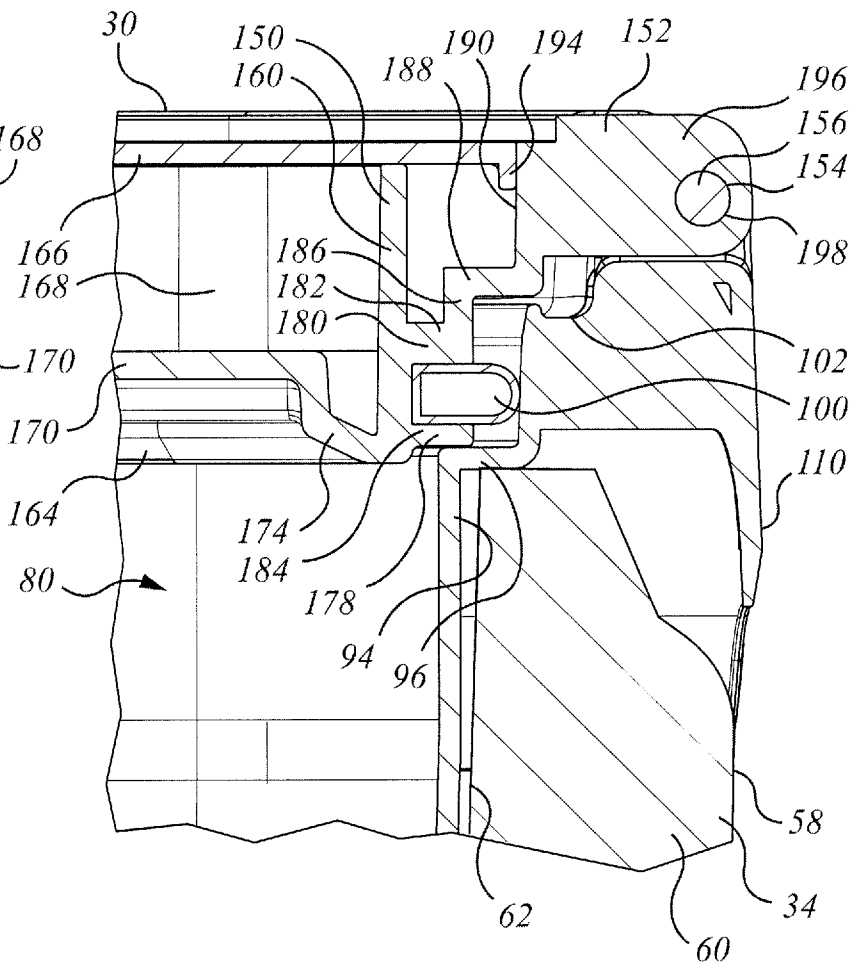
FIG. 3*h* is an enlarged detail of the section of FIG. 3*c* at the rear wall.

The hinge structure is shown in section in FIG. 3*h*. That is, in the rearward portion or rearward margin of lid assembly 30, upper leg 180 is molded to terminate in a set of solid hinge blocks 196 that have bores 198 formed therein in which to receive hinge pins 156 of hinge fittings 154 of frame 150.

Figure 3F:
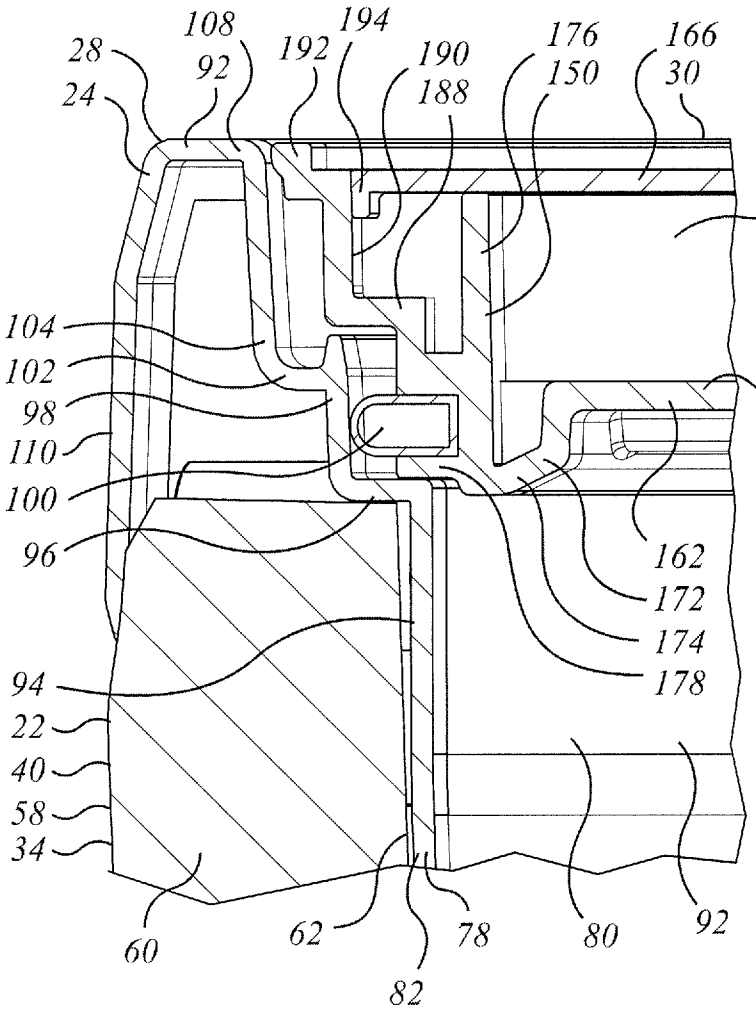
FIG. 3*f* is an enlarged detail of the section of FIG. 3*c* at the front wall.

The opposed view of FIG. 3*f* is seen in section through the upper portion of wall panel 40 of casing 22 and of the corresponding front portion of frame 28 and lid 30 as mated together in the closed position of lid 30. The view of FIG. 3*f* may be compared with the views through front latch 200 seen in the closed and latched position or configuration of FIG. 3*d*, and the corresponding closed and unlatched position of FIG. 3*e*. In these positions there is a stationary member in the form of a stationary latch keeper 202 molded into skirt 110 of frame 28. Latch keeper 202 extends or stands forwardly, outwardly proud of skirt 110 more generally, and includes at its lowermost margin a downwardly protruding detent in the form of a ridge 204. Ridge 204 is effectively an over-center device. A rebate or channel, or accommodation, or seat 206 in which to receive the mating or engaging portion of latch 200 is formed behind (i.e., inwardly of) ridge 204.

Latch 200 includes a moving member in the form of an arm or a latch lever 210 that has trunnions, or stub axles 208 that seat in bores 148 of the forward stationary hinge block 158. Hinge block 158 is formed as an extension of upper leg 180 in the midst of the forewardmost region of the forward edge of lid assembly 30. Lever 210 has a lobe, or cam, 226 that engages, or interacts with, the outermost and uppermost rib of frame rim 78. Lever 210 has roots or arms 212 to which trunnions 208 (or a continuous hinge pin in place of trunnions 208) are (or is) mounted. Arms 212 extend radially away from the hinge axis of trunnions 208. Arms 212 are joined by a transom, or cross-piece, 214, that runs laterally between them, generally parallel to the hinge axis. At the end of arms 212 there is a cross-wise extending bail 216 that is formed in an S-shape to yield a downwardmost engagement member or handle or grip 218 behind which the users fingers may be placed when opening, i.e., releasing, lever 210. The upper edge 220 of bail 216 defines an engagement member, or finger, or tooth, that engages, and when pressed pushes past, detent ridge 204 to snap into, and seat in, the channel, or seat, or accommodation 206. That is, as lever 210 moves to swing pivotally downward from the positon of FIG. 3*e* toward the position of FIG. 3*d*, it tends to pop or lift seal 100 out of its passive engagement with the land defined by tapered wall 98. However, as lever 210 continues to move downward toward its end of stroke, edge 220 encounters detent ridge 204. When this happens a further pushing on handle 218 causes lever 210, and, locally, leg 180, to stretch or to flex such that edge 220 rides over detent ridge 204, and then snaps into seat 206. The latch must be move through the higher energy, stretched or flexed condition before reaching the lower energy, more relaxed condition at rest in seat 206, as seen in FIG. 3*d*. When the latch is released, these same steps occur in reverse. Notably, to ride over detent ridge 204 and sit in seat 206, latch 200 must impost a positive, downward, force on the interface of the lower face of the tip of first leg 198 against the receiving land of shelf 96, thereby securing the closure in an active, energized condition, i.e., in contrast to the passive condition in which resistance to opening of lid assembly 30 is determined by the friction of the tip of seal 100 against axial tapered wall 98.

In the alternate embodiment of FIGS. 5*a* and 5*b*, a lid assembly 230 has a molded spanning member 232 and an edge flange structure 234. As before the edge flange structure starts with a peripheral rib 236 that is bumped inwardly into chamber 80 (or, alternatively expressed, as before, the spanning member web or sheet 238 is bumped outwardly to give more head room inside chamber 80 when lid assembly 230 is closed) that extends around the four sided D-shape of lid 230 more generally. However, the outboard peripheral leg 248 of rib 236 does not extend fully to the cover panel. Rather it ends at an intermediate, half-way height, roughly corresponding to the height of the drip channel lip 242 of molded frame 240. Rather than having an O-ring seal channel defined by legs 178 and 180, edge flange structure 234 has an outwardly extending web 244 and a re-entrant, or downwardly, extending leg 246 that runs generally parallel to, and spaced apart from peripheral leg 248, and that has a molded peripheral spline 252 in one or both of its internal walls in legs 246 and 248. A channel 250 is thereby formed between legs 246 and 248. A further wall or web portion 254, which is effectively a continuation of web 244, offset upwardly therefrom, extends outwardly to form a shoulder 256 at the root or base of leg 246. A further peripheral leg or peripherally wall 260 extends upwardly predominantly axially from the outermost edge of web portion 254 on an outwardly splayed taper. Leg 260 terminates in a further lateral web 262 that extends laterally outwardly to a further flange 264 that extends downwardly in general spaced opposition to leg 260. The back or upper end 266 of flange 264 extends upwardly proud of lateral web 262, thereby defining an internal shoulder 268. The outside tip of end 266 bulges laterally beyond leg 264 forming a close fit inside peripheral rim 270 of frame 240.

A molded spanning member, or tray, 280, has a spanning panel or web, or sheet 272, and a peripheral wall 274. Peripheral wall 274 has a folded-over rib portion 276, and an extending leg 278 that protrudes downwardly from the crown of the inwardly facing rib portion 276. On installation, the tip of leg 278 bottoms on the upwardly facing back of leg or flange 264, thus establishing the height of sheet 272 relative to sheet 238. The tip of the inside face of wall 260 and the outside of the tip of the outer leg of rib 276 are correspondingly notched to fit together, as at 282, so that, on installation, tray 280 snaps into place, and is prevented by the notched relationship from disengaging. These panels may be molded to have a formed profile, or they may be substantially or entirely flat, or formed on a smooth arc. The space between sheet 272 and sheet 238 may be filled with insulation 168. The space defined inside shoulder 268 and outside sheet 272 is filled with a soft cover panel 284 of such appearance as may be. Cover panel 284 can alternatively be a herd member presenting a working surface, such as a cutting board. Either or both of tray 280 and cover panel 284 may be made of either rigid molded material, or of a soft-sided, fabric material, which may include a layer or batt of insulation.

As seen in FIG. 5*b*, the outside face of leg 246 is tapered outwardly. A seal is shown as 290. The major portion of seal 290 is a P-seal leg, or wiper, 292. It has a root that forms a lateral web, or ring, 294 and a leg 296 that extends upward. Leg 296 has outside ridges 298 that fit into splines 252. The back of P-seal leg 292 and leg 296 sandwich leg 246 of edge flange structure 234. In operation, in the unlatched condition, the bulb of P-seal leg 292 encounters the taper of wall 98, in a passive, friction fit. When latch 110 is closed, it forces the tip of leg 246 into web 294, which actively energizes the seal.

Container assembly 20 also has a pressure relief vent, 300, which allows the passage of air, but not the passage of liquids. Such a valve or vent prevents the build-up of a pressure differential between inside and outside during normal use, such as may tend to permit container assembly 20 to be opened more easily, while also maintaining the waterproof nature of the rigid liner and lid combination. Such relief vents are available from commercial vendors. A vent 146 may be located in the rear wall of container assembly 20, for example between the hinges or in the side wall as seen in FIG. 10*h*.

Figure 3I:
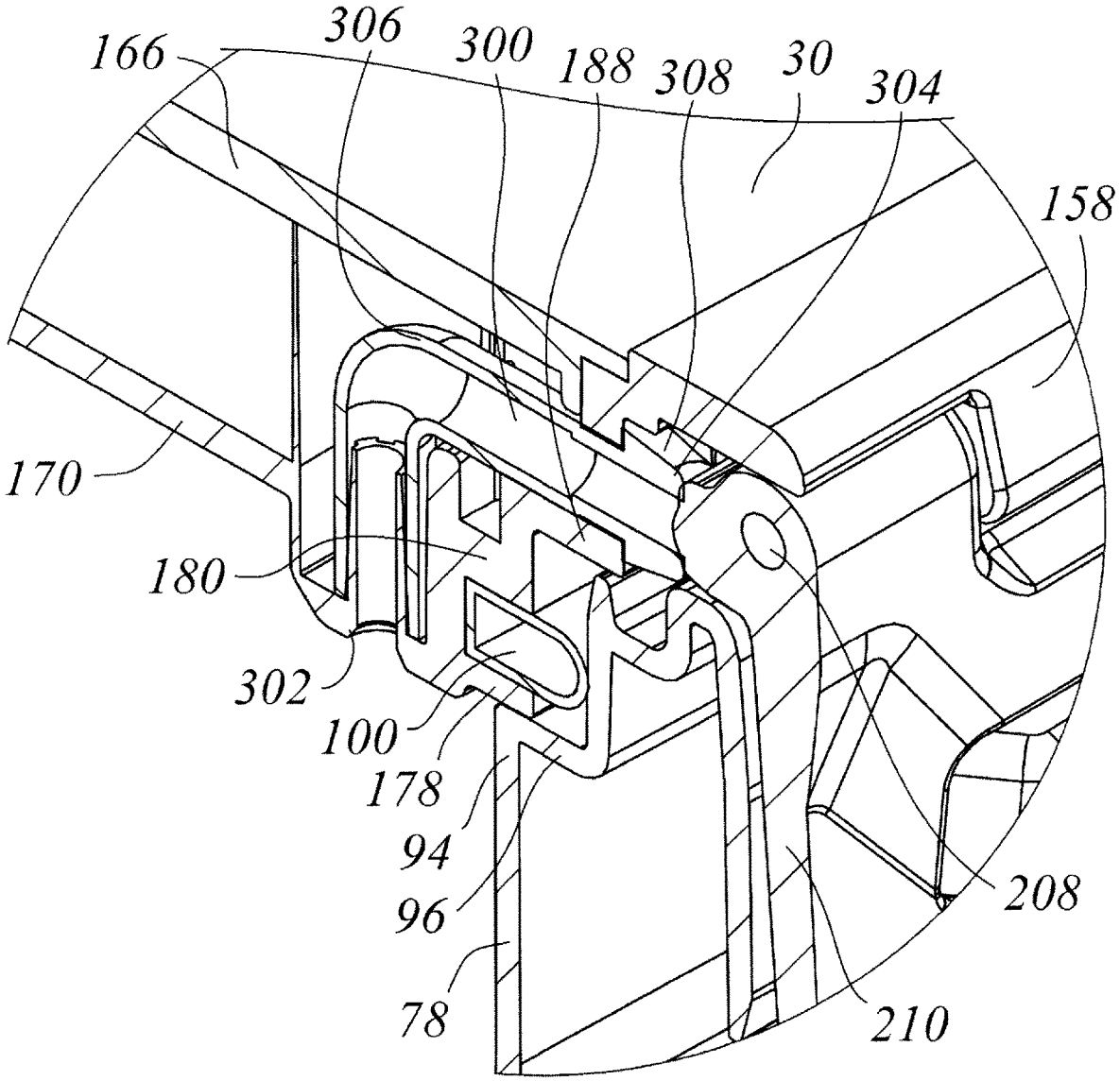
FIG. 3*i* is a sectional view, in perspective, showing details of a pressure relief vent taken in the opposite direction to that of FIG. 3*g*, through the relief vent.
Figure 4B:
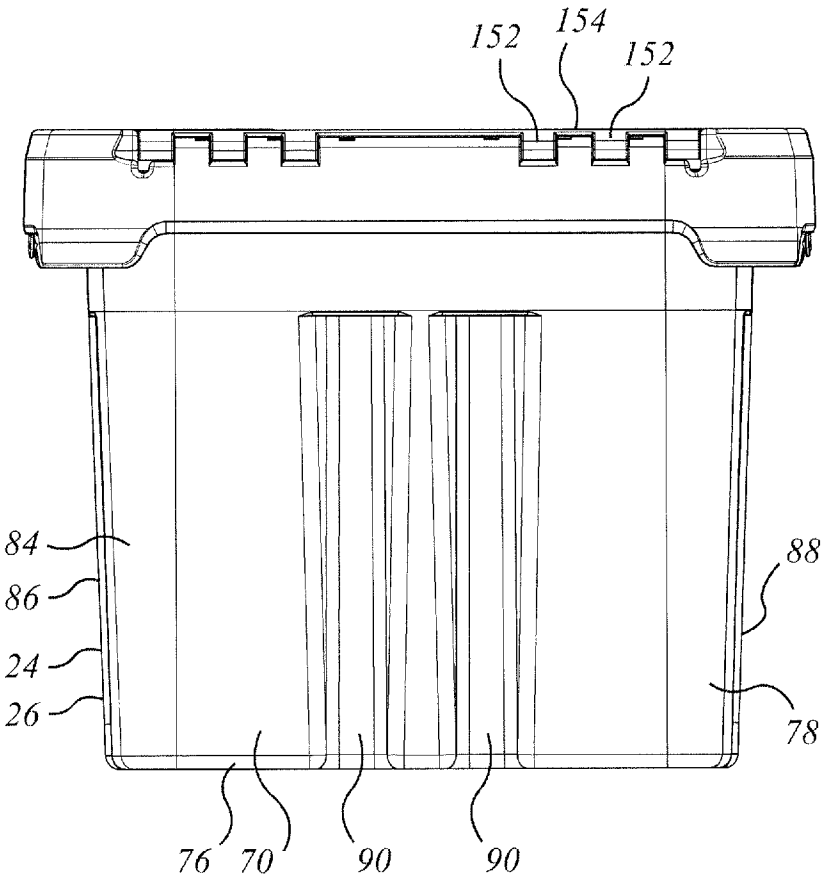
FIG. 4*b* is a rear view of the rigid liner and lid assembly of the insulated soft-sided container assembly of FIG. 2*a;*
Figure 4A:
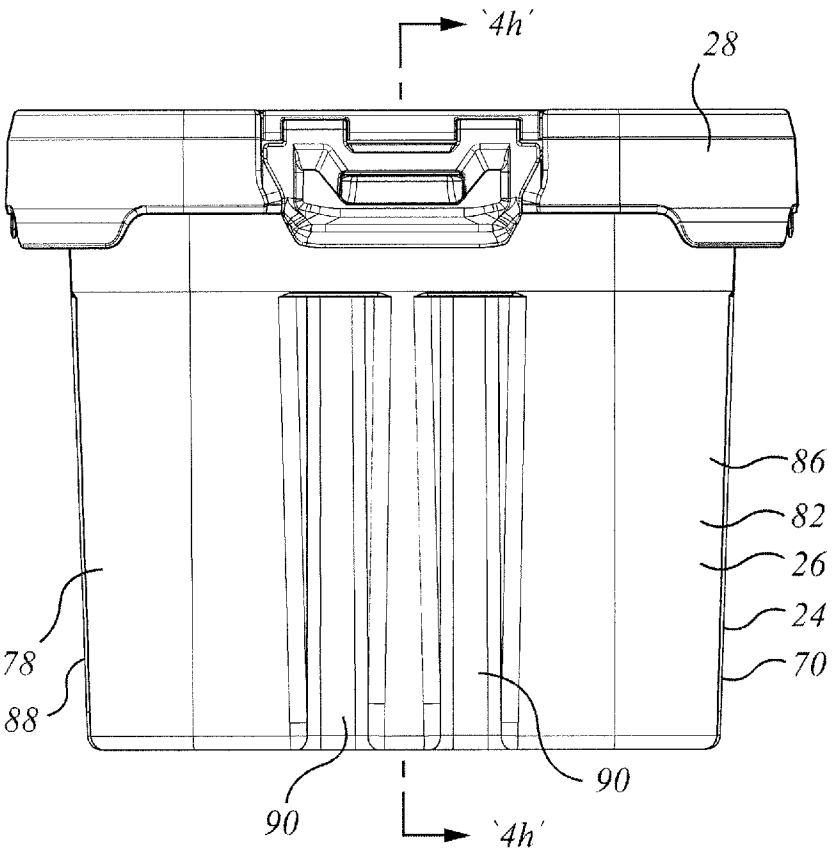
FIG. 4*a* is front view of the rigid liner and lid assembly of the insulated soft-sided container assembly of FIG. 2*a;*
Figure 4G:
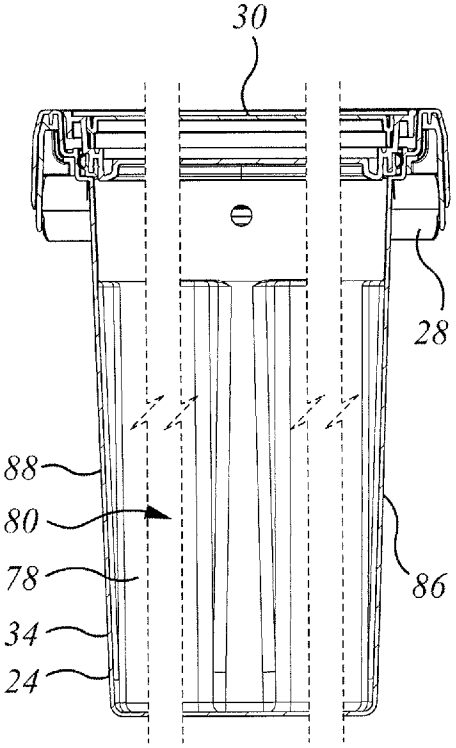
FIG. 4*g* is a foreshortened section the assembly of FIG. 4*c* taken on section '4*g*-4*g*' of FIG. 4*c;*
Figure 4H:
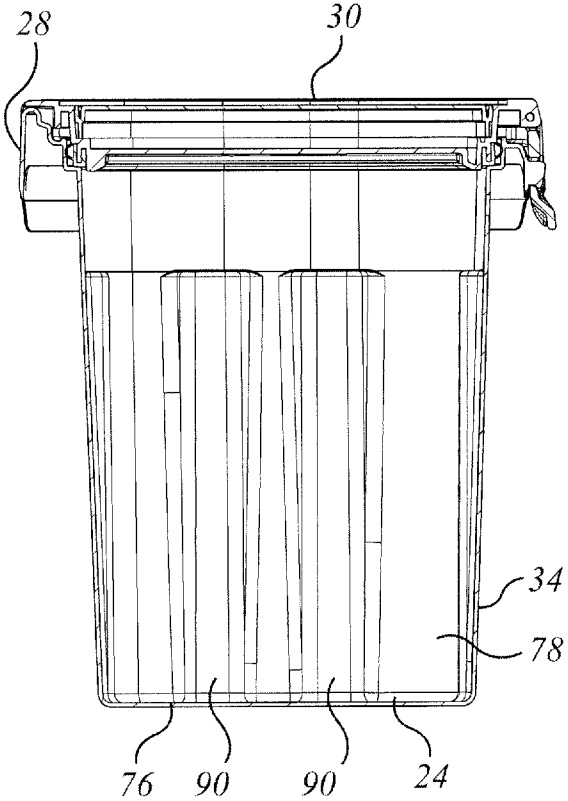
FIG. 4*h* is a section taken on the centerline vertical plane of the container assembly of FIG. 4*a* indicated as section '4*h*-4*h*' through the lid latch assembly.
Figure 4C:
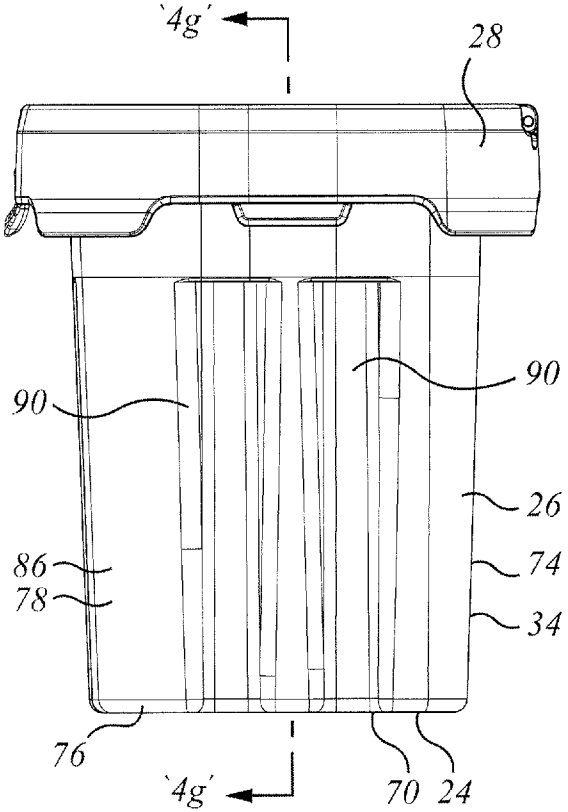
FIG. 4*c* shows the left-hand side of the rigid liner and lid assembly of FIG. 4*a*, the right hand side being a mirror image thereof.
Figure 4D:
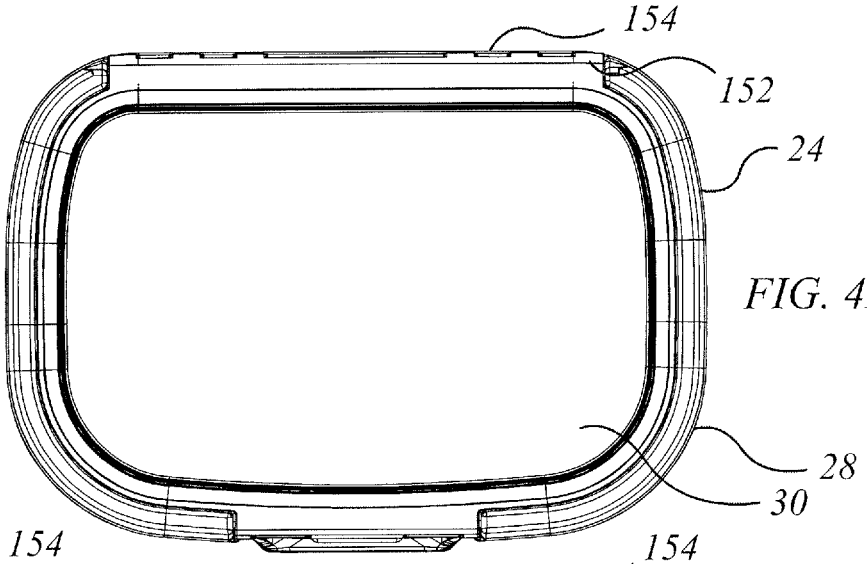
FIG. 4*d* is a top view of the rigid liner and lid assembly of FIG. 4*a;*
Figure 4F:
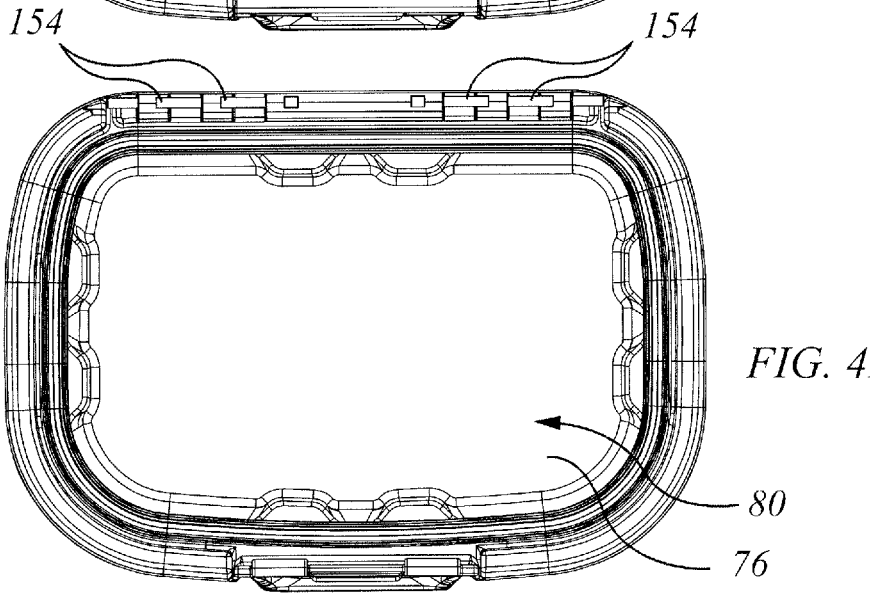
FIG. 4*f* is a top view of the rigid liner and lid assembly of FIG. 4*d* with the lid removed to show the inside of the liner.
Figure 4E:
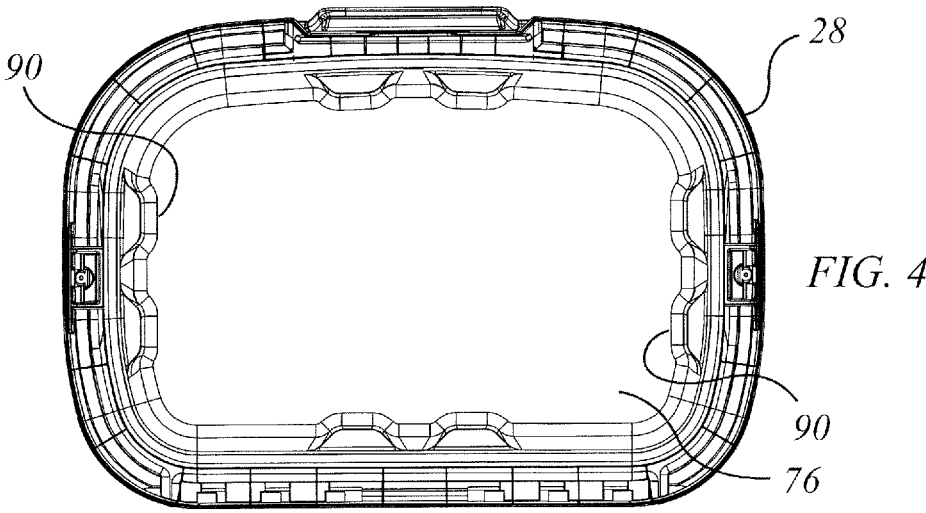
FIG. 4*e* is a bottom view of the rigid liner and lid assembly of FIG. 4*a;*

In the embodiment of FIG. 3*i*, pressure relief vent 300 has an exterior port 302, and interior port 304, and a passageway between them defined by a tube 306. Interior port 302 may be molded into the peripheral inward rib of the lid molding, as shown. Exterior port 304 may likewise be formed in, or may pass through, the external peripheral flange structure, again as shown in FIG. 3*i*. Tube 306 may be a flexible tube made of a relatively soft rubber or vinyl, having an internal end that mates with interior port 302. In the example shown, interior port 302 is a male stub, and tube 306 fits over the stub. At the outer end tube 306 has a collar 308 that seats inside the vertical leg of the lid. The open end faces the root of the moving member. When latch lever 210 is closed, lobe 226 is brought into engagement with tube 306, and, in so engaging, blocks it, the end of the tube being flexible and resilient to form a seal on lobe 226. Thus the motion of locking lever 210 also seals container assembly 20. Thus lever 210 has three positions: locked; passively disengaged such that the lid assembly is held in a friction fit; and fully open, as in FIG. 3*e*.

In an alternate embodiment there is a soft-sided insulated container identified as cooler assembly 320, as seen in FIGS. 7*a* to 7*h*. The basic components of cooler assembly 320 are given the same annotation numbers as the corresponding features of container assembly 20. Cooler assembly 320, like cooler assembly 20 is a soft sided insulated container. The wall structure of an outer skin; a layer of insulation; and an inner skin, is as before. Cooler assembly 320 has a casing 322, and a liner 324. Liner 324 includes a main body portion 326 (which may also be referred to as "the liner", and that seats inside casing 322), a frame assembly 328, and a lid assembly 330. The hinge structure and arrangement between frame assembly 328 and lid assembly 330 may be taken as being substantially the same as that of container assembly 20.

Container assembly 320 differs from container assembly 20 in being larger. Accordingly, it is both taller and wider; and rigid liner main body portion 326 has three flutes 90 in the front and rear walls, rather than two. Also, given the size, it has two latches 400 rather than the single latch 210 of container assembly 20. Furthermore, the latch assemblies shown are two-part cam latches as opposed to a single part lever as in container assembly 20. Container assembly 320 also has a different two stage closure and seal from that of container assembly 20, whether of FIGS. 3*a*-3*h* or of FIGS. 5*a* and 5*b*.

Considering the latch structure of FIGS. 9*a* and 10*a*-10*d*, lid assembly 330 has a generally rectangular shape when seen from above in plan view. It has an inner surface or skin or panel in the form of a spanning web 332 that, when closed, forms the roof of chamber 350. There is also an outer surface or spanning sheet, or panel or web 334.

In FIG. 10*c*, outer web 334 has spaced-apart reinforcement ribs 336 that run cross-wise. Insulation, such as foam insulation 338 may fill the space between webs 332 and 334. Around the periphery of lid assembly 330 there is a molded structural frame 340, which, again, is generally rectangular with radiused corners to follow the plan form shape of lid assembly 330, or frame 324 and of casing 322 more generally, much as described above. Structural frame 340 effectively forms a stiffened peripheral margin, or flange structure, around both web 332 and web 334, with segments thereof extending along the respective front, rear, left-hand side and right hand side margins or portions of lid assembly 330. Structural frame 340 differs from structural frame 28. In the first instance, because structural frame 340 is part of the lid assembly, which, of course, moves between open and closed positions; whereas structure frame 28 is part of the stationary structure of liner 24. Lid assembly 30 has a peripheral edge that closed within, and then lay flush with, frame 28. By contrast, in the closed position structural frame 340 lies over, and forms a visually concordant profile with, frame 324.

Structural frame 340 has a downwardly formed peripheral rib 342. It merges into the margin of inner spanning sheet 332, with an array of internal form-holding webs or gussets 344 spaced all around. Rib 342 transitions into an inward channel or hat section 350 having an inner leg 346, an outer leg 348 and a back 352. Outboard of leg 348 is a grip in the form of an upwardly molded impression 354 into which a person's finger tips might fit when opening the container assembly. An outer leg 356 of frame 340 extends upwardly from the outside lip of impression 354. Outer leg 356 forms the outside profile of frame 340 and of lid assembly 330 more generally. Outer leg 356 curls around and has an upper portion 358 that overspans flange 354, and is generally opposed thereto and spaced apart therefrom such that portion 358 functions as a flange in opposition to the web of accommodation 354, with leg 356 functioning as a shear web between them. Inboard of portion 358 there is a downward chamfer 362 prior to merging with sheet 334. Chamfer 362 acts as a retainer, or retaining lip to discourage objects from sliding off sheet 334. Flange 358 has a stiffening rib 336 that acts like a longitudinal stringer.

Rigid frame 360 of liner 324 is also different. It has upstanding internal liner wall 78, but it terminates in an upper margin formed back on itself into channel section 366 that nests within channel section 350 of lid assembly 330. The upper end of inner wall 78 is the first leg of that channel section, and it has an interference friction fit relationship with leg 348. The outer leg 368 extends downwardly to merge into a laterally outwardly extending formed flange 370 that ultimately has an outermost, downwardly curled web 376 whose outer leg 378 lies in the same plane, or the same general arc of curvature, as may be, as the laterally outermost segment or flange portion of outer leg 356, to give a relatively smoothly mating relationship or appearance.

As seen in FIG. 10*c*, a seal 380 locates inside channel or hat section 350. Seal 350 may be, and in the embodiment illustrated is, an O-ring seal that extends about the periphery of frame 340. It may be a hollow section seal. That hollow section may be D-shaped, P-shaped, or rectangular, as shown. In operation, when the lid is not latched, there is a passive friction fit engagement as one or other of the outside leg surfaces of the walls of channel section 362 comes into engagement with the inside wall of one of the side legs of channel or hat section 380. There may be passive engagement on seal 380. When the latches are closed, there is active engagement that imposes a closing force at the closure interface between the lid frame and the liner frame, which actively energizes, and compresses, seal 380 under a more-than-gravity load.

Having considered the seal closure interface generally, latches 400 are shown in FIGS. 10*a*-10*d*. Latches 400 are compound latches. A stationary keeper 402 is formed in frame 340, having an upwardly protruding detent or ridge, or catch 404. The molded keeper structure is formed in a rebate or accommodation 406 molded into the front face of frame 340 such that, when latch 400 is closed, latch 400 sits largely or completely within the profile of the adjacent frame structures of lid assembly 330 and liner frame 360.

In this structure, rather than the section seen in FIG. 10*c*, the section in the midst of Accommodation 406 is seen in FIG. 10*d*. Here the outer profile of frame 340 has been interrupted, and there is a vertical web 408 of keeper 404 that runs between sidewalls 382 of accommodation 406. The recessed wall 384 slopes outward and downwardly from sheet 334. It has a dog-leg folded in to accommodate closing finger 440 of latch 400. Recessed wall 384 ends in vertical web 408. In this section outer leg 348 of top hat 350 has an outwardly extending flange 394 that ends at, and mates with the bottom edge of vertical web 408. Similarly, frame 360 is locally interrupted by accommodation 386 that has side walls 388. In the midst of accommodation 386, the section of frame 360 replaces items 376 and 378 with an extended flange 390 that is an extension of flange 370. There is also a vertical web or leg 392 that runs between side walls 388 and that forms a T-stem with flange 390, making a stiffened section. The outer margin of flange 390 ends at a downwardly depending web or flange, or retainer, or finger 394. When lid assembly 330 is closed, vertical web 408 and web 392 are roughly aligned in a common vertical plane.

Latches 400 also include a moving assembly 420 having a first leg 422 and a second leg 424. First leg 422 is a lever constrained to pivot about a hinge pin 426 that passes through a stationary boss 428 centered in latch accommodation 430 of frame 360. Hinge pin 426 pierces the side walls of boss 428 and is captured below flange 390 and behind finger 394. In the embodiment shown, first leg 422 has a pair of spaced apart arms 432 that straddle boss 428. The outermost, or distal, end of first leg 422 is formed into the shape of a handle or grip 434 for engagement by the user's fingers or hands more generally. Second leg 424 is pivotally mounted on a hinge pin 438 at a location part way along first leg 422, roughly the mid-way location as seen in FIG. 10*a*. Second leg 424 is a grip, or claw, or clasp that is pivotally secured to hinge pin 438 at one end. It likewise has a pair of arms 436 that bracket arms 432, and a cross-member 442 that includes a finger 440 at the distal end furthest away from hinge pin 438. Finger 440 over-reaches and engages detent ridge or catch 404. When handle 434 is pressed downward the hinge pins move through an over-center condition in which they can impose a downward closing force through finger 440 and into catch 404, thus energizing seal 380. In this position the U-shaped structure of arms 432 and the cross-member of grip 434 of first leg 422 nests about three sides of boss 428, and nests within the U-shaped structure of arms 436 and cross-member 442 of second leg 424 within the profile of frames 340 and 360.

In this configuration, as before, there is a first stage of closure in which the closure is a passive friction fit, and the latch is released. There is also a second mode or stage of closure in which the latch is applied, and a greater-than-gravity active force is applied at the closure interface to energize seal 380.

FIG. 10*f* is a section of an alternate releasable securement 450 of the main casing to the internal liner, whether of casing 22 or 322, and whether the liner is liner assembly 24 or liner assembly 324, seen in contrast to securement 120. As before, the first and second portions are indicated as 122 and 124. The components of assembly 450 are understood to be the same as those of assembly 120, unless otherwise noted, and have the same annotation numbers. As in the other views, frame 340 includes channel section 350 that houses seal 380. Outer leg 348 terminates in a flange 444 that extends horizontally outboard above opposed flange 390. As before, second portion molded fitting 452 mounts snuggly within, and has a shape that conforms to, the inside of frame 360. Fitting 452 has an outer skirt or wall 454 that fits within skirt 110; an upper web or back 456 that mates with the underside of flange 390; and an inner wall or flange 458 that is opposed to, and abuts, the outside face of wall 78. In that regard, fitting 452 has a section seen in FIG. 10*f* of a channel having legs of unequal length, the outer leg being much longer than the inner leg. In this example flange 390 and back 456 have mating mate and female engagement fittings 460, 462. As shown, fitting 460 of flange 390 is a male fitting in the form of a downwardly protruding boss. Fitting 462 of back 456 is a female socket that receives male fitting 460. As stub, or lock, or rivet, or short screw is driven from below into the blind bore of male fitting 460, and prevents handle 140 from disengaging from skirt 110.

Figure 9B:
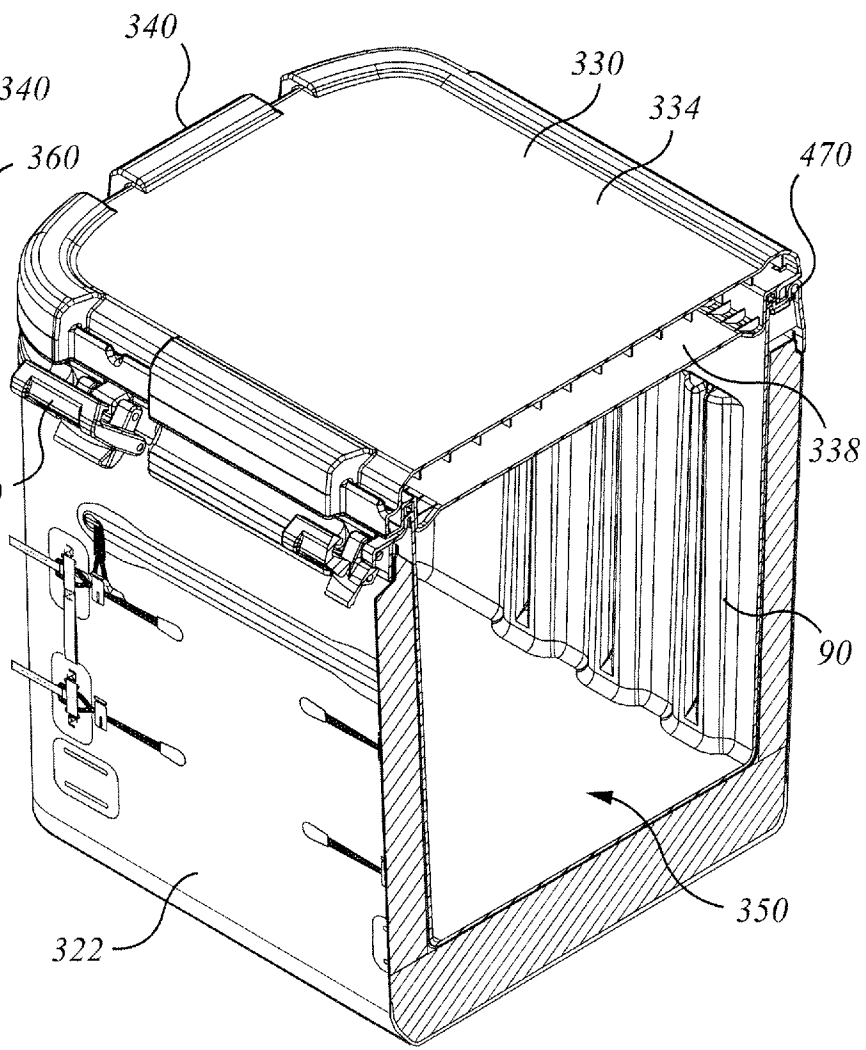
FIG. 9*b* is an isometric view of the container assembly of FIG. 7*e* taken on section 9*b*-9*b*' of FIG. 7*e;*
Figure 9A:
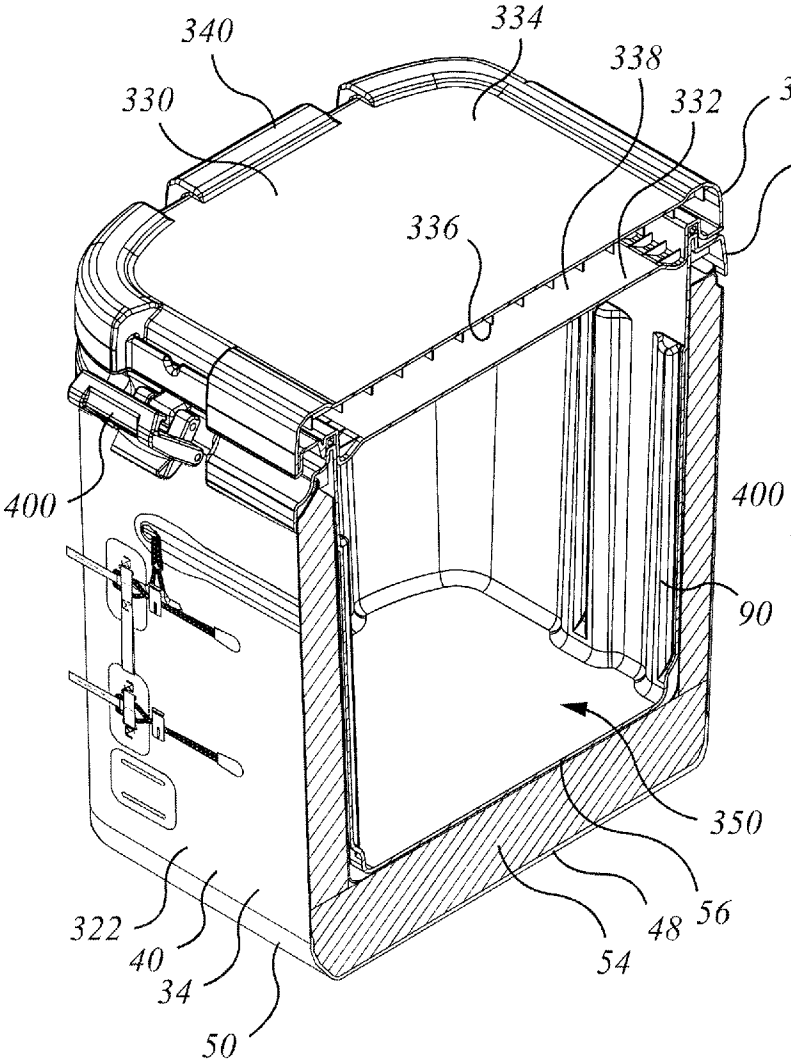
FIG. 9*a* is an isometric view of the container assembly of FIG. 7*e* taken on section '9*a*-9*a*' of FIG. 7*e;*
Figure 10G:
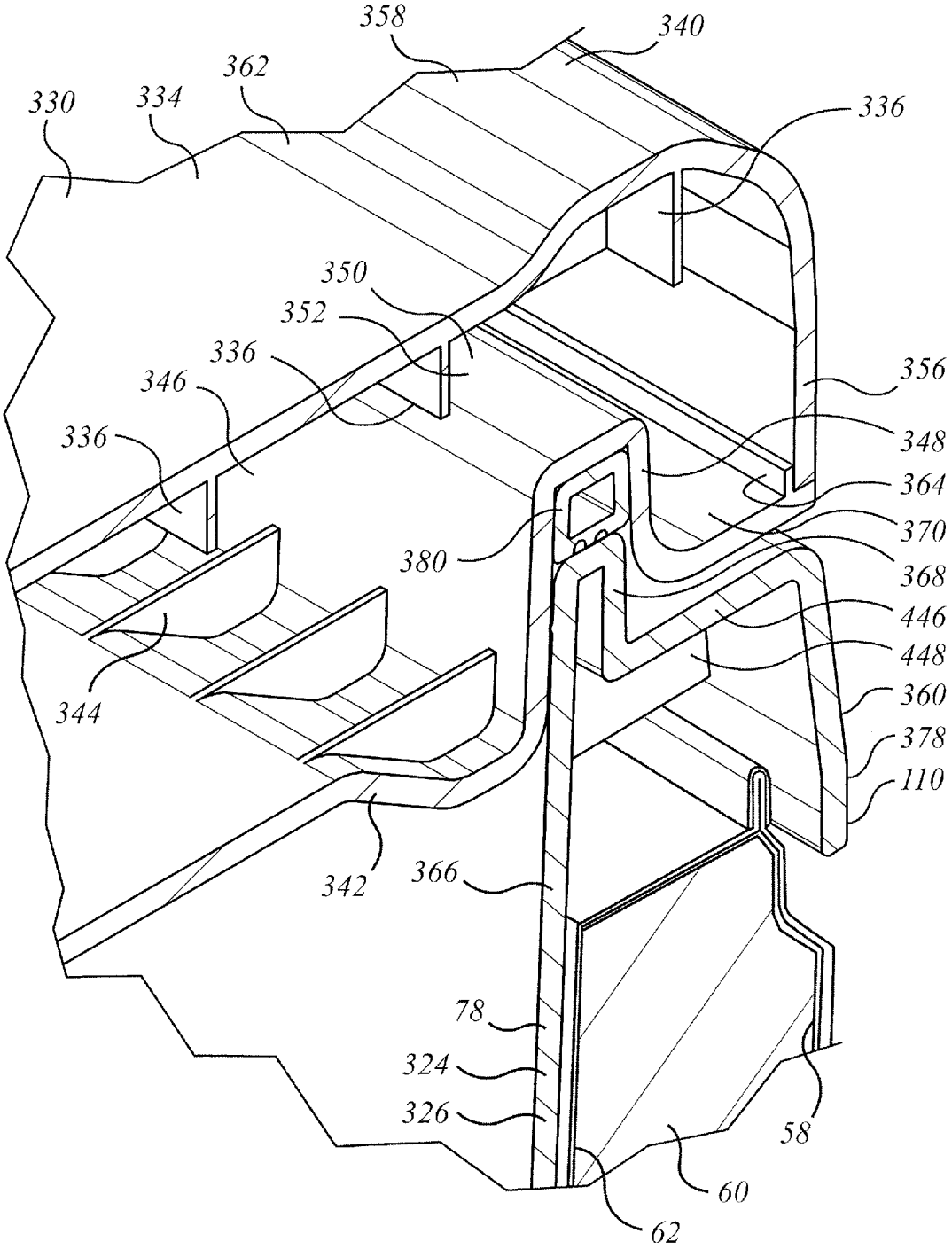
FIG. 10*g* shows an enlarged detail of section of FIG. 9*a* at upper rear.
Figure 10H:
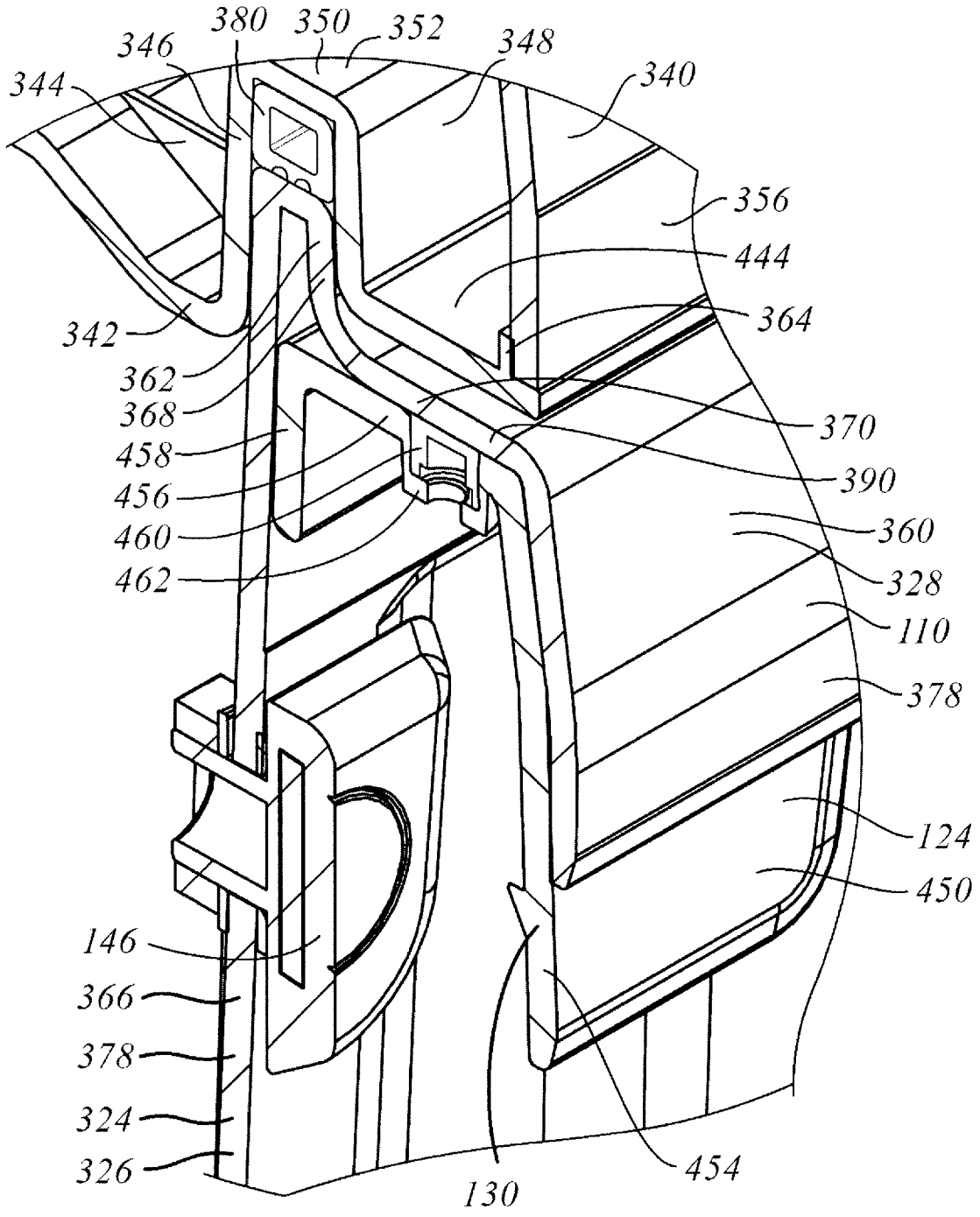
FIG. 10*h* shows an enlarged detail of the structure at FIG. 10*f*, with the insulation removed to show a pressure relief.
Figure 11A:
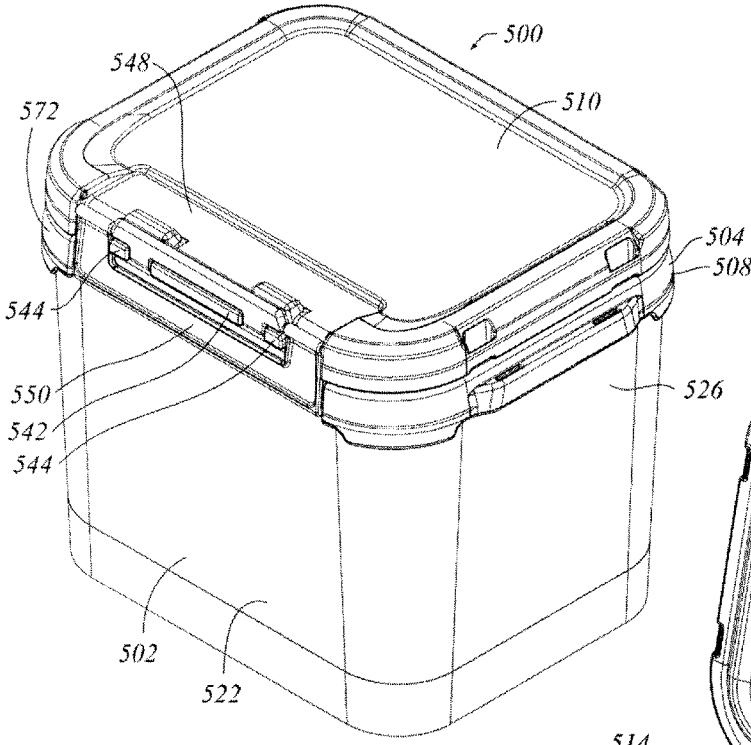
FIG. 11*a* shows a general arrangement of another embodiment of soft-sided insulated container assembly to that of FIG. 1*a;*
Figure 11B:
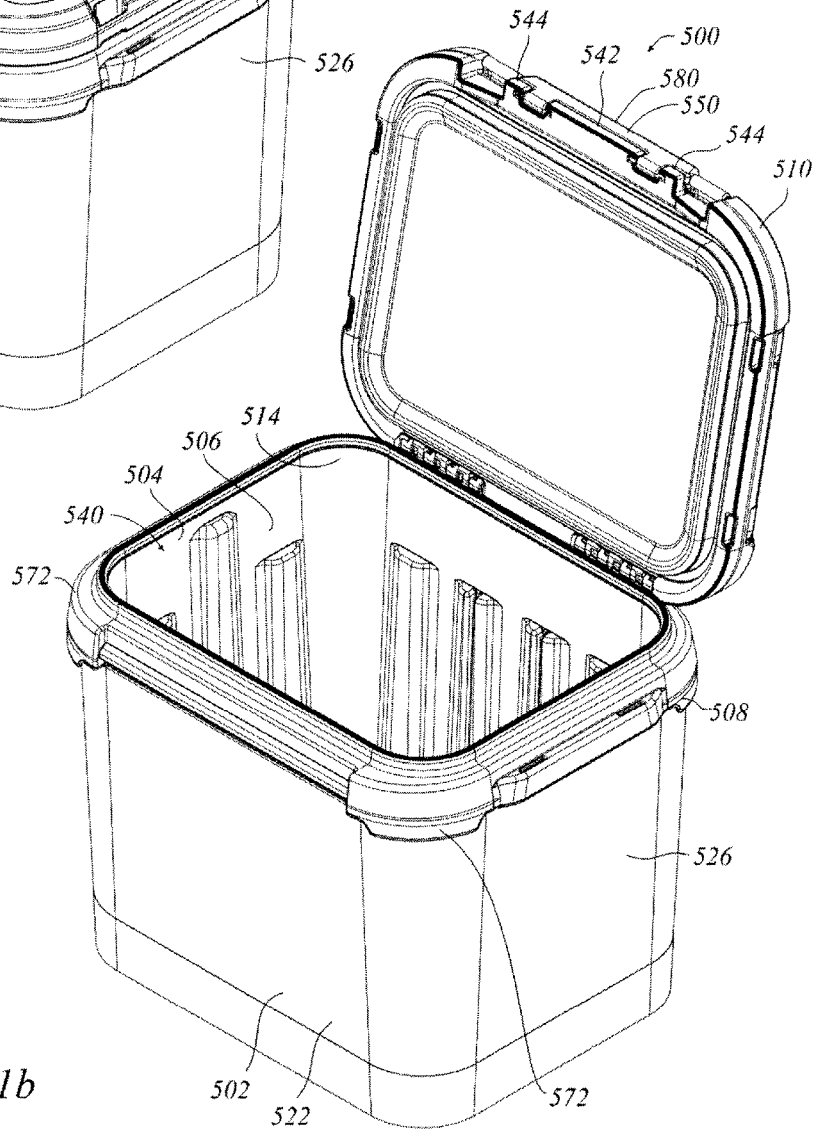
FIG. 11*b* shows the soft-sided insulated container assembly of FIG. 11*a* as open.
Figure 11C:
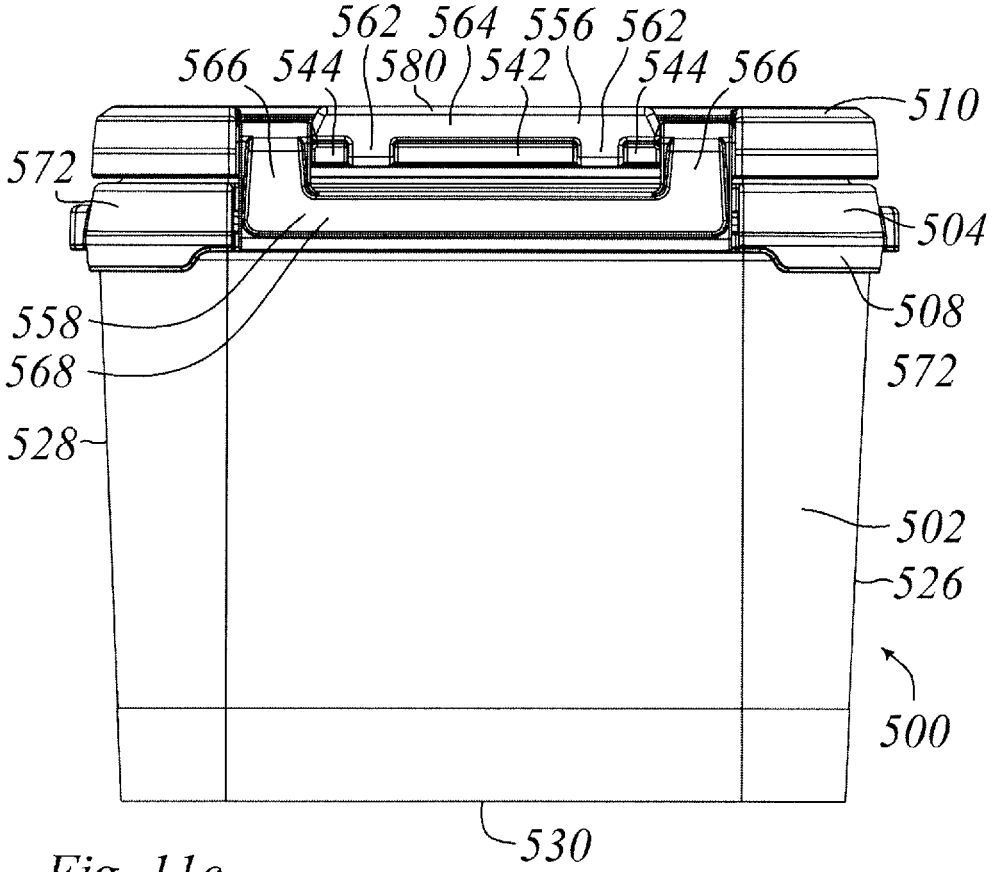
FIG. 11*c* shows a front view of the container assembly of FIG. 11*a;*
Figure 11D:
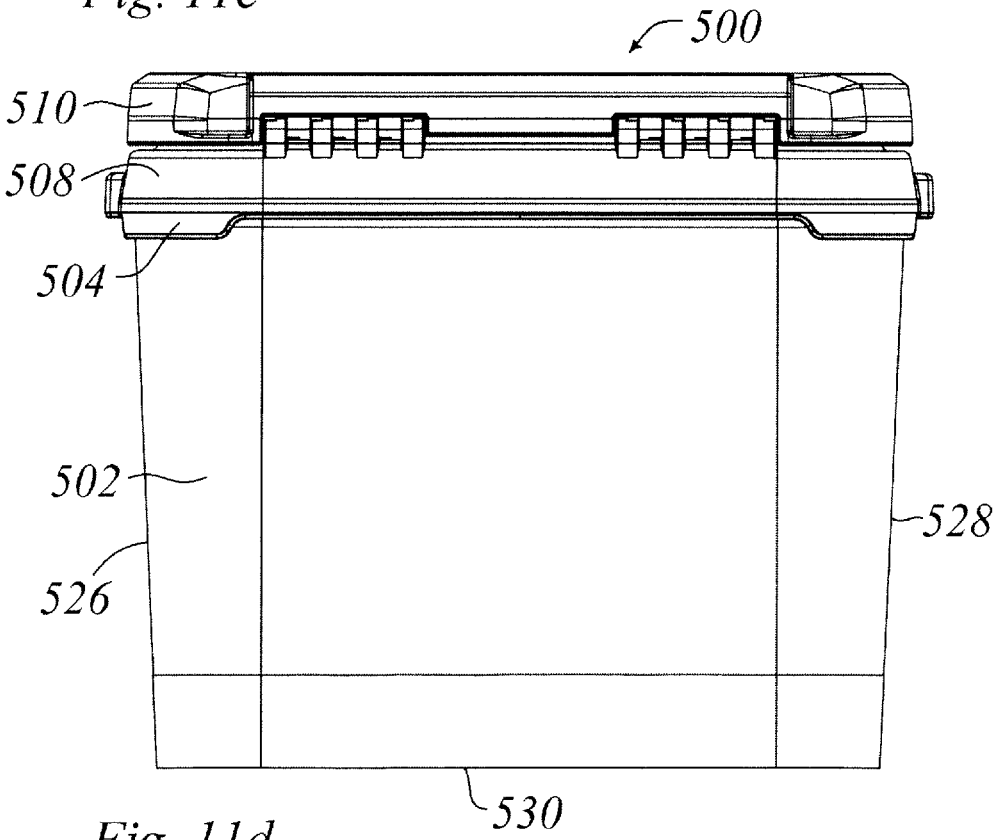
FIG. 11*d* shows a rear view of the container assembly of FIG. 11*a;*
Figure 11E:
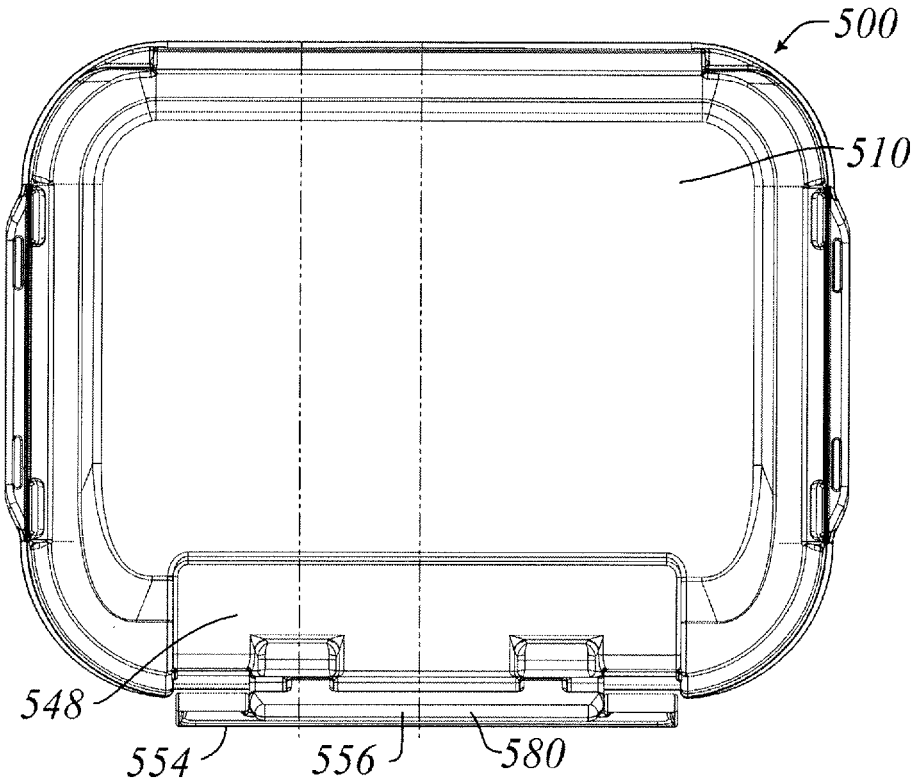
FIG. 11*e* shows a top view of the container assembly of FIG. 11*a;*
Figure 11F:
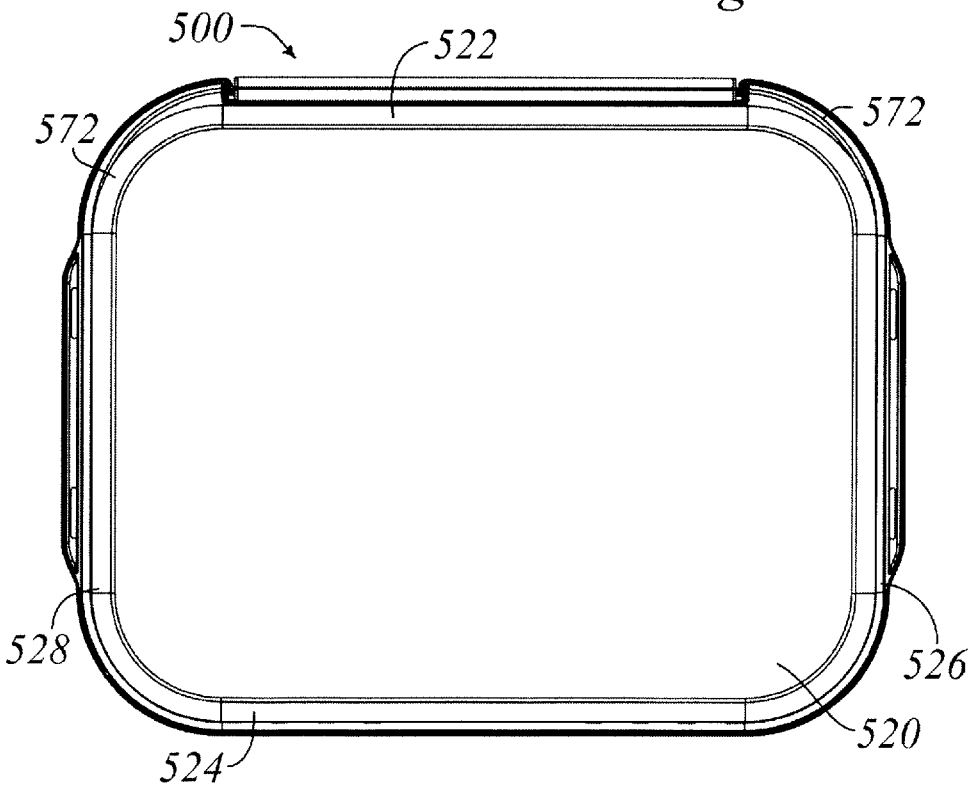
FIG. 11*f* shows a bottom view of the container assembly of FIG. 11*a;*
Figure 11H:
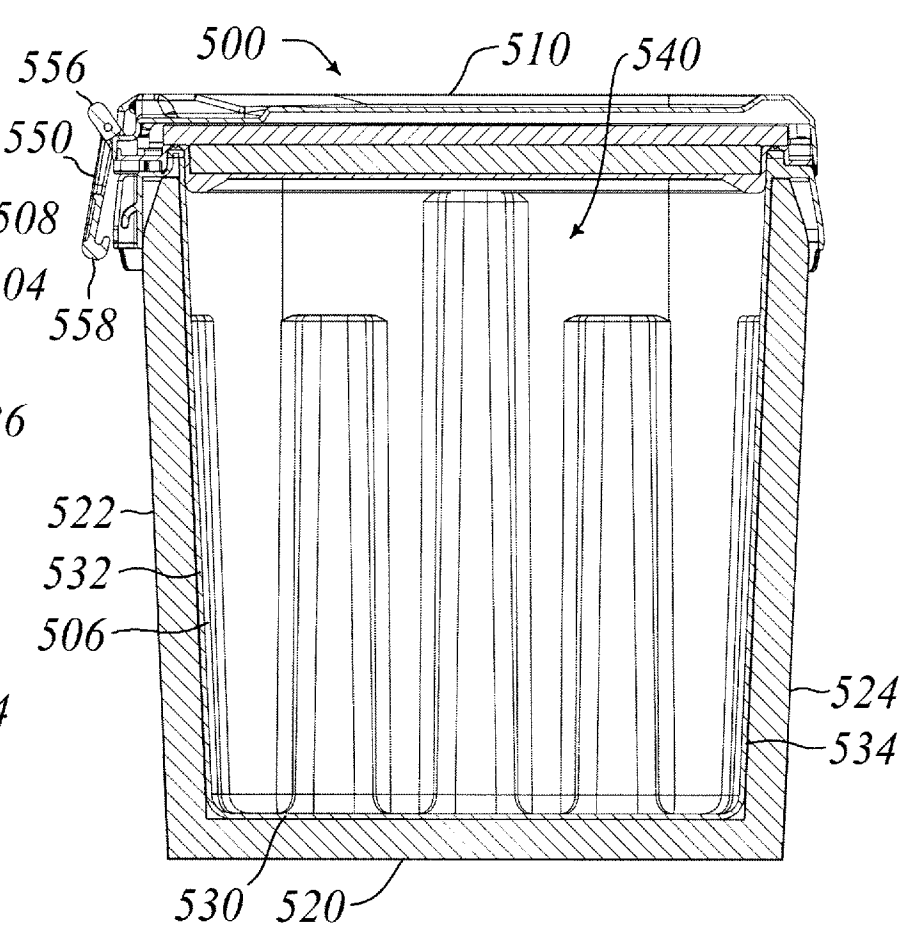
FIG. 11*h* shows a cross-section of the container assembly of FIG. 11*a* taken on section '11*h*-11*h*' of FIG. 11*c;*
Figure 11G:
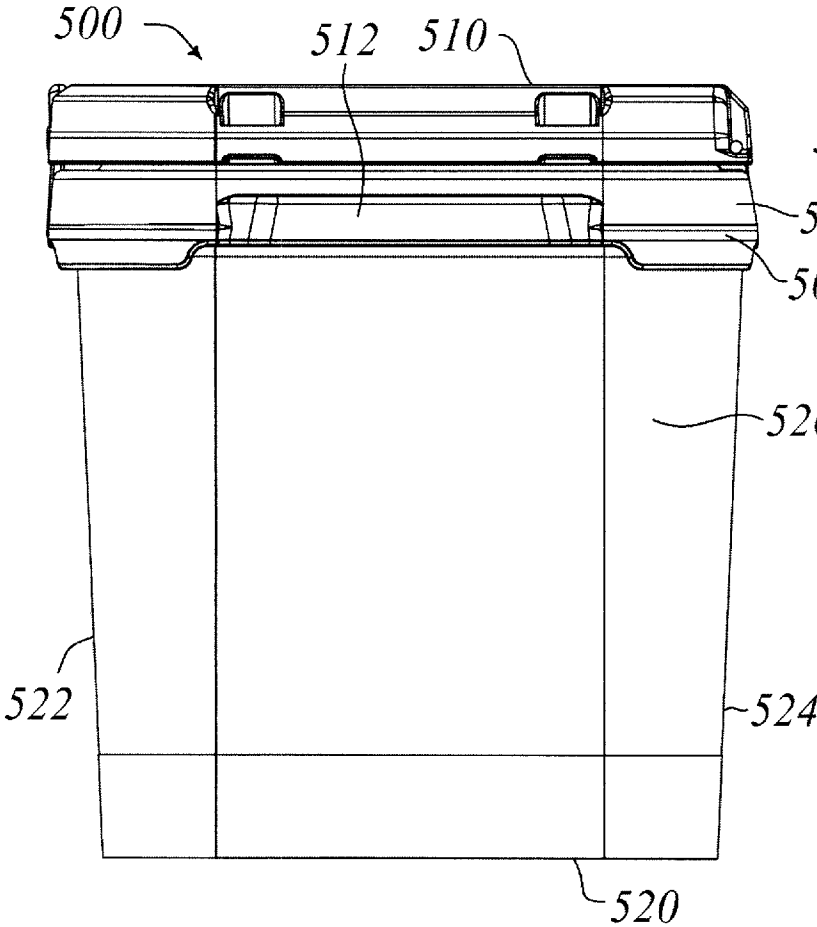
FIG. 11*g* shows a left-side view of the container assembly of FIG. 11*a;*
Figure 11I:
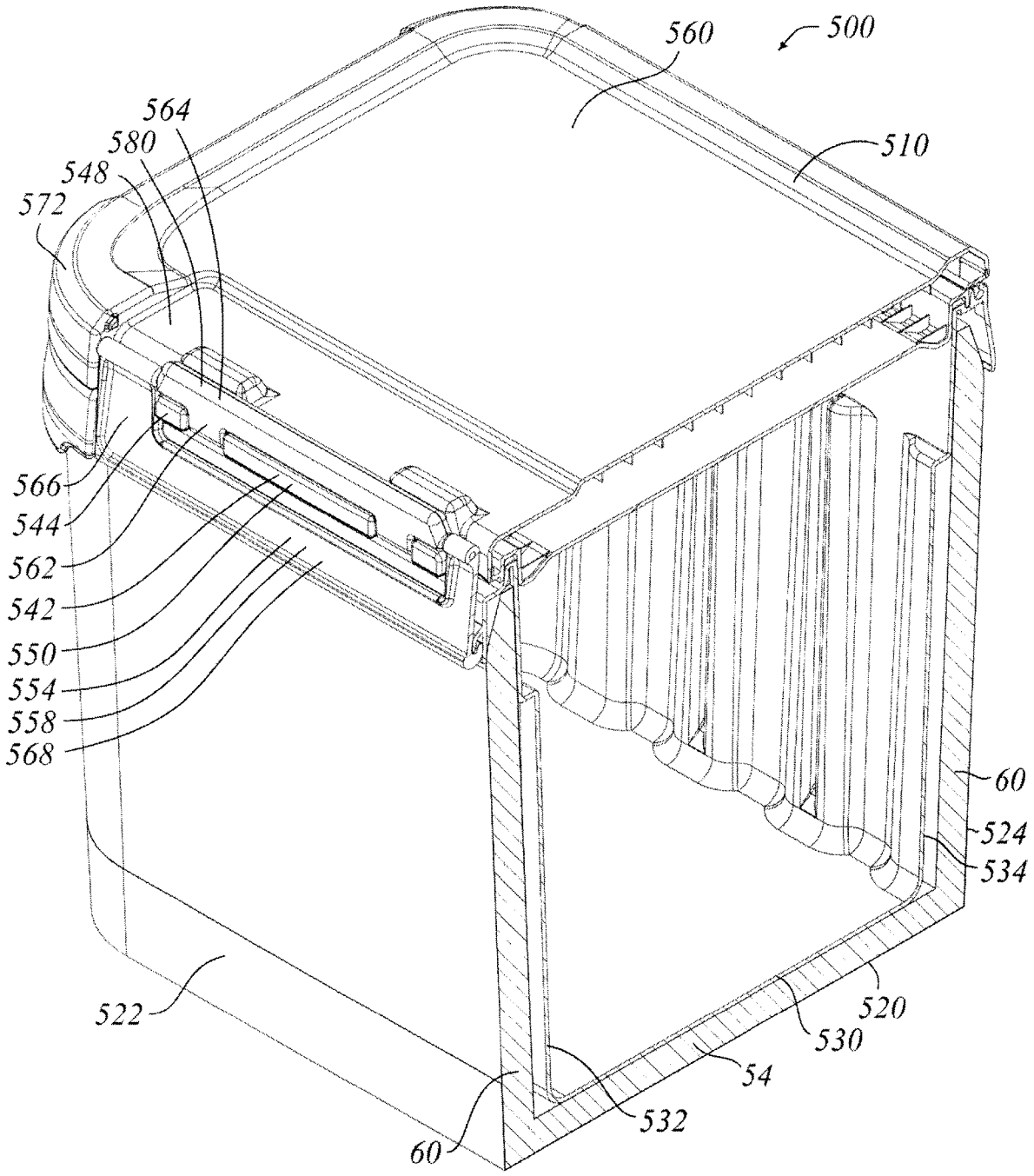
FIG. 11*i* shows a cross-section, in perspective taken through one arm of a lid latching assembly of the soft-sided insulated container assembly of FIG. 11*a* with the latching assembly in the closed and locked position.
Figures 11J, 11K:
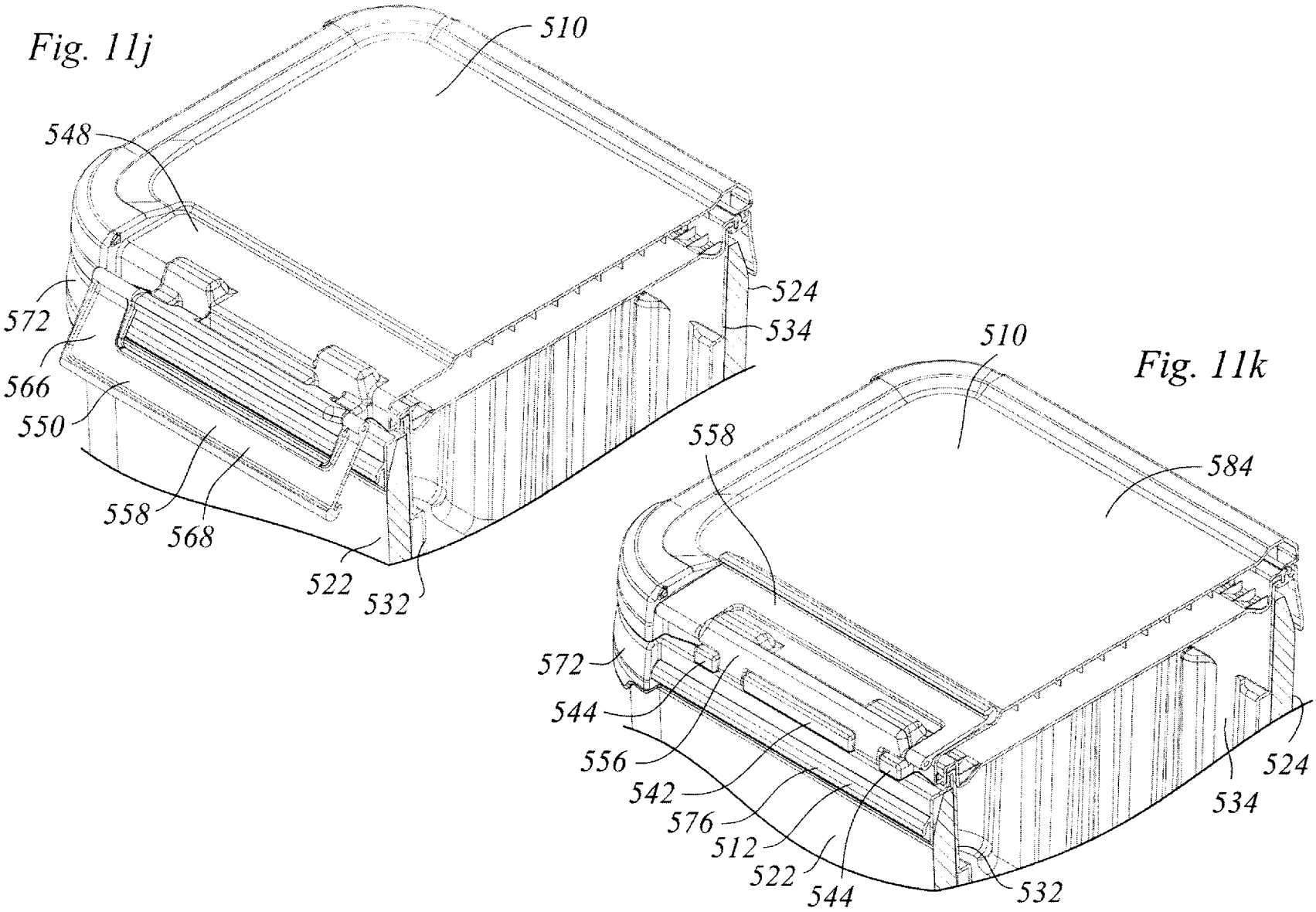
FIG. 11*j* shows an upper portion of the perspective view of FIG. 11*a*, in which the lid is passively closed, with the latch unlocked and released.
FIG. 11*k* shows the upper portion of FIG. 11*j* with the latch released and folded over onto the lid to lie flat.
Figures 12A, 12B:
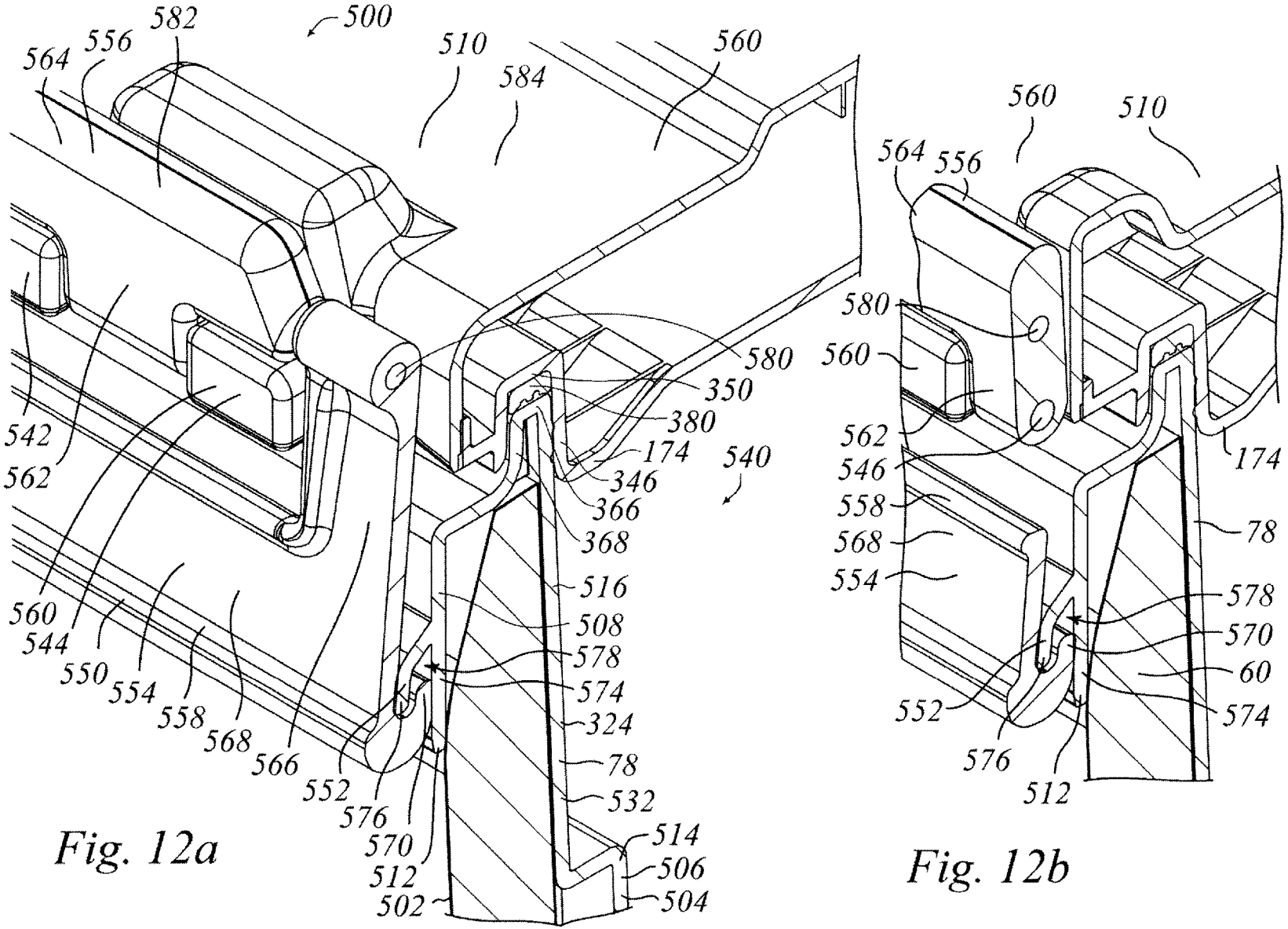
FIG. 12*a* shows an enlarged detail, in section, through the locking arm in enlarged detail of the latching assembly of the cross-section of FIG. 11*i* as locked.
FIG. 12*b* shows an adjacent section to that of FIG. 12*a*, through the crank arm of the latching assembly.
Figure 12C:
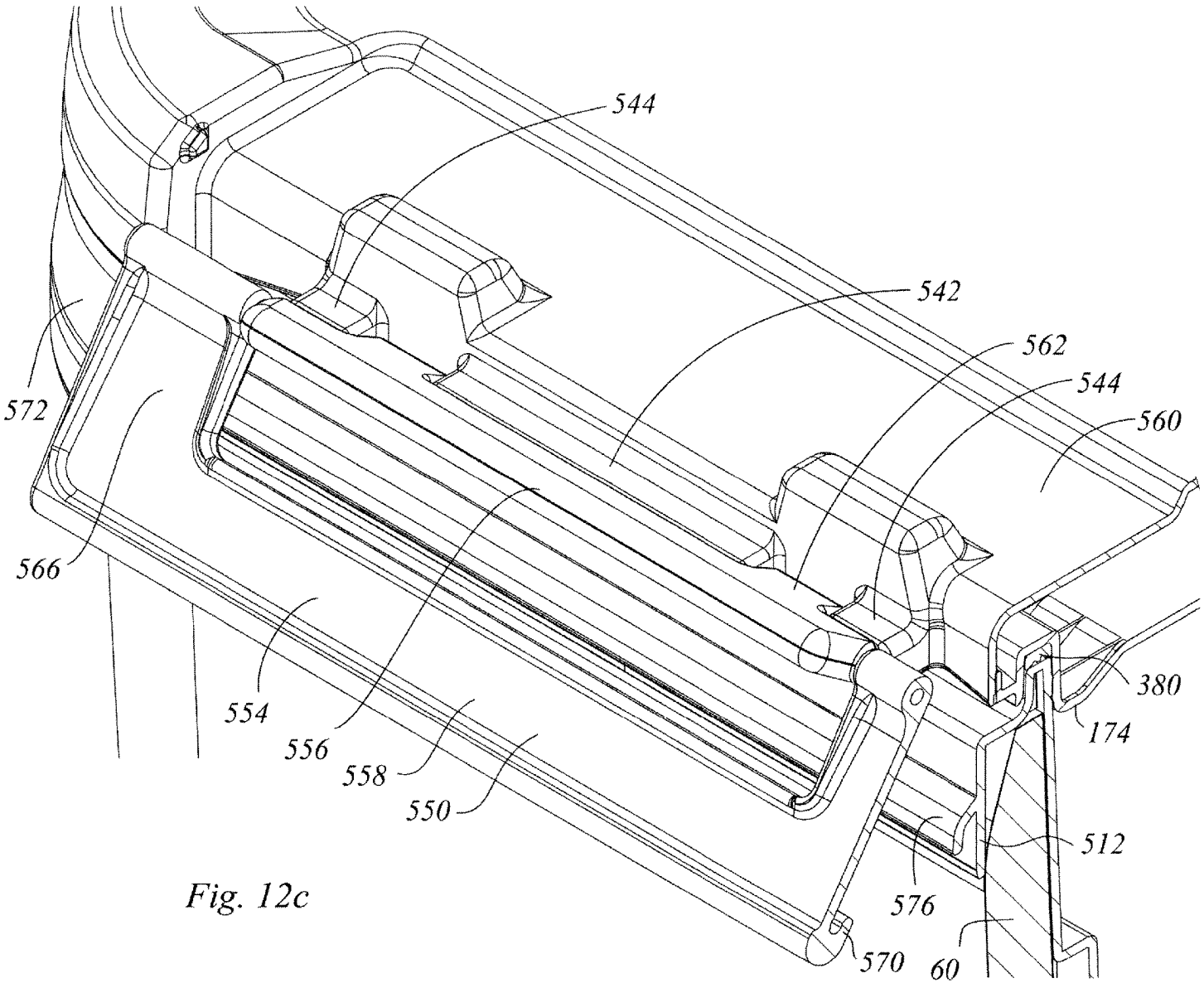
FIG. 12*c* shows an enlarged detail of the latching assembly of FIG. 12*a* in a released condition, with the near arm in section.
Figure 12F:
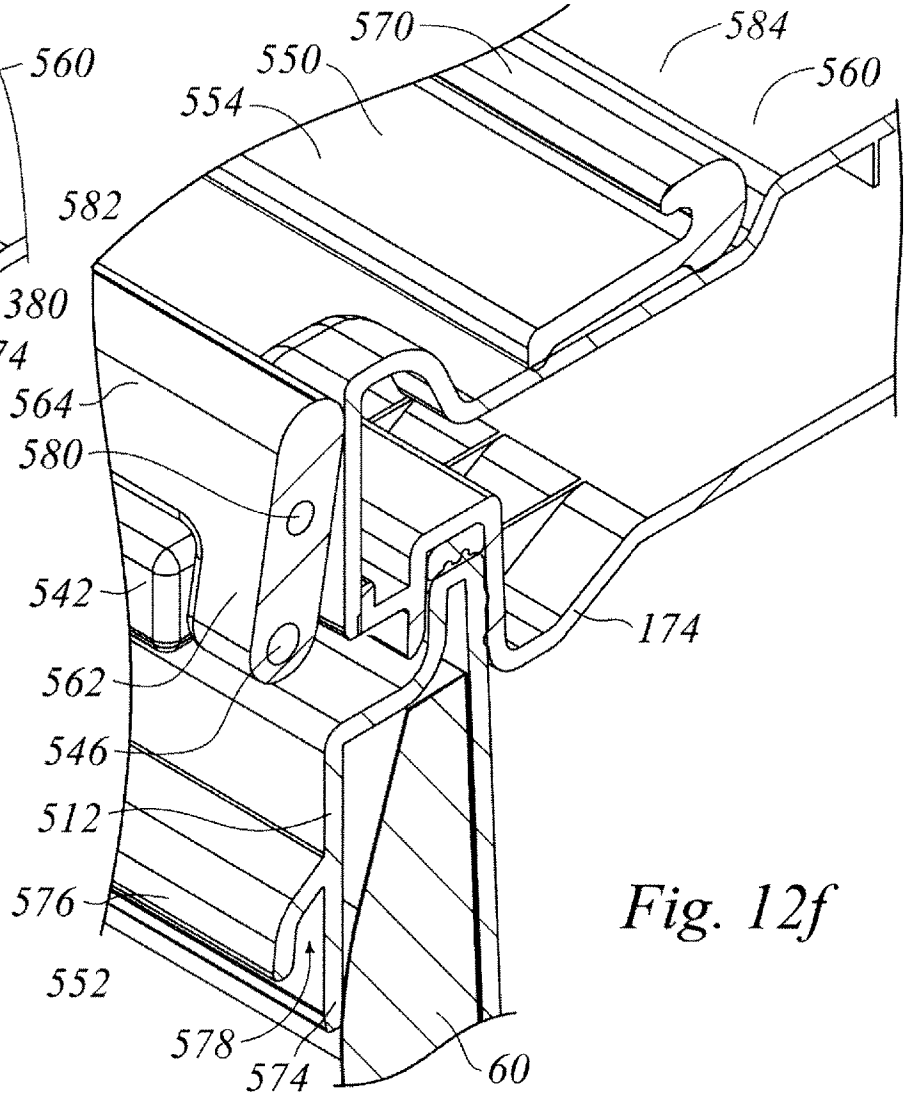
FIG. 12*f* shows the latching assembly of FIG. 12*e* as sectioned in FIG. 12*b*.
Figure 12D:
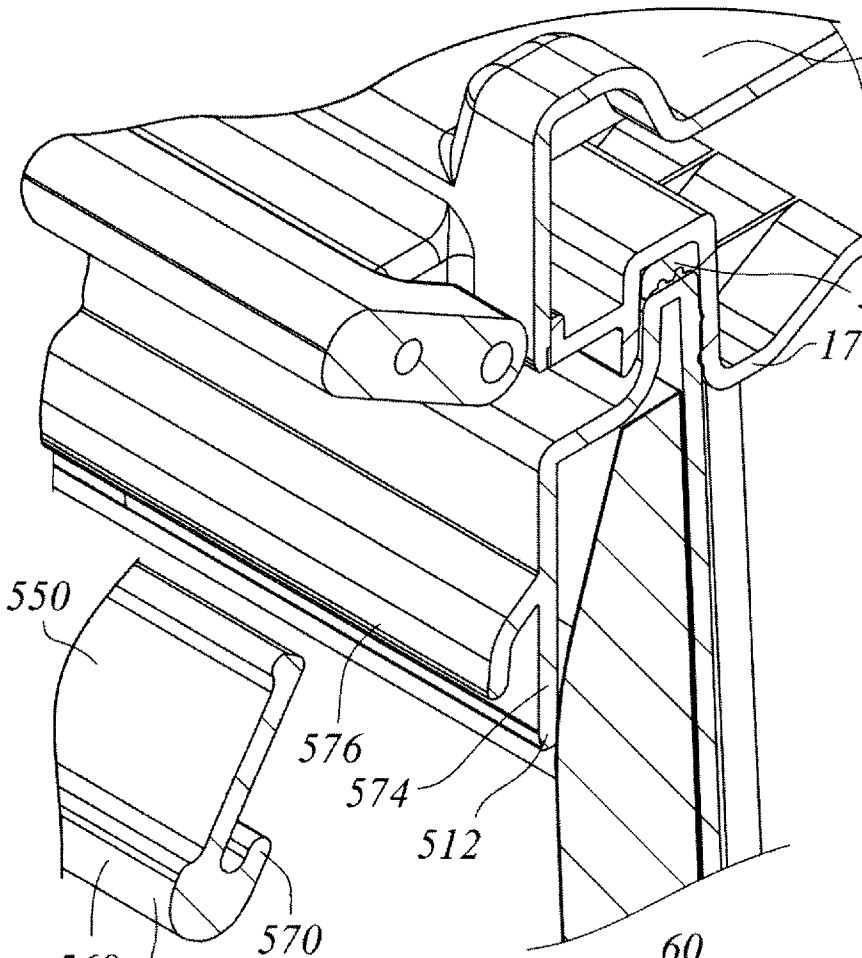
FIG. 12*d* shows the latching assembly in the position of FIG. 12*c* taken on the sectional location of FIG. 12*b;*
Figure 12E:
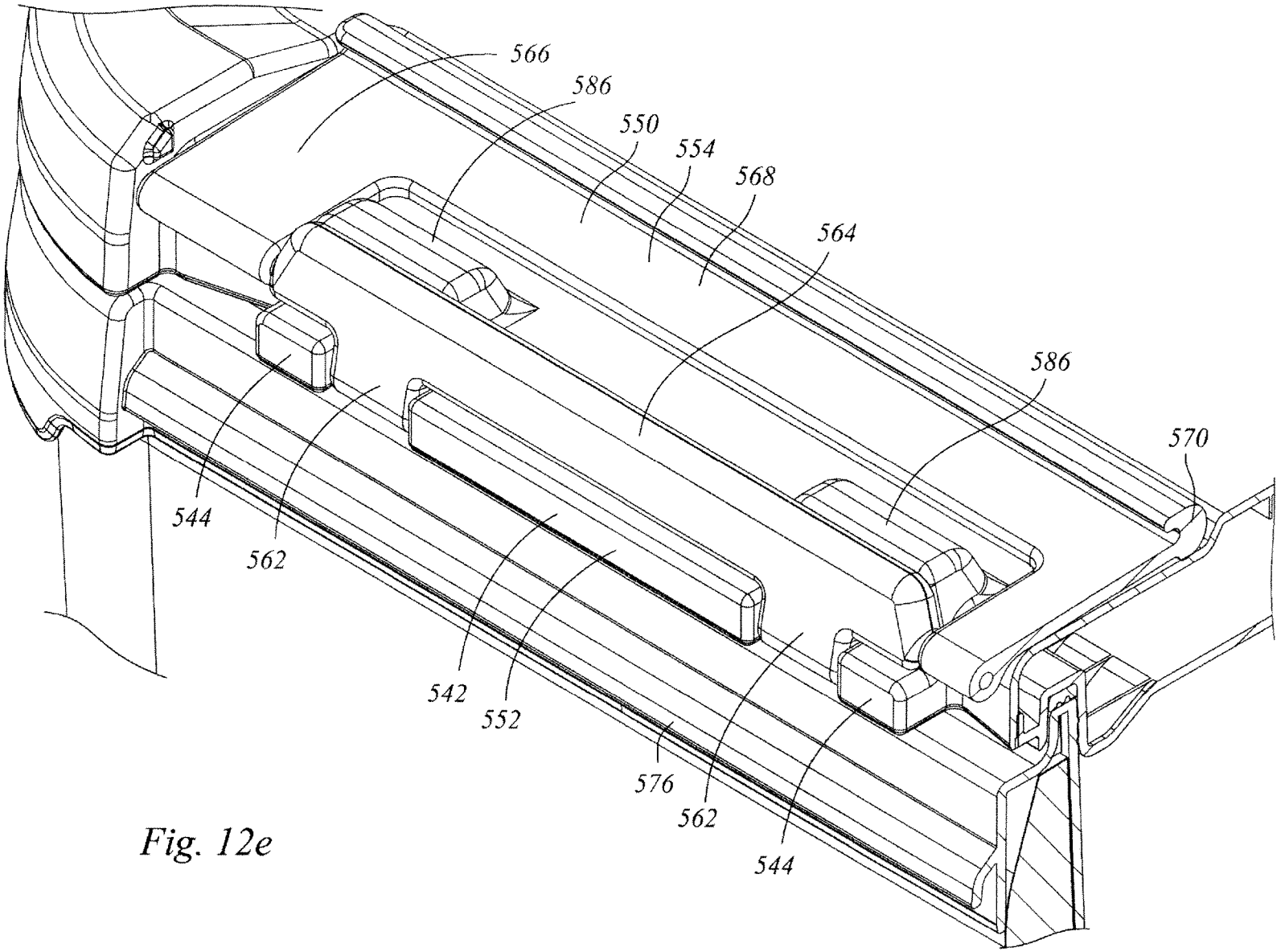
FIG. 12*e* shows the latching assembly of FIG. 12*a* in the released and fully rotated and stored position.

By contrast to the standard wall section of FIG. 9*a*, enlarged in FIG. 10*g*, the section FIG. 10*e* shows a section through a hinge fitting of the rear of container assembly 320, and FIG. 10*f* shows a comparable section other than at the location of a hinge. At the location of the hinge, top hat 350 has downwardly extending leg 464 that is shorter than customary leg 348, and back 352 has an extension 466 that runs outboard to intersect frame 340. As shown, back 352 and extension 466 are coplanar. In this configuration leg 464 forms a web or stem or T relative to the flange defined by back 352 and extension 466. Leg 464, back 352 and leg 346 form the channel in which seal 380 seats. An internal reinforcement, or gusset, 448 bridges the space between legs 366 and 378 under flange 446.

At the location of FIG. 10*e*, skirt 110 of frame 360 has an outer wall 468 that terminates upwardly in a hinge fitting 470, and a back 472 that runs from hinge fitting 470 to leg 366. Internal gussets 474 extend between inner wall 366 and outer wall 468, acting as a reinforcement or load spreader that holds the profile of the section. Lid assembly 330 has corresponding hinge fittings 476 that depend from extension 466 to lie in an axially corresponding position to hinge fitting 470. A hinge pin 478 passes between, and connects, fittings 470 and 476. The centerline of hinge pin 478 defines the pivot axis of lid assembly 330.

In the embodiment of FIGS. 11*a*-11*k* and 12*a*-12*f*, there is a soft-sided insulated container assembly 500 that may be taken as being of the same construction as soft-sided insulated container assembly 20 or soft-sided insulated container assembly 320. It has a soft-sided insulated main body, or casing, 502 and a rigid liner assembly 504, which may be that includes a main tub portion 506, which itself has a rim or flange assembly 508 and a lid assembly 510. Casing 502 and rigid liner assembly 504 may be understood to be releasably secured by releasable securement assemblies 120 located on the respective left-hand and right-hand side walls or end walls, as described above. As above, the structure is waterproof, and rigid liner assembly 540 has a pressure relief vent 146 which may be installed as indicated above.

As before, main body casing 502 has a substantially rectangular bottom wall panel 520 and an upstanding side-wall structure 518 that has first, second, third, and fourth portions identified as front wall panel 522, rear wall panel 524, left-hand wall panel 526 and right-hand wall panel 528. The upper portion of sidewall structure 518 ends in an upper peripheral margin or rim region 516 to which the first portion 122 of releasable securement 120 is mounted. Flange assembly 508 has second portion 124 of releasable securement 120 mounted thereto.

Similarly, as before, internal rigid liner container vessel, or tub, 506 has a rigid wall structure having a bottom wall panel 530, and an upstanding molded plastic rigid sidewall structure 514 that includes first, second, third and fourth upstanding wall panels, being front wall panel 532, rear wall panel 534, left-hand wall panel 536, and right-hand wall panel 538, those members co-operating with bottom wall panel 530 to form a five-sided, open-topped liquid containing vessel, the same as, or substantially the same as liner 26 described above. As before, lid assembly 510 and frame assembly 508 are joined along their respective rear margins by hinges, such that a pivot relationship is created, lid assembly 510 being movable between open and closed positions to govern access of objects to and from an internal chamber 540. The hinge fittings may be taken as being the same as previously described.

Soft-sided insulated container assembly 500 is different from soft-sided insulated container assemblies 20 and 320 insofar as the latching relationship is reversed such that the stationary portion is on the frame, and the moving portion is on the lid. That is, there is a latching interface defined by a latching assembly 550 that includes a stationary latching interface member, identified as an anchor, or hold, or keeper 552 that is mounted to, or forms part of, frame 508; and a movable latching assembly 554 that is mounted to lid assembly 510. Movable latching assembly 554 includes a first member identified as crank 556 and a second member, or drag link, identified as clasp 558. Crank 556 is pivotally mounted, or rooted, to a fixed pivot point on lid panel 560. In the example shown, crank 556 has a pair of short swing arms 562 and a cross-member 564 that extends between the distal swinging tips of arms 562. The toes of the short swing arms 562 are mounted in double shear connections to the pivot points on lid panel 560, between central molded anchor, or block 542 and left-hand and right-hand laterally outboard blocks 544 on a pivot axis identified as axle 546 in the sectional views.

The drag link, or clasp, 558 also has a pair of left-hand and right-hand spaced-apart arms, or legs 566 that bracket first member 556. Legs 566 are joined at their distal ends by a cross-member 568. Cross-member 568 terminates in a latch engagement member such as may have the form of a curved finger, or hook, 570 that, in use, engages keeper 552. In that regard, in place of skirt 110, the front margin of frame 508 has skirt 512 that runs between enlarged molded corner fittings 572. Skirt 512 has the downwardly extending leg 574 that corresponds to skirt 110, but, in addition, it has a forwardly outward spur forming a downward finger or catch 576. Catch 576 is located part way down the face of leg 574. The depending tip of catch 576 is spaced forwardly of leg 574 such that an accommodation 578 is formed between leg 574 and catch 576. The near ends, or attached ends, of legs 566 are pivotally connected to first member 556 by axle 580. Axle 580 is positioned at an intermediate location radially distant from the pivot axis of axle 546, such that the outer or distal portion of cross-member 568 extends radially beyond the axis of rotation of axle 580 and form a handle, or grip 582 that in use acts as a closing lever having a measure of mechanical advantage by virtue of the greater radius. In use, the tip of hook 570 seats in accommodation 578, and hook 570 clasps catch 576.

In use, as first member 556 rotates counter-clockwise, it tightens second member 558 onto catch 576, and may pass through an over-center condition as latching occurs, thus locking latching assembly 550 in the closed and locked position, and imposing a positive sealing force on seal 380, above and beyond the friction retention of lid assembly 510 relative to frame assembly 508. As may be noted, skirt 512 has an uninterrupted, clear lateral run between molded corner fittings 572. That is, there is no interruption, indentation, cavity, protrusion, boss, or block creating a discontinuity in the latching assembly interface. The clasp and the catch meet along more than half the length. In the embodiment shown, they meet over substantially the entire width between molded corner fittings 572. Accordingly, the latching force is spread along the mating of the hook and catch.

To open soft-sided insulated container assembly 500, the process is reversed. The user lifts forwardly and outwardly on handle or grip 582, to cause it to pass through the over-center condition, thus unlocking latch assembly 550. Once hook 570 is clear of catch 576, lid assembly 510 is in the passively closed condition, in which it is held closed by the passive, zipperless friction retention of the inner rib of the lid assembly against the upper rim of the tub. Latch assembly 550 may be moved further to a storage position by rotation of first member 556 in the opposite direction until it stops against abutments 586 at its rotational end-of-travel limit, after which second member 558 can be rotted until it seats in the conformal accommodation 548 defined in lid assembly 510. In this position, although hook 570 is facing upward, legs 566 are either partially or entirely recessed in accommodation 548 relative to the level of the main spanning portion 584 of lid assembly 510. In this condition, the movable latch assembly 554 is stored out of the way, and lid assembly 510 may be opened and closed by lifting to overcome the frictional fit.

The movable latching assembly 554 has three positions, or states, or conditions, namely a first position, seen in FIGS. 11*a*, 11*i*, 12*a* and 12*b*, in which it is latched and locked, and holds lid assembly 510 in a clamped, positive force watertight closure. It is movable to a second position, seen in FIGS. 11*e*, 11*h*, 11*j*, 12*c* and 12*d*, in which it is unlatched, and released from keeper 552, but lid assembly 510 remains closed in a friction fit condition as a zipperless closure that keeps warm or cold items in an insulated chamber, yet permits easy access merely by lifting lid assembly 510; and a third position seen in FIGS. 11*b*, 11*k*, 12*e* and 12*f*, in which latching assembly 554 is stowed in the recessed position in accommodation 548.

Various container body and lid combinations have been shown, or described, or both. The features of the various embodiments may be mixed and matched as may be appropriate without the need for further description of all possible variations, combinations, and permutations of those features.

The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only by a purposive reading of the appended claims.

We claim:

1. A soft-sided insulated container assembly comprising:
a first portion and a second portion;
the first portion having a soft-sided insulated wall structure that includes an upstanding soft-sided insulated peripheral wall;
said second portion including a surround that mates with said first portion;
said second portion including a closure movable between an open position and a closed position;
said closure having a movable member and a stationary member;
said closure having a first mode of securement and a second mode of securement;
in said first mode, when said movable member is closed relative to said stationary member, said movable member is in a friction fit with said stationary member, said friction fit discouraging said movable member from disengaging from said stationary member;
in said second mode, when said movable member is closed relative to said stationary member, said movable member is retained by a locking force other than said friction fit; and
said container assembly has a pressure relief vent, and, when said container assembly is closed, said container assembly is waterproof.

2. The soft-sided insulated container assembly of claim 1 wherein there is a first closure interface between said movable member and said stationary member, and in closing in said first mode said movable member rubs across said stationary member.

3. The soft-sided insulated container assembly of claim 2 wherein there is a second closure interface between said movable member and said stationary member, and in closing in said second mode said movable member applies a normal force to said second closure interface, said normal force exceeding frictional force between said movable member and said stationary member.

4. The soft-sided insulated container assembly of claim 1 wherein there is a closure interface between said movable and stationary members; in moving from said open position to said closed position said movable member moves in a closing direction; there is a seal located at said closure interface; and said locking force is applied in said closing direction.

5. The soft-sided insulated container assembly of claim 4 wherein in said second mode said locking force is applied normal to said seal.

6. The soft-sided insulated container assembly of claim 1 wherein:

there is a first closure interface between said movable member and said stationary member, and a second closure interface between said movable member and said stationary member;

in closing in said first mode said movable member rubs across said stationary member in said friction fit; and in closing in said second mode said movable member moves predominantly normal to said second closure interface.

7. The soft-sided insulated container assembly of claim 6 wherein, in moving from said open position to said closed position, said movable member closes in said first mode prior to closing in said second mode.

8. The soft-sided insulated container assembly of claim 1 wherein in said second mode said movable member and said stationary member co-operate to form a water-tight seal.

9. The soft-sided insulated container assembly of claim 6 wherein a seal is trapped between said movable member and said stationary member; said seal has a first portion and a second portion; said first portion of said seal defines a wiper that deflects in said first mode; said second portion of said seal defines a ring that is compressed when energized in said second mode.

10. The soft-sided insulated container assembly of claim 9 wherein:

said seal is a resilient seal mounted to said movable member;

said wiper is one of (a) a peripherally outwardly extending deflectable vane, and (b) a hollow bulb;

said stationary member includes a flanged shoulder having a first leg and a second leg forming an angle, said first leg being a peripherally outwardly extending flange defining a land engaged by said ring in said second mode; and said second leg having an axially extending surface engaged by said wiper in said first mode.

11. The soft-sided insulated container assembly of claim 1 wherein said stationary member includes a frame that extends about a peripheral lip of said second portion, and said frame defines an opening of said soft-sided insulated container through which objects pass upon entry to an internal chamber of said soft-sided insulated container assembly.

12. The soft-sided insulated container assembly of claim 1 wherein said second portion includes a rigid molded liner that seats within said first portion.

13. The soft-sided insulated container assembly of claim 1 wherein said second portion includes a rigid molded liner having a liquid containment wall; and said stationary member of said second portion defines a peripheral flange structure of said rigid molded liner.

14. The soft-sided insulated container assembly of claim 1 wherein said second portion includes at least a first clamp, and in said second mode said clamp is operable to secure said movable member in said closed position relative to said stationary member.

15. The soft-sided insulated container assembly of claim 1 wherein said movable member is connected to said stationary member at a hinge; said second portion includes two clamps operable to secure said movable member in said closed position relative to said stationary member; and said clamps are mounted in opposition to said hinge.

16. The soft-sided insulated container assembly of claim 1 wherein said second portion defines a rigid liner that seats within said first portion; and, when said rigid liner is located within said first portion, said second portion is releasably secured to said first portion whereby said rigid liner is releasably secured to said upstanding soft-sided insulated peripheral wall of said soft-sided insulated wall structure.

17. The soft-sided insulated container assembly of claim 16 wherein said second portion is releasably secured to said first portion by one-way engagement fittings, said one-way engagement fittings having a releasable catch.

18. The soft-sided insulated container assembly of claim 16 wherein:

said first portion has an uppermost peripheral margin;

said rigid liner is a rigid molding;

said second portion includes a peripheral frame that defines an access-way to said rigid liner;

said stationary member is defined by said peripheral frame;

said movable member is hingedly mounted to said peripheral frame;

said peripheral frame of said second portion includes an outermost downwardly depending skirt that overhangs said uppermost peripheral margin of said first portion;

said peripheral frame of said second portion has an inward facing releasable one-way catch located inwardly of said downwardly depending skirt;

said uppermost peripheral margin of said first portion has an outwardly facing cleat;

on insertion of said rigid liner of said second portion within said upstanding peripheral wall of said first portion, said one-way catch of said peripheral frame of said second portion engages said cleat of said uppermost peripheral margin of said first portion to retain said rigid liner of said second portion within said upstanding peripheral wall of said first portion; and said downwardly depending skirt is outwardly flexible away from said rigid liner to release said one-way catch.

19. The soft-sided insulated container assembly of claim 1 wherein said first portion includes at least one water-tight envelope membrane.

20. A soft-sided insulated container comprising: an insulated soft-sided external casing and a rigid internal liner, the insulated soft-sided external casing having a releasable securement operable to retain said rigid internal liner within said insulated soft-sided external casing;

said rigid internal liner has a rim that defines an opening of said liner providing access to a chamber formed within said liner;

a lid is hingedly mounted to said rim and is movable between open and closed conditions to govern access to said chamber;

said chamber has a first closure mode and a second closure mode, said first closure mode being a friction fit of said lid in engagement with said rim; and said second closure mode being an active closure energized by a latching mechanism.

21. The soft-sided insulated container of claim 20 wherein said releasable securement is a one-way catch that engages passively on insertion of said liner within said soft-sided external casing, and is actively disengaged to permit removal of said liner from within said soft-sided external casing.

22. The soft-sided insulated container of claim 20 wherein said rim has a downwardly depending skirt that overhangs said soft-sided external casing.

23. The soft sided insulated container of claim 22 wherein said releasable securement includes a reinforcement mounted within said downwardly depending skirt.

24. The soft-sided insulated container of claim 22 wherein said releasable securement includes a cleat mounted to said soft-sided external casing and a catch mounted within said downwardly depending skirt.

25. The soft-sided insulated container of claim 24 wherein said skirt is transversely deformable to release said catch from said cleat.

26. The soft-sided insulated container of claim 20 wherein said rigid internal liner has a lid, and said lid has a watertight seal.

27. The soft-sided insulated container of claim 20 wherein said rigid internal liner has the form of a molded plastic tub that forms a liquid containment vessel.

28. The soft-sided insulated container of claim 20 wherein said rim includes a peripherally extending depending skirt, there being an upwardly extending recess defined between said downwardly depending skirt and a peripheral wall portion of said liner lying inwardly of said rim; and said soft sided insulated wall structure has an uppermost margin that seats in said recess between said skirt and said peripheral wall portion.

29. The soft-sided insulated container of claim 20 wherein said container has a pressure relief vent.

30. A soft-sided insulated container assembly comprising:

a first portion and a second portion;

the first portion having a soft-sided insulated wall structure that includes an upstanding soft-sided insulated peripheral wall;

said second portion including a surround that mates with said first portion;

said second portion including a closure movable between an open position and a closed position;

said closure having a movable member and a stationary member;

said closure having a first mode of securement and a second mode of securement;

in said first mode, when said movable member is closed relative to said stationary member, said movable member is in a friction fit with said stationary member, said friction fit discouraging said movable member from disengaging from said stationary member;

in said second mode, when said movable member is closed relative to said stationary member, said movable member is retained by a locking force other than said friction fit;

there is a first closure interface between said movable member and said stationary member, and a second closure interface between said movable member and said stationary member;

in closing in said first mode said movable member rubs across said stationary member in said friction fit;

in closing in said second mode said movable member moves predominantly normal to said second closure interface;

a seal is trapped between said movable member and said stationary member;

said seal has a first portion and a second portion; said first portion of said seal defines a wiper that deflects in said first mode; and said second portion of said seal defines a ring that is compressed when energized in said second mode.

31. The soft-sided insulated container assembly of claim 30 wherein said locking force exceeds frictional force between said movable member and said stationary member.

32. The soft-sided insulated container assembly of claim 30 wherein in moving from said open position to said closed position said movable member moves in a closing direction; and said locking force is applied in said closing direction.

33. The soft-sided insulated container assembly of claim 32 wherein in said second mode said locking force is applied normal to said seal.

34. The soft-sided insulated container assembly of claim 30 wherein, in moving from said open position to said closed position, said movable member closes in said first mode prior to closing in said second mode.

35. The soft-sided insulated container assembly of claim 30 wherein in said second mode said movable member and said stationary member co-operate to form a water-tight seal.

36. The soft-sided insulated container assembly of claim 30 wherein:

said seal is a resilient seal mounted to said movable member;

said wiper is one of (a) a peripherally outwardly extending deflectable vane, and (b) a hollow bulb;

said stationary member includes a flanged shoulder having a first leg and a second leg forming an angle, said first leg being a peripherally outwardly extending flange defining a land engaged by said ring in said second mode; and said second leg having an axially extending surface engaged by said wiper in said first mode.

37. The soft-sided insulated container assembly of claim 30 wherein said stationary member includes a frame that extends about a peripheral lip of said second portion, and said frame defines an opening of said soft-sided insulated container through which objects pass upon entry to an internal chamber of said soft-sided insulated container.

38. The soft-sided insulated container assembly of claim 30 wherein said second portion includes a rigid molded liner that seats within said first portion.

39. The soft-sided insulated container assembly of claim 30 wherein said second portion includes a rigid molded liner having a liquid containment wall; and said stationary member of second portion defines a peripheral flange structure of said rigid molded liner.

40. The soft-sided insulated container assembly of claim 30 wherein said second portion includes at least a first clamp, and in said second mode said clamp is operable to secure said movable member in said closed position relative to said stationary member.

41. The soft-sided insulated container assembly of claim 30 wherein said movable member is connected to said stationary member at a hinge; said second portion includes two clamps operable to secure said movable member in said closed position relative to said stationary member; and said clamps are mounted in opposition to said hinge.

42. A soft-sided insulated container assembly comprising:

a first portion and a second portion;

the first portion having a soft-sided insulated wall structure that includes an upstanding soft-sided insulated peripheral wall;

said second portion including a surround that mates with said first portion;

said second portion including a closure movable between an open position and a closed position;

said closure having a movable member and a stationary member;

said closure having a first mode of securement and a second mode of securement;

in said first mode, when said movable member is closed relative to said stationary member, said movable member is in a friction fit with said stationary member, said friction fit discouraging said movable member from disengaging from said stationary member;

in said second mode, when said movable member is closed relative to said stationary member, said movable member is retained by a locking force other than said friction fit;

said second portion defines a rigid liner that seats within said first portion; and, when said rigid liner is located within said first portion, said second portion is releasably secured to said first portion whereby said rigid liner is releasably secured to said upstanding soft-sided insulated peripheral wall of said soft-sided insulated wall structure.

43. The soft-sided insulated container assembly of claim 42 wherein there is a first closure interface between said movable member and said stationary member, and in closing in said first mode said movable member rubs across said stationary member.

44. The soft-sided insulated container assembly of claim 43 wherein there is a second closure interface between said movable member and said stationary member, and in closing in said second mode said movable member applies a normal force to said second closure interface, said normal force exceeds frictional force between said movable member and said stationary member.

45. The soft-sided insulated container assembly of claim 42 wherein there is a closure interface between said movable and stationary members; in moving from said open position to said closed position said movable member moves in a closing direction; there is a seal located at said closure interface; and said locking force is applied in said closing direction.

46. The soft-sided insulated container assembly of claim 45 wherein in said second mode said locking force is applied normal to said seal.

47. The soft-sided insulated container assembly of claim 42 wherein:

there is a first closure interface between said movable member and said stationary member, and a second closure interface between said movable member and said stationary member;

in closing in said first mode said movable member rubs across said stationary member in said interference fit; and in closing in said second mode said movable member moves predominantly normal to said second closure interface.

48. The soft-sided insulated container assembly of claim 47 wherein, in moving from said open position to said closed position, said movable member closes in said first mode prior to closing in said second mode.

49. The soft-sided insulated container assembly of claim 42 wherein in said second mode said movable member and said stationary member co-operate to form a water-tight seal.

50. The soft-sided insulated container assembly of claim 47 wherein a seal is trapped between said movable member and said stationary member; said seal has a first portion and a second portion; said first portion of said seal defines a wiper that deflects in said first mode; said second portion of said seal defines a ring that is compressed when energized in said second mode.

51. The soft-sided insulated container assembly of claim 42 wherein:

said seal is a resilient seal mounted to said movable member;

said wiper is one of (a) a peripherally outwardly extending deflectable vane, and (b) a hollow bulb;

said stationary member includes a flanged shoulder having a first leg and a second leg forming an angle, said first leg being a peripherally outwardly extending flange defining a land engaged by said ring in said second mode; and said second leg having an axially extending surface engaged by said wiper in said first mode.

52. The soft-sided insulated container assembly of claim 42 wherein said stationary member includes a frame that extends about a peripheral lip of said second portion, and said frame defines an opening of said soft-sided insulated container assembly through which objects pass upon entry to an internal chamber of said soft-sided insulated container assembly.

53. The soft-sided insulated container assembly of claim 42 wherein said second portion includes a rigid molded liner that seats within said first portion.

54. The soft-sided insulated container assembly of claim 42 wherein said second portion includes a rigid molded liner having a liquid containment wall; and said stationary member of said second portion defines a peripheral flange structure of said rigid molded liner.

55. The soft-sided insulated container assembly of claim 42 wherein said second portion includes at least a first clamp, and in said second mode said clamp is operable to secure said movable member in said closed position relative to said stationary member.

56. The soft-sided insulated container assembly of claim 42 wherein said movable member is connected to said stationary member at a hinge; said second portion includes two clamps operable to secure said movable member in said closed position relative to said stationary member; and said clamps are mounted in opposition to said hinge.

57. The soft-sided insulated container assembly of claim 42 wherein said second portion is releasably secured to said first portion by one-way engagement fittings, said one-way engagement fittings having a releasable catch.

58. A soft-sided insulated container comprising:

an insulated soft-sided external casing and a rigid internal liner, the insulated soft-sided external casing having a releasable securement operable to retain said rigid internal liner within said insulated soft-sided external casing;

said rigid internal liner includes a rim defining an opening thereof;

said rim has a downwardly depending skirt that overhangs said soft-sided external casing;

said releasable securement includes a cleat mounted to said soft-sided external casing and a catch mounted within said downwardly depending skirt; and said skirt is transversely deformable to release said catch from said cleat.

59. The soft-sided insulated container of claim 58 wherein said catch of said releasable securement is a one-way catch that engages passively on insertion of said liner within said soft-sided external casing, and is actively disengaged to permit removal of said liner from within said soft-sided external casing.

60. The soft sided insulated container of claim 58 wherein said releasable securement includes a reinforcement mounted within said downwardly depending skirt.

61. The soft-sided insulated container of claim 58 wherein said liner has a lid, and said lid has a watertight seal.

62. The soft-sided insulated container of claim 58 wherein said rigid internal liner has the form of a molded plastic tub that forms a liquid containment vessel.

63. The soft-sided insulated container of claim 58 wherein said container has a pressure relief vent.

* * * * *